US007713672B2

(12) United States Patent
Watanabe et al.

(10) Patent No.: US 7,713,672 B2
(45) Date of Patent: May 11, 2010

(54) IMAGE FORMING APPARATUS, IMAGE FORMING METHOD AND PROCESS CARTRIDGE

(75) Inventors: Yohichiroh Watanabe, Fuji (JP); Yasuaki Iwamoto, Numazu (JP); Yasutada Shitara, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 316 days.

(21) Appl. No.: 11/755,484

(22) Filed: May 30, 2007

(65) Prior Publication Data

US 2007/0281236 A1 Dec. 6, 2007

(30) Foreign Application Priority Data

Jun. 2, 2006 (JP) ..... 2006-155237

(51) Int. Cl.
*G03G 15/02* (2006.01)
*G03G 15/06* (2006.01)
*G03G 15/16* (2006.01)

(52) U.S. Cl. ..... 430/123.5; 399/168; 399/297

(58) Field of Classification Search ..... 430/123.5, 430/109.4; 399/168, 222, 297, 350
See application file for complete search history.

(56) References Cited

U.S. PATENT DOCUMENTS

| | | | | |
|---|---|---|---|---|
| 4,863,825 | A | 9/1989 | Yoshimoto et al. | |
| 5,156,937 | A | 10/1992 | Alexandrovich et al. | |
| 7,166,403 | B2 | 1/2007 | Ichikawa et al. | |
| 7,198,874 | B2 | 4/2007 | Saito et al. | |
| 2005/0079433 | A1 | 4/2005 | Watanabe et al. | |
| 2005/0089786 | A1 | 4/2005 | Sugiura et al. | |
| 2005/0089787 | A1 | 4/2005 | Uchinokura et al. | |
| 2005/0277046 | A1 | 12/2005 | Sawada et al. | |
| 2006/0057487 | A1* | 3/2006 | Nagayama et al. | 430/109.4 |
| 2006/0068312 | A1 | 3/2006 | Yamashita et al. | |
| 2006/0068313 | A1* | 3/2006 | Nakayama et al. | 430/109.4 |
| 2006/0160011 | A1 | 7/2006 | Inoue et al. | |
| 2006/0165989 | A1 | 7/2006 | Takikawa et al. | |
| 2006/0204883 | A1 | 9/2006 | Nakayama et al. | |
| 2006/0240349 | A1 | 10/2006 | Watanabe et al. | |
| 2006/0240351 | A1 | 10/2006 | Sugiura et al. | |
| 2007/0031748 | A1 | 2/2007 | Kotsugai et al. | |
| 2007/0031752 | A1 | 2/2007 | Watanabe et al. | |
| 2008/0261131 | A1 | 10/2008 | Nakayama et al. | |

FOREIGN PATENT DOCUMENTS

| | | | |
|---|---|---|---|
| DE | 37 38 024 | A1 | 5/1988 |
| EP | 1 701 220 | A2 | 9/2006 |
| JP | 63-313182 | | 12/1988 |
| JP | 1-263679 | | 10/1989 |
| JP | 2-82267 | | 3/1990 |
| JP | 4-70765 | | 3/1992 |
| JP | 4-307557 | | 10/1992 |
| JP | 5-341617 | | 12/1993 |
| JP | 8-22206 | | 1/1996 |
| JP | 10-307419 | | 11/1998 |
| JP | 3194396 | | 6/2001 |
| JP | 3289051 | | 3/2002 |
| JP | 2004-245854 | | 9/2004 |
| WO | WO 2005/031469 | A2 | 4/2005 |

OTHER PUBLICATIONS

U.S. Appl. No. 12/297,952, filed Oct. 21, 2008, Iwamoto, et al.
U.S. Appl. No. 11/738,149, filed Apr. 20, 2007, Iwamoto, et al.
U.S. Appl. No. 11/755,517, filed May 30, 2007, Iwamoto, et al.
U.S. Appl. No. 11/934,929, filed Nov. 21, 2007, Nakayama, et al.
U.S. Appl. No. 12/112,601, filed Apr. 30, 2008, Sabu, et al.
U.S. Appl. No. 12/118,006, filed May 9, 2008, Nakayama, et al.
U.S. Appl. No. 12/253,558, filed Oct. 17, 2008, Nakayama et al.
U.S. Appl. No. 12/142,311, filed Jun. 19, 2008, Nakayama, et al.
U.S. Appl. No. 11/943,972, filed Nov. 21, 2007, Nakayama, et al.
U.S. Appl. No. 11/950,114, filed Dec. 4, 2007, Shitara, et al.
U.S. Appl. No. 11/956,378, filed Dec. 14, 2007, Shu, et al.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

To provide an image forming apparatus including a latent electrostatic image bearing member; a charging unit; an exposing unit; a developing unit; a transferring unit; and a fixing unit, wherein the binder resin of a toner comprises a polyester-based resin (A) and a polyester-based resin (B) having a melting point which is at least 10° C. higher than that of the polyester-based resin (A), the polyester-based resins (A) is a resin which is derived from a (meth)acrylic acid-modified rosin and which has a polyester unit obtained by condensation polymerization of an alcohol component and a carboxylic acid component containing a (meth)acrylic acid-modified rosin, and the polyester-based resin (B) is a resin derived from a fumaric acid/maleic acid-modified rosin and has a polyester unit obtained by condensation polymerization of an alcohol component and a carboxylic acid component containing any one of a fumaric acid-modified rosin and a maleic acid-modified rosin.

23 Claims, 14 Drawing Sheets

IMAGE FORMING APPARATUS, IMAGE FORMING METHOD AND PROCESS CARTRIDGE

BACKGROUND OF THE INVENTION

1. Field of the Invention

The present invention relates to an electrophotographic image forming apparatus such as a copying machine, an electrostatic printing machine, a printer, a facsimile and an electrostatic recording machine, an image forming method, and a process cartridge.

2. Description of the Related Art

Various known methods have hitherto been used for formation of an electrophotographic image. In general, the surface of a latent electrostatic image bearing member (hereinafter sometimes referred to as a "photoconductor," an "electrophotoconductor" or an "image bearing member") is charged and the charged surface is then exposed to form a latent electrostatic image thereon. Subsequently, the latent electrostatic image is developed with a toner to form a visualized image on the latent electrostatic image bearing member. The visualized image thus formed is transferred onto a recording medium directly or through an intermediate transfer member and the visualized image thus transferred is fixed to the medium by application of heat and/or pressure to obtain a record in which the image is formed on the recording medium. The toner particles left on the latent electrostatic image bearing member after transferring the visualized image are then removed with a known method that uses a blade, a brush, a roller or the like.

As a full color image forming apparatus which utilizes such an electrophotographic system, two systems are commonly known. One system is referred to as a single system (or a single drum system) in which an image forming apparatus is equipped with one latent electrostatic image bearing member and is also equipped with 4 developing units corresponding to fours colors such as cyan, magenta, yellow and black colors. In such a single system, visualized images of four colors are formed on a latent electrostatic image bearing member or a recording medium. In this single system, a charging unit, an exposing unit, a transferring unit and a cleaning unit that are arranged around the latent electrostatic image bearing member can be integrated and can be designed with small size at low cost as compared with a tandem system described hereinafter.

The other system is a system referred to as a tandem system (or a tandem drum system) in which an image forming apparatus is equipped with a plurality of latent electrostatic image bearing members (see Japanese Patent Application Laid-Open (JP-A) No. 05-341617). Commonly, for one latent electrostatic image bearing member, a charging unit, a developing unit, a transferring unit and a cleaning unit are arranged one by one to form one image forming element, and the image forming apparatus is equipped with plural (commonly, four) image forming elements. In this tandem system, a monocolor visualized image is formed by one image forming element and the visualized image is sequentially transferred onto a recording medium to from a full color image. In this tandem system, since each colored visualized image can be formed by parallel processing, an image can be formed at a high speed. That is, the tandem system requires a time for an image formation treatment which is about ¼times shorter than that in case of the single system, and also can cope with four-times high-speed printing. Also, it is possible to substantially enhance durability of each unit in an image forming element, including a latent electrostatic image bearing member. The reason is as follows. That is, in the single system, charging, exposing, developing and transferring steps are performed 4 times by one latent electrostatic image bearing member to form one full color image, whereas, in the tandem system, an operation of each step can be performed only one time by one latent electrostatic image bearing member.

However, the tandem system has such a problem that plural image forming elements are arranged and therefore the size of the entire image forming apparatus increases, resulting in high cost.

The above problem is solved by decreasing the diameter of the latent electrostatic image bearing member, down-sizing of each unit arranged around the latent electrostatic image bearing member and down-sizing of one image forming element. As a result, not only the effect of down-sizing of the mage forming apparatus, but also the effect of reducing the material cost can be exerted, and thus entire cost reduction could be attained to some degree. However, with the progress in down-sizing of the image forming apparatus, there arises such a new problem that it is required to impart high performances to each unit with which the image forming element is equipped, and to remarkably enhance stability.

Recently, market's requirements such as energy-saving and speeding-up on image forming apparatuses such as printer, copying machine and facsimile have become stronger. To achieve good performances, it is important to improve thermal efficiency of a fixing unit in the image forming apparatus.

Commonly, in the image forming apparatus, an unfixed toner image is formed on a recording medium such as recording sheet, printing paper, photographic paper or electrostatic recording paper by an image forming process such as electrophotographic recording, electrostatic recording or magnetic recording processes using an indirect transferring system or a direct transferring system. As a fixing unit configured to fix the unfixed toner image, for example, contact heating systems such as heating roller system, film heating system and electromagnetic induction heating system are widely employed.

The fixing unit of heating roller system has such a basic configuration comprising a heat source such as halogen lamp inside, a fixing roller whose temperature is controlled to a predetermined temperature, and a pair of rotary rollers with a pressurizing roller to be pressure-contacted with the fixing roller. A recording medium is inserted into a contact portion (so-called a nipping section) of the pair of rotary rollers and transported, and then the unfixed toner image is melted and fixed by heat and pressure from the fixing roller and the pressurizing roller.

The fixing unit of the film heating system is proposed for instance in JP-A Nos. 63-313182 and 01-263679. Such a fixing unit of the film heating system makes a heating element supported fixedly to a supporting member and a recording medium come closely contact through a thin fixing film having heat resistance, and makes the fixing film to slide to a heating element, thereby feeding heat of the heating element to the recording medium through the fixing film while moving the heating element.

As the heating element, for example, it is possible to use a ceramic heater comprising a ceramic substrate made of alumina or aluminum nitride having properties such as heat resistance, insulating properties and good thermal conductivity, and a resistive layer formed on the ceramic substrate. In such a fixing unit, a thin fixing film having low heat capacity can be used and the fixing unit has higher heat transfer efficiency than that of the fixing unit of heating roller system, and thus the duration of warm-up period can be shortened and quick-start and energy-saving can be realized.

As the fixing unit of an electromagnetic induction heating system, for example, there is proposed a technology in which Joule heat is generated by an eddy current generated in a magnetic metallic member through a magnetic alternating field and a heating element including a metallic member is allowed to cause electromagnetic induction heat generation (see JP-A No. 08-22206).

In such a fixing unit of the electromagnetic induction heating system, since the visualized image is uniformly melted with heating in a state of being sufficiently covered, a film comprising a rubber elastic layer on the surface is formed between a heating element and a recording medium. When the rubber elastic layer is formed of a silicone rubber, thermal responsiveness deteriorates because of low thermal conductivity, and thus a temperature difference between the internal surface of the film to be heated from the heating element and the external surface of the film in contact with the toner. When the amount of the toner adhered is large, the surface temperature of the belt quickly decreases and fixation performances can not be sufficiently secured, and thus so-called cold offset may occur.

In the fixing unit of the electrophotographic image forming apparatus, releasabiliy (hereinafter sometimes referred to as an "anti-offset properties") of the toner to the heating member are required. The anti-offset properties can be improved by the presence of a releasing agent on the surface of the toner. When the toner other than a predetermined toner is used or the toner is reused, the amount of the releasing agent, which is present on the surface of the toner, decreases and anti-offset properties may deteriorate.

With the development of the electrophotographic technology, a toner having excellent low-temperature fixation properties, anti-offset properties and storage stability (blocking resistance) is required and, for example, there are proposed a toner containing a linear polyester resin having defined physical properties such as molecular weight (see JP-A No. 2004-245854), toner containing a non-linear crosslinking type polyester resin using rosins as an acid component in a polyester (see JP-A No. 04-70765), a toner having fixation properties improved by using a resin modified with maleic acid (see JP-A No. 04-307557) and a toner containing a mixture of a low molecular weight resin and a high molecular weight resin (see JP-A No. 02-82267).

It has been found that a conventional binder resin does not sufficiently meet the market's requirements as current image forming apparatus becomes faster and energy-saving. It becomes very difficult to maintain sufficient fixation properties with the reduction of the fixation time in a fixing step and the decrease of the heating temperature by means of a fixing unit. When a low molecular weight resin is used as the binder resin, there arises a problem that a toner is aggregated during storage because a glass transition temperature necessarily decreases, thus resulting in poor storage stability. As current image forming apparatus become faster, a reduction in image quality becomes remarkable particularly in high-speed continuous printing because of poor electrification of toner and toner filming which is caused due to poor dispersion of internal additive.

Furthermore, rosins used in JP-A Nos. 04-70765 and 04-307557 are effective for improvement of low-temperature fixation properties, but have a drawback that odor is likely to occur depending on the kind of rosins.

Therefore, it is now required to quickly provide an image forming apparatus, an image forming method and a process cartridge, which are excellent in low-temperature fixation properties, anti-offset properties, storage stability, rising property of electrification and filming resistance, which can also reduce generation of odor, and which are capable of forming high-quality images for a long period of time.

BRIEF SUMMARY OF THE INVENTION

An object of the present invention is to solve various problems in the prior art and to achieve the following object. That is, an object of the present invention is to provide an image forming apparatus, an image forming method and a process cartridge, which are capable of forming extremely high-quality images, which are excellent in low-temperature fixation properties, anti-offset properties, storage stability, rising property of electrification and filming resistance, which cause no change in color tone when used for a long period of time, and which are free from abnormality such as decrease in density or background smear.

Means for solving the above problems are as follows.

<1> An image forming apparatus including: a latent electrostatic image bearing member; a charging unit configured to charge a surface of the latent electrostatic image bearing member; an exposing unit configured to expose the charged surface of the latent electrostatic image to form a latent electrostatic image thereon; a developing unit configured to develop the latent electrostatic image with a toner to form a visualized image; a transferring unit configured to transfer the visualized image onto a recording medium; and a fixing unit configured to fix the visualized image to the recording medium, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resins (A) is a resin which is derived from a (meth)acrylic acid-modified rosin and which comprises a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which comprises a polyester unit obtained by condensation polymerization of an alcohol component and a carboxylic acid component containing any one of a fumaric acid-modified rosin and a maleic acid-modified rosin;

<2> The image forming apparatus according to <1>, wherein the charging unit is a charging unit configured to charge the latent electrostatic image is bearing member without involving any contact with the latent electrostatic image bearing member;

<3> The image forming apparatus according to <1>, wherein the charging unit is a charging unit configured to charge the latent electrostatic image bearing member while being in contact with the latent electrostatic image bearing member;

<4> The image forming apparatus according to <1>, wherein the developing unit comprises a developer bearing member which comprises a magnetic field generating unit fixed inside, the developer bearing member being rotated while bearing on its surface a two-component developer composed of a magnetic carrier and a toner;

<5> The image forming apparatus according to <1>, wherein the developing unit comprises a developer bearing member to which the toner is supplied, and a layer thickness controlling member which forms a thin layer of toner on the surface of the developer bearing member;

<6> The image forming apparatus according to <1>, wherein the transferring unit is a transferring unit configured to transfer a visualized image formed on the latent electrostatic image bearing member onto a recording medium;

<7> The image forming apparatus according to <1>, comprising a plurality of image forming elements arranged therein, each including at least a latent electrostatic image bearing member, a charging unit, a developing unit and a transferring unit, wherein each transferring unit is a transferring unit configured to transfer onto a recording medium a visualized image formed on the corresponding the latent electrostatic image bearing member, the surface of the recording medium being configured to pass through a transfer portion where each transferring unit faces the corresponding latent electrostatic image bearing member;

<8> The image forming apparatus according to <1>, wherein the transferring unit comprises an intermediate transfer member onto which a visualized image formed on the latent electrostatic image bearing member is primarily transferred, and a secondary transferring unit configured to secondarily transfer the visualized image formed on the intermediate transfer member onto a recording medium;

<9> The image forming apparatus according to <1>, further comprising a cleaning unit, wherein the cleaning unit comprises a cleaning blade which is brought into contact with the surface of the latent electrostatic image bearing member;

<10> The image forming apparatus according to <1>, wherein the developing unit comprises a developer bearing member to be brought into contact with the surface of the latent electrostatic image bearing member, develops the latent electrostatic image formed on the latent electrostatic image bearing member, and recovers toner particles left on the latent electrostatic image bearing member;

<11> The image forming apparatus according to <1>, wherein the fixing unit is a fixing unit which comprises at least one of a roller and a belt and is configured to fix the visualized image transferred on the recording medium by application of heat and pressure by heating from the side which is not in contact with the toner;

<12> The image forming apparatus according to <1>, wherein the fixing unit is a fixing unit which comprises at least one of a roller and a belt and is configured to fix the transferred image transferred on the recording medium by application of heat and pressure by heating from the side which is in contact with the toner;

<13> The image forming apparatus according to <1>, wherein an alcohol component of at least one of a resin derived from a (meth)acrylic modified rosin and a resin derived from a fumaric acid/maleic acid-modified rosin contains an aliphatic alcohol;

<14> The image forming apparatus according to <1>, wherein the content of the (meth)acrylic acid-modified rosin in the carboxylic acid component of a resin derived from a (meth)acrylic acid-modified rosin is from 5% by mass to 85% by mass, and the total content of the fumaric acid-modified rosin and the maleic acid-modified rosin in the carboxylic acid component of a resin derived from fumaric acid/maleic acid-modified rosin is from 5% by mass to 85% by mass;

<15> The image forming apparatus according to <1>, wherein at least one of the (meth)acrylic acid-modified rosin, the fumaric acid-modified rosin and the maleic acid-modified rosin is obtained by modifying a purified rosin;

<16> The image forming apparatus according to <1>, wherein an alcohol component of at least one of a resin derived from a (meth)acrylic modified rosin and a resin derived from fumaric acid/maleic acid-modified rosin contains a trihydric or higher alcohol, a carboxylic acid component of at least one of a resin derived from a (meth)acrylic modified rosin and a resin derived from a fumaric acid/maleic acid-modified rosin contains a trihydric or higher carboxylic acid compound, or the alcohol component contains a trihydric or higher alcohol and the carboxylic acid component contains a trihydric or higher carboxylic acid compound;

<17> The image forming apparatus according to <1>, wherein the content of a low molecular weight component having a molecular weight of 500 or less in at least one of the polyester-based resin (A) and the polyester-based resin (B) is 12% or less;

<18> The image forming apparatus according to <1>, wherein condensation polymerization of at least one of a resin derived from a (meth)acrylic modified rosin and a resin derived from a fumaric acid/maleic acid-modified rosin is performed in the presence of at least one of a titanium compound and a tin(II) compound having no Sn—C bond;

<19> The image forming apparatus according to <1>, wherein the total content of a resin derived from a (meth) acrylic modified rosin and a resin derived from a fumaric acid/maleic acid-modified rosin in the binder resin is 70% by weight or more;

<20> The image forming apparatus according to <1>, wherein at least one of the degree of modification of the (meth)acrylic acid rosin with (meth)acrylic acid, the degree of modification of the fumaric acid-modified rosin with fumaric and the degree of modification of maleic acid-modified rosin with maleic acid-modified rosin is from 5 to 105;

<21> The image forming apparatus according to <1>, wherein a softening point of the polyester-based resin (A) is from 80° C. to 120° C. and a softening point of the polyester-based resin (B) is from 100° C. to 180° C.;

<22> An image forming method including: charging a surface of a latent electrostatic image bearing member; exposing the charged surface of the latent electrostatic image to form a latent electrostatic image thereon; developing the latent electrostatic image with a toner to form a visualized image; transferring the visualized image onto a recording medium; and fixing the visualized image to the recording medium, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resins (A) is a resin which is derived from a (meth)acrylic acid-modified rosin and which comprises a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which comprises a polyester unit obtained by condensation polymerization of an alcohol component and a carboxylic acid component containing any one of a fumaric acid-modified rosin and a maleic acid-modified rosin;

<23> The image forming method according to <22>, wherein the charging unit is a charging unit configured to charge the latent electrostatic image bearing member without involving any contact with the latent electrostatic image bearing member;

<24> The image forming method according to <22>, wherein the charging unit is a charging unit configured to charge the latent electrostatic image bearing member while being in contact with the latent electrostatic image bearing member;

<25> The image forming method according to <22>, wherein the developing unit comprises a developer bearing member which comprises a magnetic field generating unit fixed inside, the developer bearing member being rotated while bearing on its surface a two-component developer composed of a magnetic carrier and a toner;

<26> The image forming method according to <22>, wherein the developing unit comprises a developer bearing member to which the toner is supplied, and a layer thickness controlling member which forms a thin layer of toner on the surface of the developer bearing member;

<27> The image forming method according to <22>, wherein the transferring unit is a transferring unit configured to transfer a visualized image formed on the latent electrostatic image bearing member onto a recording medium;

<28> The image forming method according to <22>, comprising a plurality of image forming elements arranged therein, each including at least a latent electrostatic image bearing member, a charging unit, a developing unit and a transferring unit, wherein each transferring unit is a transferring unit configured to transfer onto a recording medium a visualized image formed on the corresponding the latent electrostatic image bearing member, the surface of the recording medium being configured to pass through a transfer portion where each transferring unit faces the corresponding latent electrostatic image bearing member;

<29> The image forming method according to <22>, wherein the transferring unit comprises an intermediate transfer member onto which a visualized image formed on the latent electrostatic image bearing member is primarily transferred, and a secondary transferring unit configured to secondarily transfer the visualized image formed on the intermediate transfer member onto a recording medium;

<30> The image forming method according to <22>, further comprising a cleaning unit, wherein the cleaning unit comprises a cleaning blade which is brought into contact with the surface of the latent electrostatic image bearing member;

<31> The image forming method according to <22>, wherein the developing unit comprises a developer bearing member to be brought into contact with the surface of the latent electrostatic image bearing member, develops the latent electrostatic image formed on the latent electrostatic image bearing member, and recovers toner particles left on the latent electrostatic image bearing member;

<32> The image forming apparatus according to <22>, wherein the fixing unit is a fixing unit which comprises at least one of a roller and a belt and is configured to fix the visualized image transferred on the recording medium by application of heat and pressure by heating from the side which is not in contact with the toner;

<33> The image forming method according to <22>, wherein the fixing unit is a fixing unit which comprises at least one of a roller and a belt and is configured to fix the transferred image transferred on the recording medium by application of heat and pressure by heating from the side which is in contact with the toner;

<34> The image forming method according to <22>, wherein an alcohol component of at least one of a resin derived from a (meth)acrylic modified rosin and a resin derived from a fumaric acid/maleic acid-modified rosin contains an aliphatic alcohol;

<35> The image forming method according to <22>, wherein the content of the (meth)acrylic acid-modified rosin in the carboxylic acid component of a resin derived from a (meth)acrylic acid-modified rosin is from 5% by mass to 85% by mass, and the content of the fumaric acid-modified rosin and the maleic acid-modified rosin in the carboxylic acid component of a resin derived from fumaric acid/maleic acid-modified rosin is from 5% by mass to 85% by mass;

<36> The image forming apparatus according to <22>, wherein at least one of the (meth)acrylic acid-modified rosin, the fumaric acid-modified rosin and the maleic acid-modified rosin is obtained by modifying a purified rosin;

<37> The image forming method according to <22>, wherein an alcohol component of at least one of a resin derived from a (meth)acrylic modified rosin and a resin derived from fumaric acid/maleic acid-modified rosin contains a trihydric or higher alcohol, a carboxylic acid component of at least one of a resin derived from a (meth)acrylic modified rosin and a resin derived from a fumaric acid/maleic acid-modified rosin contains a trihydric or higher carboxylic acid compound, or the alcohol component contains a trihydric or higher alcohol and the carboxylic acid component contains a trihydric or higher carboxylic acid compound;

<38> The image forming method according to <22>, wherein the content of a low molecular weight component having a molecular weight of 500 or less in at least one of the polyester-based resin (A) and the polyester-based resin (B) is 12% or less;

<39> The image forming method according to <22>, wherein condensation polymerization of at least one of a resin derived from a (meth)acrylic modified rosin and a resin derived from a fumaric acid/maleic acid-modified rosin is performed in the presence of at least one of a titanium compound and a tin(II) compound having no Sn—C bond;

<40> The image forming method according to <22>, wherein the total content of a resin derived from a (meth) acrylic modified rosin and a resin derived from a fumaric acid/maleic acid-modified rosin in the binder resin is 70% by weight or more;

<41> The image forming method according to <22>, wherein at least one of the degree of modification of the (meth)acrylic acid rosin with (meth)acrylic acid, the degree of modification of the fumaric acid-modified rosin with fumaric and the degree of modification of maleic acid-modified rosin with maleic acid-modified rosin is from 5 to 105;

<42> The image forming method according to <22>, wherein a softening point of the polyester-based resin (A) is from 80° C. to 120° C. and a softening point of the polyester-based resin (B) is from 100° C. to 180° C.;

<43> A process cartridge including: a latent electrostatic image bearing member; and a developing unit configured to develop a latent electrostatic image formed on the latent electrostatic image bearing member with a toner to form a visualized image thereon, the process cartridge being removable from the body of an image forming apparatus, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resins (A) is a resin which is derived from a (meth)acrylic acid-modified rosin and which comprises a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which comprises a polyester unit obtained by condensation polymerization of an alcohol component and a carboxylic acid component containing any one of a fumaric acid-modified rosin and a maleic acid-modified rosin;

<44> The image forming apparatus according to <43>, wherein an alcohol component of at least one of a resin derived from a (meth)acrylic modified rosin and a resin derived from a fumaric acid/maleic acid-modified rosin contains an aliphatic alcohol.

<45> The image forming apparatus according to <43>, wherein the content of the (meth)acrylic acid-modified rosin in the carboxylic acid component of a resin derived from a (meth)acrylic acid-modified rosin is from 5% by mass to 85% by mass, and the total content of the fumaric acid-modified rosin and the maleic acid-modified rosin in the carboxylic acid component of a resin derived from fumaric acid/maleic acid-modified rosin is from 5% by mass to 85% by mass;

<46> The image forming apparatus according to <43>, wherein at least one of the (meth)acrylic acid-modified rosin, the fumaric acid-modified rosin and the maleic acid-modified rosin is obtained by modifying a purified rosin;

<47> The image forming apparatus according to <43>, wherein an alcohol component of at least one of a resin derived from a (meth)acrylic modified rosin and a resin derived from fumaric acid/maleic acid-modified rosin contains a trihydric or higher alcohol, a carboxylic acid component of at least one of a resin derived from a (meth)acrylic modified rosin and a resin derived from a fumaric acid/maleic acid-modified rosin contains a trihydric or higher carboxylic acid compound, or the alcohol component contains a trihydric or higher alcohol and the carboxylic acid component contains a trihydric or higher carboxylic acid compound;

<48> The image forming apparatus according to <43>, wherein the content of a low molecular weight component having a molecular weight of 500 or less in at least one of the polyester-based resin (A) and the polyester-based resin (B) is 12% or less;

<49> The image forming apparatus according to <43>, wherein condensation polymerization of at least one of a resin derived from a (meth)acrylic modified rosin and a resin derived from a fumaric acid/maleic acid-modified rosin is performed in the presence of at least one of a titanium compound and a tin(II) compound having no Sn—C bond;

<50> The image forming apparatus according to <43>, wherein the total content of a resin derived from a (meth) acrylic modified rosin and a resin derived from a fumaric acid/maleic acid-modified rosin in the binder resin is 70% by weight or more;

<51> The image forming apparatus according to <43>, wherein at least one of the degree of modification of the (meth)acrylic acid rosin with (meth)acrylic acid, the degree of modification of the fumaric acid-modified rosin with fumaric and the degree of modification of maleic acid-modified rosin with maleic acid-modified rosin is from 5 to 105; and <52> The image forming apparatus according to <43>, wherein a softening point of the polyester-based resin (A) is from 80° C. to 120° C. and a softening point of the polyester-based resin (B) is from 100° C. to 180° C.

The image forming apparatus of the present invention comprises at least: a latent electrostatic image bearing member; a charging unit configured to charge a surface of the latent electrostatic image bearing member; an exposing unit configured to expose the charged surface of the latent electrostatic image to form a latent electrostatic image thereon; a developing unit configured to develop the latent electrostatic image with a toner to form a visualized image; a transferring unit configured to transfer the visualized image onto a recording medium; and a fixing unit configured to fix the visualized image to the recording medium, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resins (A) is a resin which is derived from a (meth)acrylic acid-modified rosin and which has a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which comprises a polyester unit obtained by condensation polymerization of an alcohol component and a carboxylic acid component containing any one of a fumaric acid-modified rosin and a maleic acid-modified rosin. In the image forming apparatus of the present invention, the charging unit configures to uniformly charge the surface of the latent electrostatic image bearing member. By the exposing unit, the surface of the latent electrostatic image bearing member is exposed to form a latent electrostatic image. By the developing unit, the latent electrostatic image formed on the latent electrostatic image bearing member is developed with a toner to form a visualized image. By the transferring unit, the visualized image is transferred onto a recording medium. By the fixing unit, the transferred image transferred onto the recording medium is fixed. At this time, since a resin comprising a polyester-based resin (A) and a polyester-based resin (B) having a melting point which is at least 10° C. higher than that of the polyester-based resin (A), the polyester-based resins (A) being a resin which is derived from a (meth)acrylic acid-modified rosin and which has a polyester unit obtained by condensation polymerization of an alcohol component and a carboxylic acid component containing a (meth)acrylic acid-modified rosin, and the polyester-based resin (B) being a resin which is derived from a fumaric acid/maleic acid-modified rosin and which has a polyester unit obtained by condensation polymerization of an alcohol component and a carboxylic acid component containing any one of a fumaric acid-modified rosin and a maleic acid-modified rosin, is used as a binder resin for the toner, it is possible to form an extremely high quality image, which is excellent in low-temperature fixation properties, anti-offset properties, storage stability, rising property of electrification and filming resistance and can reduce generation of odor, and also causes no change in color tone when used for a long period of time and is free from abnormality such as decrease in density or background smear.

The image forming method of the present invention comprises at least: a charging step of charging a surface of a latent electrostatic image bearing member; en exposing step of exposing the charged surface of the latent electrostatic image to form a latent electrostatic image thereon; a developing step of developing the latent electrostatic image with a toner to form a visualized image; a transferring step of transferring the visualized image onto a recording medium; and a fixing step of fixing the visualized image to the recording medium, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resins (A) is a resin which is derived from a (meth)acrylic acid-modified rosin and which has a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which has a polyester unit obtained by condensation polymerization of an alcohol component and a carboxylic acid component containing any one of a fumaric acid-modified rosin and a maleic acid-modified rosin. In the image forming method of the present invention, in the charging step, the surface of the latent electrostatic image bearing member is uniformly charged. In the exposing step, the surface of the latent electrostatic image bearing member is exposed to form a latent electrostatic image. In the developing step, the latent electrostatic image formed on the latent electrostatic image bearing member is developed with a toner to form a visualized image. In the transferring step, the visualized image is transferred onto a recording medium. In the fixing step, the transferred image transferred onto a recording medium is fixed. At this time, since a resin comprising a polyester-based resin (A) and a polyester-based resin (B) having a melting point which is at least 10° C. higher than that of the polyester-based resin (A), the polyester-based resins (A) being a resin which is derived from a (meth)acrylic acid-modified rosin and which has a polyester unit obtained by condensation polymerization of an alcohol component and a carboxylic acid component containing a (meth)acrylic acid-modified rosin, and the polyester-based resin (B) being a resin which is derived from a fumaric acid/maleic acid-modified rosin which has a polyester unit obtained by condensation polymerization of an alcohol component and a carboxylic acid component containing any one of a fumaric acid-modified rosin and a maleic acid-modified rosin, is used as a binder resin of the toner, it is possible to form an extremely high quality image, which is excellent in low-temperature fixation properties, anti-offset properties, storage stability, rising property of electrification and filming resistance and can reduce generation of odor, and also causes no change in color tone when used for a long period of time and is free from abnormality such as decrease in density or background smear.

The process cartridge of the present invention comprises at least: a latent electrostatic image bearing member; and a developing unit configured to develop a latent electrostatic image formed on the latent electrostatic image bearing member with a toner to form a visualized image thereon, the process cartridge being removable from the body of an image forming apparatus, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resins (A) is a resin which is derived from a (meth)acrylic acid-modified rosin and which has a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which has a polyester unit obtained by condensation polymerization of an alcohol component and a carboxylic acid component containing any one of a fumaric acid-modified rosin and a maleic acid-modified rosin. Therefore, it is possible to form an extremely high quality image, which is excellent in low-temperature fixation properties, anti-offset properties, storage stability, rising property of electrification and filming resistance and can reduce generation of odor, and also causes no change in color tone when used for a long period of time and is free from abnormality such as decrease in density or background smear.

According to the present invention, it is possible to solve the problems in the prior art and to provide an image forming apparatus, an image forming method and a process cartridge, capable of forming an extremely high quality image, which is excellent in low-temperature fixation properties, anti-offset properties, storage stability, rising property of electrification and filming resistance and causes no change in color tone when used for a long period of time, and is also free from abnormality such as decrease in density or background smear.

Figure 1:
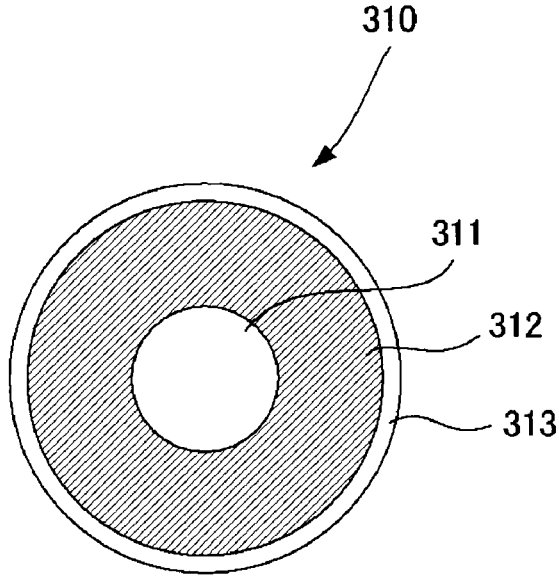
FIG. 1 is a schematic sectional view showing an example of a charging roller in the image forming apparatus of the present invention.

DETAILED DESCRIPTION OF THE INVENTION (Image Forming Apparatus and Image Forming Method)

The image forming apparatus of the present invention comprises at least a latent electrostatic image bearing member, a charging unit, an exposing unit, a developing unit, a transferring unit and a fixing unit, and also comprises a cleaning unit and, if necessary, appropriately selected other units, for example, a decharging unit, a recycling unit and a controlling unit. A combination of the charging unit and the exposing unit is sometimes referred to as a latent electrostatic image forming unit.

The image forming method of the present invention comprises at least a charging step, an exposing step, a developing step, a transferring step and a fixing step, and also comprises a cleaning unit and, if necessary, appropriately selected other steps, for example, a discharging step, a recycling step and a controlling step. A combination of the charging step and the exposing step is sometimes referred to as a latent electrostatic image forming step.

The image forming method of the present invention can be preferably carried out by the image forming apparatus of the present invention. The charging step can be performed by the charging unit, the exposing step can be performed by the exposing unit, the developing step can be performed by the developing unit, the transferring step can be performed by the transferring unit, the fixing step can be performed by the fixing unit, the cleaning step can be performed by the cleaning unit, and other steps can be performed by other units.

<Latent Electrostatic Image Bearing Member>

The material, shape, structure and size of the latent electrostatic image bearing member are not specifically limited and can be appropriately selected according to the purposes and the shape includes, for example, drum, sheet and endless belt. The structure may be a singe-layered structure or a multi-layered structure. The size can be appropriately selected according to the size and specification of the image forming apparatus. Examples of the material include inorganic photoconductors made of amorphous silicone, selenium, CdS and ZnO; and organic photoconductors (OPC) made of polysilane and phthalopolymethine.

The amorphous silicone photoconductor is obtained, for example, by heating a substrate to a temperature of 50° C. to 400° C. and forming a photosensitive layer made of a-Si on the substrate using a film forming method such as a vacuum deposition method, a sputtering method, an ion plating method, a thermal CVD method, a photo-CVD method or a plasma CVD method. Among these methods, a plasma CVD is particularly preferable. Specifically, a method of decomposing a raw gas by direct current, high-frequency wave or microwave glow discharge to form a photosensitive layer made of a-Si on a substrate is preferable.

The organic photoconductor (OPC) is widely used for the following reasons: (1) excellent optical properties such as wide light absorption wavelength range and large light absorption amount, (2) excellent electrical properties such as high sensitivity and stable charge properties, (3) wide latitude in the selection of material, (4) ease of production, (5) low cost, and (6) nontoxicity. Layer configuration of the organic photoconductor is roughly classified into a singe-layered structure and a multi-layered structure.

The photoconductor having a singe-layered structure comprises a substrate and a single-layered type photosensitive layer formed on the substrate, and also comprises a protective layer, an intermediate layer and other layers.

The photoconductor having a multi-layered structure comprises a substrate and a multi-layered type photosensitive layer comprising at least, in order, a charge generating layer and a charge transporting layer formed over the substrate, and also comprises a protective layer, an intermediate layer and other layers.

<Charging Step and Charging Unit>

The charging step is a step of charging the surface of the latent electrostatic image bearing member and is performed by the exposing unit.

The charging unit is not specifically limited and can be appropriately selected according to the purposes as long as it can uniformly charge the surface of the latent electrostatic image bearing member by applying a voltage and is roughly classified into (1) a contact type charging unit configured to charge while making contact with the latent electrostatic image bearing member, and (2) a non-contact type charging unit configured to charge without making contact with the latent electrostatic image bearing member.

-Contact Type Charging Unit-

Examples of the contact type charging unit (1) include a conductive or semiconductive charging roller, a magnetic brush, a fur brush, a film and a rubber blade. Among these, the charging roller can remarkably decrease an amount of ozone generated as compared with corona discharge and is excellent in stability when the latent electrostatic image bearing member is repeatedly used, and is effective to prevent deterioration of image quality.

The magnetic brush is composed of a non-magnetic conductive sleeve which supports various ferrite particles made of Zn—Cu ferrite, and a magnet roller included in the sleeve. The fur brush is formed by winding or laminating a fur provided with conductivity using carbon, copper sulfide, metal or metal oxide on a metal or a core metal provided with conductivity.

Herein, FIG. 1 is a sectional view showing an example of a charging roller. This charging roller 310 comprises a core metal 311 as a cylindrical conductive substrate, a resistance controlling layer 312 formed over the circumference of the core metal 311, and a protective layer 313 which covers the surface of the resistance controlling layer 312 to thereby prevent leakage.

The resistance controlling layer 312 is formed by extrusion molding or injection molding of a thermoplastic resin composition containing at least a thermoplastic resin and a polymer type ion conductive agent on the peripheral surface of the core metal 311.

A volume resistivity value of the resistance controlling layer 312 is preferably from $10^6$ Ω×cm to $10^9$ Ω×cm. When the volume resistivity value is more than $10^9$ Ω×cm, it may become impossible that a photoconductor drum can obtain a charge potential enough to obtain an image free from unevenness. On the other hand, when the volume resistivity value is less than $10^6$ Ω×cm, leakage to the entire photoconductor drum may occur.

The thermoplastic resin used in the resistance controlling layer 312 is not specifically limited and can be appropriately selected according to the purposes and includes, for example, polyethylene (PE), polypropylene (PP), polymethyl methacrylate (PMMA), polystyrene (PS) or copolymers (AS, ABS, etc.) thereof.

As the polymer type ion conductive agent, for example, it is possible to use an ion conductive agent which has a resistance value as a simple substance of about $10^6$ Ω×cm to $10^{10}$ Ω×cm and easily decrease the resistance of the resin. As an example, a compound containing a polyetheresteramide component is exemplified. To adjust the resistance value of the resistance controlling layer 312 to the value within the above range, the amount of the ion conductive agent is preferably from 30 parts by mass to 70 parts by mass per 100 parts by mass of the thermoplastic resin.

As the polymer type ion conductive agent, a quaternary ammonium salt group-containing polymer compound can also be used. The quaternary ammonium salt group-containing polymer compound includes, for example, a quaternary ammonium salt group-containing polyolefin. To adjust the resistance value of the resistance controlling layer 312 to the value within the above range, the amount of the ion conductive agent is preferably from 10 parts by mass to 40 parts by mass per 100 parts by mass of the thermoplastic resin.

The polymer type ion conductive agent can be dispersed in the thermoplastic resin using a twin screw extruder or a kneader. Since the polymer type ion conductive agent is uniformly dispersed in the thermoplastic resin composition in a molecular level, in the resistance controlling layer 312, there is no variation in the resistance value caused by poor dispersion of a conductive substance, which is observed in the resistance controlling layer in which a conductive pigment is dispersed. Also, the polymer type ion conductive agent is a polymer compound and is therefore uniformly dispersed and fixed in the thermoplastic resin composition, and thus bleed-out is less likely to occur.

The protective layer 313 is formed so as to adjust the resistance value to the value which is more than that of the resistance controlling layer 312. As a result, leakage to the defect section of the photoconductor drum is avoided. If the resistance value of the protective layer 313 is excessively increased, charge efficiency decreases and thus a difference between the resistance value of the protective layer 313 and that of the resistance controlling layer 312 is preferably $10^3$ Ω×cm or less.

The material of the protective layer 313 is preferably a resin material because of good film forming properties. For example, the resin material is preferably a fluororesin, a polyamide resin, a polyester resin or a polyvinyl acetal resin because of its excellent non-adhesiveness in view of preventing adhesion of the toner. Also, since the resin material commonly has electrical insulating properties, properties of the charging roller are not satisfied if the protective layer 313 is formed of a resin material alone. Therefore, the resistance value of the protective layer 313 is adjusted by dispersing various conductive agents in the resin material. To improve adhesion between the protective layer 303 and the resistance controlling layer 302, a reactive curing agent such as isocyanate may be dispersed in the resin material.

The charging roller 310 is connected to a power supply and a predetermined voltage is applied thereto. The voltage may be only a direct current (DC) voltage, but is preferably a voltage in which an alternating current (AC) voltage is superposed to the DC voltage. The surface of the photoconductor drum can be charged more uniformly by applying the AC voltage.

Figure 2:
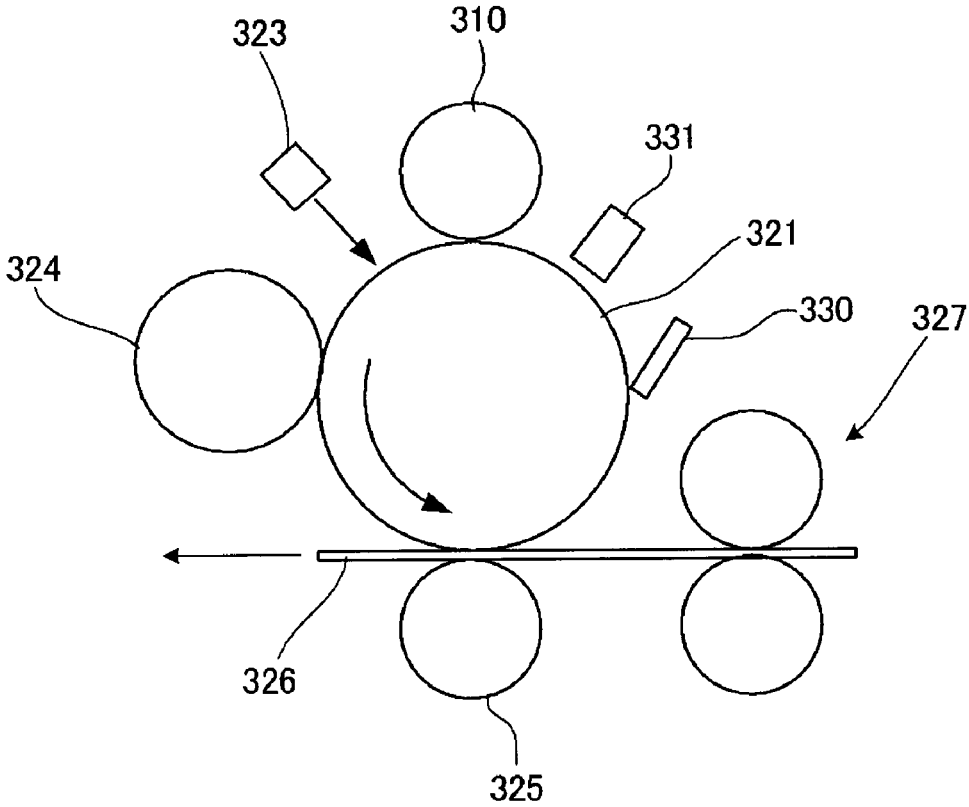
FIG. 2 is a schematic view showing an example in which a contact type charging roller in the image forming apparatus of the present invention is applied to an image forming apparatus.

Herein, FIG. 2 is a schematic view showing an example in which the contact type charging roller as shown in FIG. 1 is applied to an image forming apparatus as a charging unit. In FIG. 2, around the photoconductor drum 321 as the latent electrostatic image bearing member, there are sequentially arranged a charging unit 310 configured to charge the surface of a photoconductor drum, an exposing unit 323 configured to form a latent electrostatic image on the surface to be charged, a developing unit 324 configured to adhere a toner on the latent electrostatic image on the surface of the photoconductor drum to form a visualized image, a transferring unit 325 configured to transfer the visualized image formed on the photoconductor drum onto a recording medium 326, a fixing unit 327 configured to fix the transferred image on the recording medium, a cleaning unit 330 configured to remove and recover the toner left on the photoconductor drum, and a decharging device 331 configured to remove the residual potential on the photoconductor drum.

As the charging unit 310, a contact type charging roller 310 shown in FIG. 1 is arranged, and the surface of the photoconductor drum 321 is uniformly charged by the charging roller 310.

-Non-Contact Type Charging Unit-

The non-contact type charging unit (2) includes, for example, a non-contact type charger utilizing corona discharge, a needle electrode device, a solid discharge element; and a conductive or semiconductive charging roller arranged while keeping a microgap with respect to the latent electrostatic image bearing member.

The corona discharge method is a non-contact charging method which gives positive or negative ions generated by corona discharge in an air to the surface of a latent electrostatic image bearing member and examples of a charger include a corotron charger having properties capable of giving a fixed charge amount to a latent electrostatic image bearing member and a scorotron charger having properties capable of giving a fixed potential.

The corotron charger is composed of a casing electrode which occupies a half space around a discharge wire and a discharge wire placed nearly the center.

The scorotron charger is the same as the corotron charger, except that it further comprises a grid electrode, and the grid electrode is arranged at the position which is 1.0 mm to 2.0 mm away from the surface of the latent electrostatic image bearing member.

Figure 3:
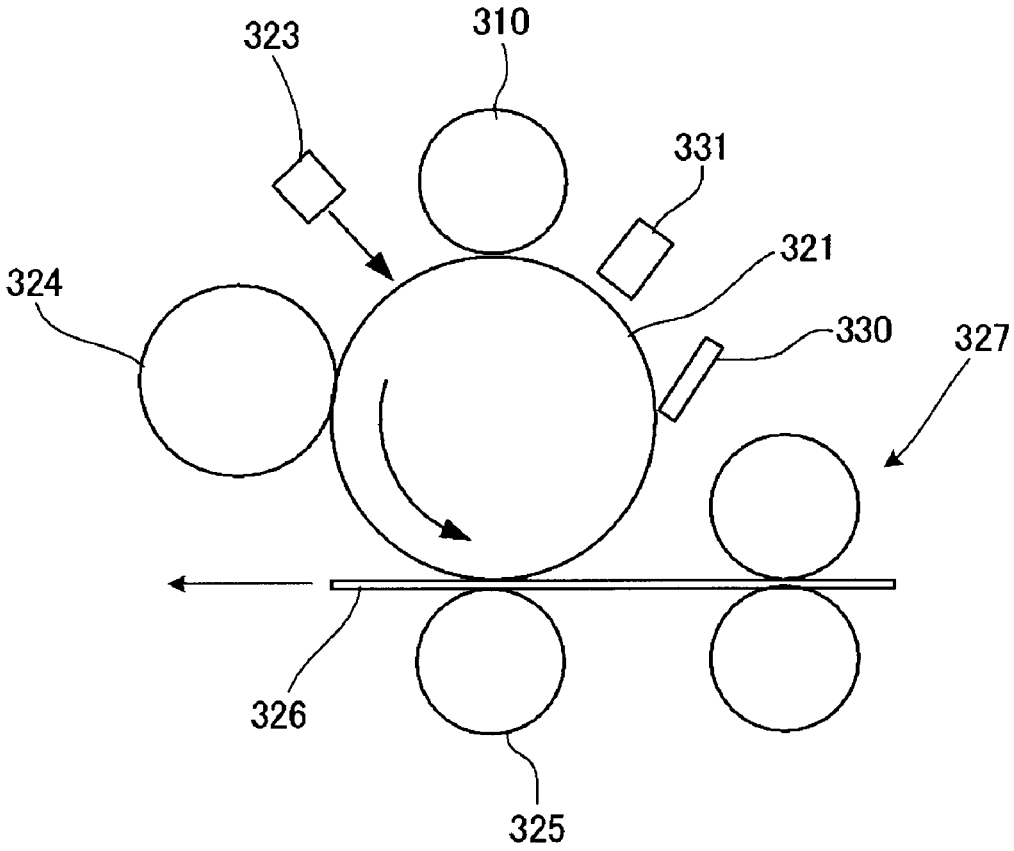
FIG. 3 is a schematic view showing an example in which a non-contact type corona charger in the image forming apparatus of the present invention is applied to an image forming apparatus.

Herein, FIG. 3 is a schematic view showing an example in which a non-contact type corona charger is applied to an image forming apparatus as a charging unit. In FIG. 3, the same parts as in FIG. 2 were expressed by the same numerals.

As the charging unit, a non-contact type corona charger 311 and the surface of the photoconductor drum 321 is uniformly charged by the corona charger 311.

Regarding the charging roller arranged while keeping a microgap with respect to the latent electrostatic image bearing member, the charging roller is improved so as to keep a microgap with respect to the latent electrostatic image bearing member. The microgap is preferably from 10 μm to 200 μm, and more preferably from 10 μm to 100 μm.

Figure 4:
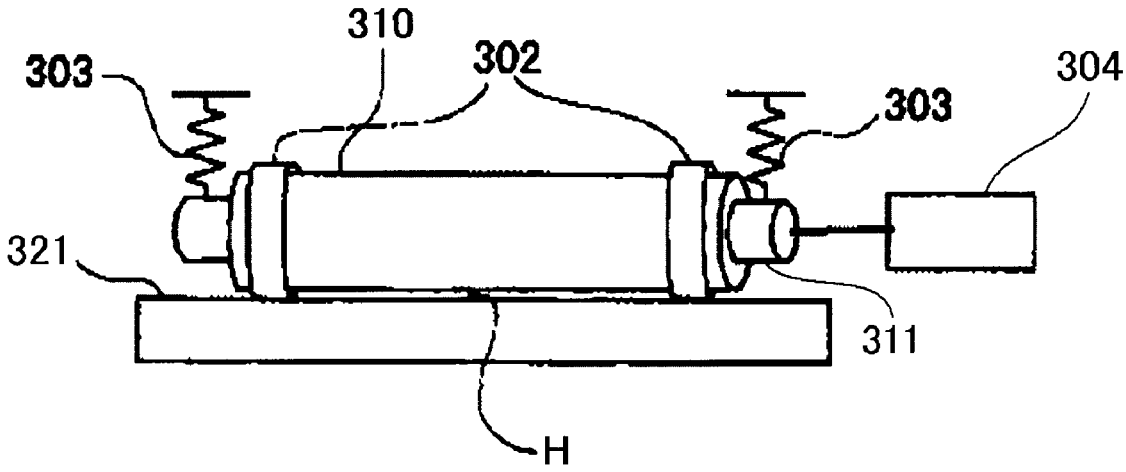
FIG. 4 is a schematic view showing an example of a non-contact type charging roller in the image forming apparatus of the present invention.

Herein, FIG. 4 is a schematic view showing an example of a non-contact type charging roller. In FIG. 4, the charging roller 310 is arranged while keeping a microgap H with respect to the photoconductor drum 321. The microgap H can be set by winding a spacer member having a fixed thickness at the non-imaged area of both ends of the charging roller 310, thereby allowing the surface of the spacer member to abut the surface of the photoconductor drum 321. In FIG. 4, the numeral 304 denotes a power supply.

In FIG. 4, to keep the microgap H, a film 302 is wound at both ends of the charging roller 310 to form a spacer member. This spacer 302 is brought into contact with the photoconductive surface of the latent electrostatic image bearing member to obtain a fixed microgap H in the image area between the charging roller and the latent electrostatic image bearing member. Also, by an applied bias, an AC superposition type voltage is applied and the latent electrostatic image bearing member is charged by discharge generated in the microgap H between the charging roller and the latent electrostatic image bearing member. As shown in FIG. 4, maintaining accuracy of the microgap H is improved by pressurizing an axis 311 of the charging roller using a spring 303.

The spacer member and the charging roller may be integrally molded. At this time, at least the surface of a gap section is made of an insulating material. Consequently, discharge at the gap section is eliminated and a discharge product is accumulated at the gap section, and thus it is possible to prevent the toner from adhering onto the gap section because of tackiness of the discharge product, resulting in a widen gap.

As the spacer member, a thermal contraction tube may be used. The thermal contraction tube includes, for example, Sumitube for 105° C. (trade name: F105° C., manufactured by Sumitomo Chemical Co., Ltd.).

<Exposing Step and Exposing Unit>

The exposure can be performed, for example, by imagewise exposing the surface of the latent electrostatic image bearing member using an exposing unit.

The optical system in the exposure is roughly classified into an analog optical system and a digital optical system. The analog optical system is an optical system in which a manuscript is directly project on a latent electrostatic image bearing member, while the digital optical system is an optical system in which image information is given as an electrical signal and the image information is converted into a light signal and a latent electrostatic image bearing member is exposed to form an image.

The exposing unit is not specifically limited and can be appropriately selected according to the purposes as long as the surface of the latent electrostatic image bearing member charged by the charging unit can be imagewise exposed and includes, fro example, various disclosing devices such as copying optical system, rod lens array system, laser optical system, liquid crystal shutter optical system and LED optical system.

In the present invention, a rear light system capable of imagewise exposing from the back side of the latent electrostatic image bearing member.

<Developing Step and Developing Unit>

The developing step is a step of developing the latent electrostatic image with a toner or a developer to from a visualized image.

The visualized image can be formed, for example, by developing the latent electrostatic image with the toner or developer and can be formed by the developing unit.

The developing unit is not specifically limited and can be appropriately selected from known ones as long as it can develop with a toner or developer, and is preferably a developing unit which contains the toner or developer and can give the toner or developer to the latent electrostatic image with or without making contact with the latent electrostatic image bearing member.

[Toner]

The toner comprises at least a binder resin and a coloring agent, and preferably comprises a releasing agent, a charge control agent and an external additive, and also comprises other components, if necessary.

-Binder Resin-

The binder resin comprises a polyester-based resin (A) and a polyester-based resin (B) having a melting point which is at least 10° C. higher than that of the polyester-based resin (A), and also comprises other components, if necessary.

The polyester-based resin (A) is a resin which is derived from a (meth)acrylic acid-modified rosin and which has a polyester unit obtained by condensation polymerization of an alcohol component and a carboxylic acid component containing a (meth)acrylic acid-modified rosin.

The polyester-based resin (B) is a resin which is derived from a fumaric acid/maleic acid-modified rosin and which has a polyester unit obtained by condensation polymerization of an alcohol component and a carboxylic acid component containing any one of a fumaric acid-modified rosin and a maleic acid-modified rosin.

Both of the resin derived from a (meth)acrylic modified rosin and resin derived from a fumaric acid/maleic acid-modified rosin (hereinafter may be collectively referred to as a "resin derived from a modified rosin") can realize fixation at very low temperatures and storage stability will be improved. There has conventionally made a trial of simultaneously satisfying two conflicting properties, for example, low-temperature fixation properties and storage stability as well as anti-offset properties and storage stability of a toner using two kinds of resins, each having a different softening point in combination. However, since these resins, each having a different softening point, are also different in melt viscosity, both resins are not uniformly mixed with ease and dispersibility of an internal additive such as coloring agent or releasing agent is likely to deteriorate. However, in the present invention, since the polyester-based resin (A) having a lower melting point is a resin derived from a (meth)acrylic acid-modified rosin, the (meth)acrylic acid-modified rosin can increase the molecular weight of the resin as a portion of the main chain of a polyester unit as described above. The melt viscosity is thus can be increased more easily than softening point, and filming resistance caused due to poor dispersion of internal additive is noticeably improved. Since the polyester-based resin (B) having a higher softening point is a resin derived from a fumaric acid/maleic acid-modified rosin, at least one of a fumaric acid-modified rosin and a maleic acid-modified rosin, each having a trifunctional group, enhances crosslinking degree of a polyester unit, thereby improving anti-offset properties, and also the acid value is increased with ease and rising property of electrification is improved.

In the present specification, the resin in the present invention was expressed as a resin derived from a (meth)acrylic acid-modified rosin and a resin derived from a fumaric acid/maleic acid-modified rosin for convenience, and "derived from" means that any one of the (meth)acrylic acid-modified rosin, a fumaric acid/maleic acid-modified rosin an a maleic acid-modified rosin is used as at least one of raw monomers.

-Resin Derived From (Meth)acrylic Modified Rosin-

The (meth)acrylic acid-modified rosin in the resin derived from a (meth)acrylic modified rosin is a rosin modified with (meth)acrylic acid and is obtained by addition reaction of a rosin containing, as main components, abietic acid, neoabietic acid, palustric acid, pimaric acid, isopimaric acid, sandaraco-pimaric acid, dehydroabietic acid and levopimaric acid with (meth)acrylic acid. Specifically, the (meth)acrylic acid-modified rosin is obtained by the Diels-Alder reaction of levopimaric acid, abietic acid, neoabietic acid and palustric acid, each having a conjugated double bond, among main components of the rosin with (meth)acrylic acid under heating.

As used herein, "(meth)acryl" means acryl or methacryl. Therefore, (meth)acrylic acid means acrylic acid or methacrylic acid, and "(meth)acrylic acid-modified rosin" means a rosin modified with acrylic acid or a rosin modified with methacrylic acid. The (meth)acrylic acid-modified rosin in the present invention is preferably an acrylic acid-modified rosin modified with acrylic acid with less steric hindrance in view of reaction activity in the Diels-Alder reaction.

The degree of modification of the rosin with (meth)acrylic acid (degree of modification with (meth)acrylic acid) is preferably from 5 to 105, more preferably from 20 to 105, still more preferably from 40 to 105, and particularly preferably from 60 to 105, in view of increasing the molecular weight of the polyester resin and decreasing the low molecular weight oligomer component.

Herein, the degree of modification with (meth)acrylic acid can be calculated using the following equation (Aa):

[Equation 1]

$$\text{Degree of Modification with (Meth)acrylic Acid} = [(X_{a1}-Y)/(X_{a2}-Y)]\times 100 \quad \text{Equation (Aa)}$$

where $X_{a1}$ denotes an SP value of a (meth)acrylic acid-modified rosin whose modification degree is to be calculated, $X_{a2}$ denotes a saturated SP value of a (meth)acrylic acid-modified rosin obtained by reacting 1 mol of (meth)acrylic acid with 1 mol of a rosin, and Y denotes a SP value of rosin.

The SP value means a softening point measured by an automatic ring-and-ball softening point tester as shown in the examples described hereinafter. The saturated SP value means a SP value when the reaction of the (meth)acrylic acid with the rosin was performed until the SP value of the resulting (meth)acrylic acid-modified rosin reaches a saturated value. The numerator $(X_{a1}-Y)$ of the equation (Aa) means the degree of an increase in a SP value of the rosin modified with (meth)acrylic acid. The larger the value of the degree of modification with (meth)acrylic acid represented by the equation (Aa), the higher the modification degree.

The method for preparing the (meth)acrylic acid-modified rosin is not specifically limited and can be appropriately selected according to the purposes and the (meth)acrylic acid-modified rosin can be obtained, for example, by mixing a rosin with (meth)acrylic acid and heating the mixture to a temperature of about 180° C. to 260° C., and preferably 180° C. to 210° C., thereby adding (meth)acrylic acid to an acid having a conjugated double bond contained in the rosin through the Diels-Alder reaction. The resulting (meth)acrylic acid-modified rosin may be used as it is, or may be used after purifying through an operation such as distillation.

-Resin derived from Fumaric Acid/Maleic Acid-modified Rosin-

The "resin derived from a fumaric acid/maleic acid-modified rosin" includes (i) a resin which is derived from fumaric acid-modified rosin and which has a polyester unit obtained by condensation polymerization of an alcohol component and a carboxylic acid component containing a fumaric acid-modified rosin modified with fumaric acid, (ii) a resin which is derived from maleic acid-modified rosin and which has a polyester unit obtained by condensation polymerization of an alcohol component with a carboxylic acid component containing a maleic acid-modified rosin modified with maleic acid, and (iii) a resin which is derived from fumaric acid/maleic acid-modified rosin and which has a polyester unit obtained by condensation polymerization of an alcohol component with a carboxylic acid component containing a fumaric acid-modified rosin and a maleic acid-modified rosin. In the present invention, a resin derived from a fumaric acid-modified rosin is preferable in view of storage stability.

The fumaric acid-modified rosin is a rosin modified with fumaric acid and is obtained by addition reaction of a rosin containing, as main components, abietic acid, neoabietic acid, palustric acid, pimaric acid, isopimaric acid, sandaracopimaric acid, dehydroabietic acid and levopimaric acid with fumaric acid, similar to the case of the (meth)acrylic acid-modified rosin. Specifically, the fumaric acid-modified rosin is obtained by the Diels-Alder reaction of levopimaric acid, abietic acid, neoabietic acid and palustric acid, each having a conjugated double bond, among main components of the rosin with fumaric acid under heating.

The degree of modification of the rosin with fumaric acid (degree of modification with fumaric acid) is preferably from 5 to 105, more preferably from 20 to 105, still more preferably from 40 to 105, and particularly preferably from 60 to 105, in view of increasing the molecular weight of the polyester resin and decreasing the glass transition temperature.

Herein, the degree of modification with fumaric acid can be calculated using the following equation (Af):

[Equation 2]

$$\text{Degree of Modification with Fumaric Acid} = [(X_{f1}-Y)/(X_{f2}-Y)]\times 100 \quad \text{Equation (Af)}$$

where $X_{f1}$ denotes a SP value of a fumaric acid-modified rosin whose modification degree is to be calculated, $X_{f2}$ denotes a saturated SP value of a fumaric acid-modified rosin obtained by reacting 1 mol of fumaric acid with 0.7 mol of rosin, and Y denotes a SP value of rosin.

The SP value means a softening point measured with an automatic ring-and-ball softening point tester as demonstrated in Examples to be described below. The numerator $(X_{f1}-Y)$ of the equation (Af) means the degree of an increase in a SP value of the rosin modified with fumaric acid. The larger the value of the degree of modification with fumaric acid represented by the equation (Af), the higher the modification degree.

The method for preparing a fumaric acid-modified rosin is not specifically limited and can be appropriately selected according to the purposes and the fumaric acid-modified rosin can be obtained, for example, by mixing a rosin with fumaric acid and heating the mixture to a temperature of about 180° C. to 260° C., preferably 18° C. to 210° C., thereby adding fumaric acid to an acid having a conjugated double bond contained in the rosin through the Diels-Alder reaction.

Furthermore, a rosin is preferably reacted with fumaric acid in the presence of a phenol in view of efficiently reacting rosin with fumaric acid. The phenol is preferably a dihyric phenol or a phenol compound having at least a substituent at the ortho-position relative to the hydroxyl group (hereinafter referred to as a hindered phenol). Among them, the hindered phenol is particularly preferable.

The dihydric phenol is a compound in which two OH groups are attached to the benzene ring and which includes no other substituents attached to that ring. Among them, hydroquinone is preferable.

The hindered phenol is not specifically limited and can be appropriately selected according to the purposes, and examples thereof include mono-t-butyl-p-cresol, mono-t-butyl-m-cresol, t-butylcatechol, 2,5-di-t-butylhydroquinone, 2,5-di-t-amylhydroquinone, propyl gallate, 4,4'-methylenebis(2,6-t-butylphenol), 4,4'-isopropylidenebis(2,6-di-t-butylphenol), 4,4'-butylidenebis(3-methyl-6-t-butylphenol), butylhydroxyanisole, 2,6-di-t-butyl-p-cresol, 2,6-di-t-butylphenol, 2,6-di-t-butyl-4-ethylphenol, 2,4,6-tri-t-butylphenol, octadecyl-3-(4-hydroxy-3',5'-di-t-butylphenyl)propionate, distearyl(4-hydroxy-3-methyl-5-t-butyl)benxzylmalonate, 6-(4-hydroxy-3,5-di-t-butylanilino)-2,4-bisoctylthio-1,3,5-triazine, 2,6-diphenyl-4-octadecanoxyphenol, 2,2'-methylenebis(4-methyl-6-t-butylphenol), 2,2'-methylenebis(4-ethyl-6-t-butylphenol), 2,2'-isobutylidenebis(4,6-dimethylphenol), 2,2'-dihydroxy-3,3'-di-(a-methylcyclohexyl)-5,5'-dimethyldiphenylmethane, 2,2'-methylenebis(4-methyl-6-cyclohexylphenol), tris[β-(3,5-di-t-butyl-4-hydroxyphenyl)propionyloxyethyl] isocyanurate, 1,3,5-tris(2,6-dimethyl-3-hydroxy-4-t-butylbenzyl)isocyanurate, tris(3,5-di-t-butyl-4-hydroxy phenol) isocyanurate, 1,1,3'-tris(2-methyl-4-hydroxy-5-t-butylphenyl)butane, 2,6-bis(2'-hydroxy-3'-t-butyl-5'-methylbenzyl)-4-methylphenol, N,N'-hexamethylenebis(3,5-di-t-butyl-4-hydroxyhydrocinnamate), hexamethylene glycol bis[β-(3,5-di-t-butyl-4-hydroxyphenyl)propionate], triethylene glycol bis[β-(3-t-butyl-5-methyl-4-hydroxyphenyl)propionate] and tetrakis[methylene-3-(3,5-di-t-butyl-4-hydroxyphenyl)propionate]methane. Among these hindered phenols, t-butylcatechol is particularly preferable.

The added amount of phenol is preferably from 0.001 parts by mass to 0.5 parts by mass, more preferably from 0.003 parts by mass to 0.1 parts by mass, and still more preferably from 0.005 parts by mass to 0.1 parts by mass, based on 100 parts by mass of the raw monomer of the fumaric acid-modified rosin.

The fumaric acid-modified rosin may be used as it is, or may be used after purification through such a process such distillation.

The maleic acid-modified rosin is a rosin modified with maleic acid or maleic anhydride and is obtained by addition reaction of a rosin containing, as main components, abietic acid, neoabietic acid, palustric acid, pimaric acid, isopimaric acid, sandaraco-pimaric acid, dehydroabietic acid and levopimaric acid with maleic acid or maleic anhydride, similar to the case of the (meth)acrylic acid-modified rosin. Specifically, the maleic acid-modified rosin is obtained by the Diels-Alder reaction of levopimaric acid, abietic acid, neoabietic acid and palustric acid, each having a conjugated double bond, among main components of the rosin with maleic acid or maleic anhydride under heating.

The degree of modification of the rosin with maleic acid or maleic anhydride (degree of modification with maleic acid) is preferably from 5 to 105, more preferably from 30 to 105, still more preferably from 40 to 105, further preferably from 50 to 105, particularly preferably from 60 to 105, and most preferably from 70 to 105, in view of increasing the molecular weight of the polyester resin and decreasing the low molecular weight oligomer component.

Herein, the degree of modification with maleic acid can be calculated using the following equation (Am):

[Equation 3]

$$\text{Degree of Modification with Maleic Acid}=[(X_{m1}-Y)/(X_{m2}-Y)]\times 100 \qquad \text{Equation (Am)}$$

where $X_{m1}$ denotes an SP value of a maleic acid-modified rosin whose modification degree is to be calculated, $X_{m2}$ denotes a saturated SP value of a maleic acid-modified rosin obtained by reacting 1 mol of maleic acid with 1 mol of rosin, and Y denotes an SP value of rosin.

The SP value means a softening point measured by an automatic ring-and-ball softening point tester as demonstrated in Examples to be described below. The saturated SP value means an SP value when the reaction of the maleic acid with the rosin was performed until the SP value of the resulting maleic acid-modified rosin reaches a saturated value. The numerator ($X_{m1}-Y$) of the equation (Am) means the degree of an increase in a SP value of the rosin modified with maleic acid or maleic anhydride. The larger the value of the degree of modification with maleic acid represented by the equation (Am), the higher the modification degree.

The method for preparing the maleic acid-modified rosin is not specifically limited and can be appropriately selected according to the purposes and the maleic acid-modified rosin can be obtained, for example, by mixing a rosin with maleic acid or maleic anhydride and heating the mixture to a temperature of about 180° C. to 260° C., and preferably 180° C. to 210° C., thereby adding maleic acid or maleic anhydride to an acid having a conjugated double bond contained in the rosin through the Diels-Alder reaction. The resulting maleic acid-modified rosin may be used as it is, or may be used after purifying through an operation such as distillation.

Next, the rosin used in the (meth)acrylic acid-modified rosin, the fumaric acid-modified rosin and the maleic acid-modified rosin (a combination of them is sometimes referred to as a "modified rosin") may be any known rosin without limitation as long as it is a rosin containing abietic acid, neoabietic acid, pulstric acid, pimaric acid, isopimaric acid, sandaracopimaric acid, dehydroabietic acid and levopimaric acid as a main component, for example, a natural rosin obtained from pine trees, an isomerized rosin, a dimerized rosin, a polymerized rosin or a dismutated rosin. In view of color, the rosin is preferably a natural rosin such as a tall rosin which is obtained from tall oil obtained as by-product in the process for preparing a natural rosin pulp, a gum rosin obtained from a raw rosin, or a wood rosin obtained from the stub of pine, and is more preferably a tall rosin in view of low-temperature fixation properties.

The (meth)acrylic acid-modified rosin is obtained through the Diels-Alder reaction under heating and therefore contains decreased impurities as a causative of odor and also has less odor. In view of reducing odor and improving storage stability, the (meth)acrylic acid-modified rosin is preferably obtained by modifying a purified rosin with (meth)acrylic acid, and is more preferably obtained by modifying a purified tall rosin with (meth)acrylic acid. Similarly, the fumaric acid-modified rosin is preferably obtained by modifying a rosin (purified rosin) in which the impurity content has been reduced by the purifying step with fumaric acid, and is more preferably obtained by modifying a purified tall rosin with fumaric acid. Also, the maleic acid-modified rosin is preferably obtained by modifying a rosin (purified rosin) in which the impurity content has been reduced by the purifying step with maleic acid or maleic anhydride, and is more preferably obtained by modifying a purified tall rosin with maleic acid or maleic anhydride.

The purified rosin is a rosin in which the impurity content has been reduced by the purifying step. Impurities contained in the rosin are removed by purifying the rosin in such a manner. Examples of impurities are mainly 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl2-cyclohexene and 4-(1-methylethyl)benzaldehyde. In the present invention, it is possible to use a peak intensity, which is detected as a volatile component of three kinds of impurities such as hexanoic acid, pentanoic acid and benzaldehyde using the head space GC-MS method, as an indicator of the purified rosin. The reason that the volatile component is focused rather the absolute quantity of impurities is that the use of the purified rosin in the present invention for improved odor is one of the improvements over conventional rosin-containing polyester resins.

Specifically, the purified rosin means a rosin in which a peak intensity of hexanoic acid is $0.8\times10^7$ or less, a peak intensity of pentanoic acid is $0.4\times10^7$ or less, and a peak intensity of benzaldehyde is $0.4\times10^7$ or less under measuring conditions of the head space GC-MS of Examples described hereinafter. In view of storage stability and odor, the peak intensity of hexanoic acid is preferably $0.6\times10^7$ or less, and more preferably $0.5\times10^7$ or less. The peak intensity of pentanoic acid is preferably $0.3\times10^7$ or less, and more preferably $0.2\times10^7$ or less. The peak intensity of benzaldehyde is preferably $0.3\times10^7$, and more preferably $0.2\times10^7$ or less.

Furthermore, in view of storage stability and odor, in addition to the above three kinds of substances, each content of n-hexanal and 2-pentylfuran is preferably reduced. A peak intensity of n-hexanal is preferably $1.7\times10^7$ or less, more preferably $1.6\times10^7$ or less, still more preferably $1.5\times10^7$ or less. Also, a peak intensity of 2-pentylfuran is preferably $1.0\times10^7$ or less, more preferably $0.9\times10^7$ or less, and still more preferably $0.8\times10^7$ or less.

The method for purifying the rosin is not specifically limited and a known method can be employed, and is performed by distillation, recrystallization or extraction, and preferably distillations. As the method for distillation, for example, a method described in JP-A No. 07-286139 can be employed and examples thereof include distillation under reduced pressure, molecular distillation and steam distillation. It is preferable to purify by distillation under reduced pressure. For example, distillation is commonly carried out under a pressure of 6.67 kPa or less at a still temperature of 200° C. to 300° C. and a method such as thin film distillation or rectification, including conventional simple distillation is applied. Under conventional distillation conditions, a high molecular weight substance is removed as a pitch fraction in the proportion of 2% by mass to 10% by mass based on the resin charged and, at the same time, 2% by mass to 10% by mass of a first fraction is removed.

The softening point of the rosin before modification is preferably from 50° C. to 100° C., more preferably from 60° C. to 90° C., and still more preferably from 65° C. to 85° C. The softening point of rosin means a softening point measured, when a rosin is once melted and then allowed to stand to cool for one hour under an environment of a temperature of 25° C. and a relative humidity of 50%, using a method shown in Examples described later.

The acid value of the rosin before modification is preferably from 100 mg KOH/g to 200 mg KOH/g, more preferably from 130 mg KOH/g to 180 mg KOH/g, and still more preferably from 150 mg KOH/g to 170 mg KOH/g.

The acid value of the rosin can be measured, for instance, according to the method described in JIS K0070.

The glass transition temperature of the fumaric acid-modified rosin is preferably from 40° C. to 90° C., more preferably from 45° C. to 85° C., and still preferably from 50° C. to 80° C., in view of enhancing storage stability of the resulting polyester resin. In the fumaric acid-modified rosin, the glass transition temperature of the rosin before modification is preferably from 10° C. to 50° C., and more preferably from 15° C. to 50° C., considering the glass transition temperature of the rosin after modification with fumaric acid.

The glass transition temperature of maleic anhydride modified rosin is preferably from 35° C. to 90° C., and more preferably from 45° C. to 70° C., in view of enhancing storage stability of the resulting polyester resin. In the maleic anhydride modified rosin, the glass transition temperature of the rosin before modification is preferably from 10° C. to 50° C., and more preferably from 15° C. to 50° C., considering the glass transition temperature of the rosin after modification with maleic anhydride.

The content of the (meth)acrylic acid-modified rosin, the fumaric acid-modified rosin and the maleic acid-modified rosin in the carboxylic acid component of the resin derived from each modified rosin is preferably 15% by mass or more, and more preferably 25% by mass or more, in view of low-temperature fixation properties. In view of storage stability, the content of the (meth)acrylic acid-modified rosin is preferably 85% by mass or less, more preferably 65% by mass or less, and still more preferably 50% by mass or less. From these points of view, the total content of the (meth)acrylic acid-modified rosin, the fumaric acid-modified rosin and the maleic acid-modified rosin in the carboxylic acid component of the resin derived from each modified rosin is preferably from 15% by mass to 85% by mass, more preferably from 25% by mass to 65% by mass, and still more preferably from 25% by mass to 50% by mass.

The carboxylic acid compound other than the modified rosin, which is contained in the carboxylic acid component, is not specifically limited and can be appropriately selected according to the purposes and includes, for example, an aliphatic dicarboxylic acid such as oxalic acid, malonic acid, maleic acid, fumaric acid, citraconic acid, itaconic acid, glutaconic acid, succinic acid, adipic acid, sebacic acid, azelaic acid, n-odecylsuccinic acid or n-dodecenylsuccinic acid; an aromatic dicarboxylic acid such as phthalic acid, isophthalic acid or terephthalic acid; an alicyclic dicarboxylic acid such as cyclohexanedicarboxylic acid; trihydric or higher polyhydric carboxylic acid, such as trimellitic acid or pyromellitic acid; or an anhydride or alkyl (having 1 to 3 carbon atoms) ester of these acids. As used herein, these acids, anhydrides of these acids, or alkyl esters of acids are generically referred to as a carboxylic acid compound.

-Alcohol Component-

The alcohol component preferably contains an aliphatic alcohol, particularly an aliphatic polyhydric alcohol. The aliphatic polyhydric alcohol is preferably an aliphatic dihydric to hexahydric polyhydric alcohol, and more preferably an aliphatic dihydric to trihydric polyhydric alcohol, in view of reactivity with carboxylic acid containing a modified rosin.

The aliphatic polyhydric alcohol preferably contains a C2-6 aliphatic polyhydric alcohol which has a more compact molecular structure and high reactivity. Examples of the C2-6 aliphatic polyhydric alcohol include ethylene glycol, neopentyl glycol, 1,2-propanediol, 1,3-propanediol, 1,4-butanediol, 1,6-hexanediol, 2,3-butanediol, pentaerythritol, trimethylolpropane, sorbitol and glycerin. These aliphatic polyhydric alcohols may be used alone or in combination.

Among these aliphatic polyhydric alcohols, 1,2-propanediol, 1,3-propanediol and glycerin are particularly preferable.

The content of the C2-6 aliphatic polyhydric alcohol in the aliphatic polyhydric alcohol is preferably 60 mol % or more, more preferably 80 mol % or more, still more preferably 90 mol % or more, and particularly preferably substantially 100 mol %.

The alcohol other than the aliphatic polyhydric alcohol contained in the alcohol component is not specifically limited and can be appropriately selected according to the purposes, and examples thereof include an alkylene oxide adduct of bisphenol A, for example, an alkylene (having 2 to 3 carbon atoms) oxide (average addition molar number of 1 to 16) adduct of bisphenol A, such as polyoxypropylene-2,2-bis(4-hydroxyphenyl)propane or polyoxyethylene-2,2-bis(4-hydroxyphenyl)propane; 1,4-cyclohexanedimethanol, hydrogenated bisphenol A, or an alkylene (having 2 to 4 carbon atoms) oxide (average addition molar number of 1 to 16) adduct thereof.

The content of the aliphatic polyhydric alcohol in the alcohol component is preferably 50 mol % or more, more preferably 60 mol % or more, still more preferably 85 mol % or more, and particularly preferably substantially 100 mol % in view of reactivity with the (meth)acrylic acid-modified rosin.

The polyester-based resin may contain at least one of a trihyridic or higher polyhydric alcohol and a trihyridic or higher polyhydric carboxylic acid compound as long as storage stability is not adversely affected in view of improvement of anti-offset properties. The trihydric or higher polyhydric alcohol is preferably contained in the alcohol component, and the trihydric or higher polyhydric carboxylic acid compound is preferably contained in the carboxylic acid component. Also, the trihydric or higher polyhydric alcohol is preferably contained in the alcohol component and the trihydric or higher polyhydric carboxylic acid compound is preferably contained in the carboxylic acid component. In view of storage stability and reduction of the content of the residual monomer, the amount of the trihydric or higher polyhydric carboxylic acid compound is preferably from 0.001 mol to 40 mol, and more preferably from 0.1 mol to 25 mol, per 100 mol of the alcohol component. The content of the trihydric or higher polyhydric alcohol in the alcohol component is preferably from 0.001 mol % to 40 mol %, and more preferably from 0.1 mol % to 25 mol %.

In the trihydric or higher raw monomer, the trihydric or higher polyhydric carboxylic acid compound is preferably, for example, trimellitic acid or a derivative thereof and the trihydric or higher polyhydric alcohol includes, for example, glycerin, pentaerythritol, trimethylolpropane, sorbitol, or an alkylene (having 2 to 4 carbon atoms) oxide (average addition molar number of 1 to 16) adduct thereof. Among these, glycerin, trimellitic acid or a derivative thereof is particularly preferable because it forms a branching site or functions as a crosslinking agent and is also effective to improve low-temperature fixation properties.

-Esterifying Catalyst-

Condensation polymerization of the alcohol component and the carboxylic acid component is preferably performed in the presence of an esterifying catalyst. The esterifying catalyst includes Lewis acids such as p-toluenesulfonic acid, a titanium compound and a tin(II) compound having no Sn—C bond, and these esterifying catalysts may be used alone or in combination. Among these esterifying agents, a tin(II) compound having no Sn—C bond is particularly preferable.

The titanium compound is preferably a tin(II) compound having no Sn—C bond, and more preferably a compound having an alkoxyl group having 1 to 28 carbon atoms, an alkenyl group or an acyloxy group.

The titanium compound includes, for example, titanium diisopropylate bistriethanolaminate [$Ti(C_6H_{14}O_3N)_2(C_3H_7O)_2$], titanium diisopropylate bisdiethanolaminate [$Ti(C_4H_{10}O_2N)_2(C_3H_7O)_2$], titanium dipentylate bistriethanolaminate [$Ti(C_6H_{14}O_3N)_2(C_5H_{11}O)_2$], titanium diethylate bistriethanolaminate [$Ti(C_6H_{14}O_3N)_2(C_2H_5O)_2$], titanium dihydroxyoctylate bistriethanolaminate [$Ti(C_6H_{14}O_3N)_2(OHC_8H_{16}O)_2$], titanium distearate bistriethanolaminate [$Ti(C_6H_{14}O_3N)_2(C_{18}H_{37}O)_2$], titanium triisopropylate triethanolaminate [$Ti(C_6H_{14}O_3N)_1(C_3H_7O)_3$] and titanium monopropylate tris(triethanolaminate) [$Ti(C_6H_{14}O_3N)_3(C_3H_7O)$]. Among these titanium compounds, titanium diisopropylate bistriethanolaminate, titanium diisopropylate bisdiethanolaminate and titanium dipentylate bistriethanolaminate are particularly preferable and are also commercially available from MATSUMOTO TRADING CO., LTD.

Specific examples of the other preferable titanium compound include tetra-n-butyl titanate [$Ti(C_4H_9O)_4$], tetrapropyl titanate [$Ti(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyldihydroxyoctyl titanate [$Ti(C_8H_{17}O)_2(OHC_8H_{16}O)_2$] and dimyristyldioctyl titanate [$Ti(C_{14}H_{29}O)_2(C_8H_{17}O)_2$]. Among these titanium compounds, tetrastearyl titanate, tetramyristyl titanate, tetraoctyl titanate and dioctyldihydroxyoctyl titanate are preferable, and are also obtained by reacting titanium halide with a corresponding alcohol and are commercially available from NISSO Co., Ltd.

The content of the titanium compound is preferably from 0.01 parts by mass to 1.0 part by mass, and more preferably from 0.1 parts by mass to 0.7 parts by mass per 100 parts by mass of the total amount of the alcohol component and the carboxylic acid component.

The tin(II) compound having no Sn—C bond is preferably a tin(II) compound having a Sn—O bond or a tin(II) compound having a Sn—X (wherein X represents a halogen atom) bond, and more preferably a tin(II) compound having a Sn—O bond.

The tin(II) compound having a Sn—O bond includes, for example, a tin(II) carboxylate having a carboxylic acid group having 2 to 28 carbon atoms, such as tin(II) oxalate, tin(II) diacetate, tin(II) dioctanoate, tin(II) dilaurate, tin(II) distearate or tin(II) dioleate; dialkoxytin(II) having an alkoxy group having 2 to 28 carbon atoms, such as dioctyloxytin(II), dilauroxytin(II), distearoxytin(II) or dioleyloxytin(II); tin(II) oxide; and tin(II) sulfate.

The compound having a Sn—X (wherein X represents a halogen atom) bond includes, for example, a tin(II) halide such as tin(II) chloride or tin(II) bromide. Among these compounds, in view of electrification rising effect and catalytic ability, tin(II) fatty acid represented by $(R^1COO)_2Sn$ (wherein $R^1$ represents an alkyl or alkenyl group having 5 to 19 carbon atoms), dialkoxytin(II) represented by $(R^2O)_2Sn$ (wherein $R^2$ represents an alkyl or alkenyl group having 6 to 20 carbon atoms) and tin(II) oxide represented by SnO are preferable, tin(II) fatty acid and tin(II) oxide which are represented by $(R^1COO)_2Sn$ are more preferable, and tin(II) dioctanoate, tin(II) distearate and tin(II) oxide are still more preferable.

The content of the tin(II) compound having no Sn—C bond is preferably from 0.01 parts by mass to 1.0 parts by mass, and more preferably from 0.1 parts by mass to 0.7 parts by mass per 100 parts by mass of the total amount of the alcohol component and the carboxylic acid component.

When the titanium compound is used in combination with the tin(II) compound having no Sn—C bond, the total amount of the titanium compound and the tin(II) compound is preferably from 0.01 parts by mass to 1.0 parts by mass, and more preferably from 0.1 parts by mass to 0.7 parts by mass per 100 parts by mass of the total amount of the alcohol component and the carboxylic acid component.

Condensation polymerization of the alcohol component and the carboxylic acid component can be performed, for example, in the presence of the esterifying catalyst in an inert gas atmosphere at a temperature of 180° C. to 250° C.

A difference in the softening point between two kinds of polyester-based resins is 10° C. or higher in view of enhancing dispersibility of the internal additive and enhancing the effect exerted on fixation properties and anti-offset properties, particularly high-temperature anti-offset properties. In an achromatic color toner such as black toner, the difference is preferably from 10° C. to 60° C., and more preferably from 20° C. to 50° C., in view of lowering gloss. In a chromatic color toner such as yellow toner, magenta toner or cyan toner, the difference is preferably from 10° C. to 30° C., and more preferably from 15° C. to 30° C., in view of enhancing gloss. The softening point of the polyester-based resin (A) having a lower softening point is preferably from 80° C. to 120° C., and more preferably from 90° C. to 110° C., in view of fixation properties. On the other hand, the softening point of the polyester-based resin (B) having a higher softening point is preferably from 100° C. to 180° C., more preferably from 120° C. to 180° C., and still more preferably from 120° C. to 160° C., in view of high-temperature anti-offset properties.

The glass transition temperature of the polyester-based resin (A) and the polyester-based resin (B) is preferably from 45° C. to 75° C., and more preferably from 50° C. to 75° C., in view of fixation properties, storage stability and durability.

The acid value of the polyester-based resin (A) and the polyester-based resin (B) is preferably from 1 mg KOH/g to 80 mg KOH/g, more preferably from 5 mg KOH/g to 60 mg KOH/g, and still more preferably from 5 mg KOH/g to 50 mg KOH/g, in view of chargeability and environmental stability. The hydroxyl value of the polyester-based resin (A) and the polyester-based resin (B) is preferably from 1 mg KOH/g to 80 mg KOH/g, more preferably from 8 mg KOH/g to 50 mg KOH/g, and still more preferably from 8 mg KOH/g to 40 mg KOH/g, in view of chargeability, and environmental stability.

In the polyester-based resin (A) and the polyester-based resin (B), in view of low-temperature fixation properties, anti-offset properties and storage stability, the content of a low molecular weight component having a molecular weight of 500 or less, which is involved in a residual monomer component and an oligomer component, is preferably 12% or less, more preferably 10% or less, still more preferably 9% or less, and particularly preferably 8% or less. The content of the low molecular weight component can be decreased by the method of enhancing the degree of modification of rosin with (meth)acrylic acid. The content of the low molecular weight component varies depending on the area percentage of the molecular weight to be measured by gel permeation chromatography (GPC) of Examples described hereinafter.

In the present invention, the polyester unit in the polyester-based resins (A) and (B) is preferably amorphous which is different from crystalline.

In the present specification, an amorphous resin is a resin in which a difference between the softening point and the glass transition temperature (Tg) is 30° C. or higher.

The mass ratio (A/B) of the polyester-based resin (A) and the polyester-based resin (B) is preferably from 1/90 to 90/10, more preferably from 20/80 to 80/20, and still more preferably from 30/70 to 70/30, in view of fixation properties and durability.

In the present invention, when the binder resin is composed of three or more kinds of polyester-based resins, optional two kinds of resins, the total content of which is 50% by mass or more in the binder resin, may satisfy a relationship between the softening point of the polyester-based resin (A) and that of the polyester-based resin (B). Therefore, as long as the effects of the present invention are not adversely affected, the binder resin may be used in combination with a known binder resin, for example, a vinyl-based resin such as styrene-acrylic resin, and the other resin such as epoxy resin, polycarbonate resin or polyurethane resin, including a polyester-based resin which does not correspond to the polyester-based resin (A) and the polyester-based resin (B). The total content of the polyester-based resin (A) and the polyester-based resin (B) in the binder resin is preferably 70% by mass or more, more preferably 80% by mass or more, still more preferably 90% by mass or more, and particularly preferably substantially 100% by mass.

In view of low-temperature fixation properties, anti-offset properties, durability and storage stability, the content of the resin derived from the (meth)acrylic acid-modified rosin in the binder resin is preferably 70% by mass or more, more preferably 80% by mass or more, still more preferably 90% by mass or more, and particularly preferably substantially 100% by mass.

In the present invention, the polyester-based resin means a resin having a polyester unit. The polyester unit means a site having a polyester structure and the polyester-based resin includes not only a polyester resin, but also a polyester resin modified as long as characteristics are not adversely affected substantially. In the present invention, both the polyester-based resins (A) and (B) are preferably polyester resins. The modified polyester resin includes, for example, polyester resins grafted or blocked with phenol, urethane or epoxy by the methods described in JP-A No. 11-133668, JP-A No. 10-23990 and JP-A No. 08-20636, and a composite resin having two or more kinds of resin units including a polyester unit.

The composite resin is preferably a resin having a polyester unit and an addition polymerization-based resin such as vinyl-based resin.

The raw monomer of the polyester unit includes the same alcohol component and carboxylic acid component as those of the raw monomer of the polyester.

The raw monomer of the vinyl-based resin unit includes, for example, styrene compounds such as styrene and α-methylstyrene; ethylenically unsaturated monoolefins such as ethylene and propylene; diolefines such as butadiene; halovinyls such as vinyl chloride; vinylesters such as vinyl acetate and vinyl propionate; esters of ethylenical monocarboxylic acids, such as alkyl (having 1 to 18 carbon atoms) ester of (meth)acrylic acid and dimethylaminoethyl(meth)acrylate; vinylethers such as vinyl methyl ether; vinylidene halides such as vinylidene chloride; and N-vinyl compounds such as N-vinyl pyrrolidone. Among these monomers, styrene, 2-ethylhexyl acrylate, butyl acrylate, and a long chain alkyl (having 12 to 18 carbon atoms) of acrylic acid are preferable, styrene is preferable in view of chargeability and an alkyl ester of (meth)acrylic acid is preferable in view of fixation properties and control of a glass transition temperature.

The content of styrene in the raw monomer of the vinyl-based resin is preferably from 50 to 90% by weight, and more preferably from 75 to 85% by weight. The mass ratio (styrene/alkyl ester of (meth)acrylic acid) of the vinyl-based resin to the alkyl ester of (meth)acrylic acid in the raw monomer is preferably from 50/50 to 95/5, and more preferably from 70/30 to 95/5.

In the addition polymerization of the raw monomer of the vinyl-based resin unit, a polymerization initiator and a crosslinking agent may be used, if necessary.

In the present invention, the mass ratio (raw monomer of polyester unit/raw monomer of addition polymerization-based resin unit) of the raw monomer of the polyester unit to the raw monomer of the addition polymerization-based resin unit is preferably from 50/50 to 95/5, and more preferably from 60/40 to 95/5, because a continuous phase is a preferably a polyester unit and a dispersed phase is preferably an addition polymerization-based resin unit.

In the present invention, the composite resin is preferably a resin (hybrid resin) obtained by using a compound (bireactive monomer) capable of reacting with both the raw monomer of the polyester unit and the raw monomer of the addition polymerization-based resin unit, in addition to the raw monomer of the polyester unit and the raw monomer of the addition polymerization-based resin unit.

The bireactive monomer is preferably a compound having at least one functional group selected from the group consisting of hydroxyl group, carboxyl group, epoxy group, primary amino group and secondary amino group, and an ethylenically unsaturated bond in the molecule, and dispersibility of the resin serving as the dispersed phase can be further improved by using such a bireactive monomer. Specific examples of the bireactive monomer include acrylic acid, fumaric acid, methacrylic acid, citraconic acid, maleic acid, 2-hydroxyethyl(meth)acrylate, glycidyl(meth)acrylate, or an anhydride and a derivative such as alkyl (having 1 to 2 carbon atoms) ester of these carboxylic acids. Among these, acrylic acid, methacrylic acid, fumaric acid, maleic acid, or a derivative of these carboxylic acids are preferable in view of reactivity.

Among the above bireactive monomers, a monomer having two or more functional groups (polycarboxylic acid) or a derivative thereof is handled as the raw monomer of the polyester unit, while a monomer having one functional group (monocarboxylic acid) or a derivative thereof is handled as the raw monomer of the addition polymerizaton-based resin unit. The amount of the bireactive monomer is preferably from 1 mol to 30 mol based on 100 mol of the raw monomer of the polyester unit excluding the bireactive monomer. In view of further improving dispersibility of the addition polymerization-based resin unit, the amount of the bireactive monomer is preferably from 1.5 mol to 20 mol, and more preferably from 2 mol to 10 mol, in the method of reacting at high temperature after the completion of the addition polymerization reaction in the process for producing a binder resin. The amount of the bireactive monomer is preferably from 4 mol to 15 mol, and more preferably from 4 mol to 10 mol, in the method of using the bireactive monomer in an amount somewhat more than the prescribed ratio while maintaining the reaction temperature at a constant temperature after the completion of the addition polymerization reaction.

In the present invention, the composite resin is preferably a resin obtained by preliminarily mixing a raw monomer of a polyester unit with a raw monomer of an addition polymerization-based resin unit and simultaneously performing condensation polymerization reaction and addition polymerization reaction in the same reaction vessel. When the composite resin is a hybrid resin obtained by further using the bireactive monomer, the composite resin is preferably a resin obtained by preliminarily mixing a mixture of a raw monomer of a polyester unit and a raw monomer of an addition polymerization-based resin unit with a bireactive monomer and simultaneously performing condensation polymerization reaction and addition polymerization reaction in the same reaction vessel.

In the present invention, it is not necessary that proceeding and completion of condensation polymerization reaction and addition polymerization reaction are simultaneously performed and the reaction may be allowed to proceed and completed by appropriately selecting the reaction temperature and the reaction time according to each reaction mechanism. For example, there is exemplified a method comprising mixing a raw monomer of a polyester unit, a raw monomer of an addition polymerization-based resin unit and a bireactive monomer, performing addition polymerization reaction under the temperature condition suited for addition polymerization reaction, for example, 50° C. to 180° C. to form an addition polymerization-based resin having a functional group capable of performing condensation polymerization reaction, adjusting the reaction temperature to the temperature suited for condensation polymerization reaction, for example, 190° C. to 270° C., and performing condensation polymerization reaction to form a condensation polymerization-based resin.

-Coloring Agent-

The coloring agent is not specifically limited and can be appropriately selected from known dyes and pigments according to the purposes and includes, for example, carbon black, nigrosine dye, iron black, naphtol yellow-S, Hansa yellow (10G, 5G, G), cadmium yellow, yellow oxide, ocher, chrome yellow, titanium yellow, polyazo yellow, oil yellow, Hansa yellow (GR, A, RN, R), pigment yellow, benzidine yellow (G, GR), permanent yellow (NCG), vulcan fast yellow (5G, R), tartrazine lake, quinoline yellow lake, anthrazane yellow BGL, isoindolinone yellow, colcothar, minium, vermilion lead, cadmium red, cadmium mercury red, antimony vermilion, parmanent red 4R, para red, fire red, para-chloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON marron light, BON marron medium, eosine lake, rhodanmine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, Cerulean Blue, alkali blue lake, peacock blue lake, Victoria blue lake, no metal-containing phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white and Litobon. These coloring agents may be used alone or in combination.

The color of the coloring agent is not specifically limited and can be appropriately selected according to the purposes and the coloring agent includes, for example, those for black color and those for multicolor. These coloring agents may be used alone or in combination.

The coloring agent for black color includes, for example, carbon blacks (C.I. Pigment Black 7) such as furnace black, lamp black, acetylene black and channel black; metals such as copper, iron (C.I. Pigment Black 11) and titanium oxide; and organic pigments such as aniine black (C.I. Pigment Black 1).

The coloring pigment for magenta includes, for example, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C.I. Pigment Violet 19; and C.I. Violet 1, 2, 10, 13, 15, 23, 29 and 35.

The coloring pigment for cyan includes, for example, C.I. Pigment Blue 2, 3, 15, 15:1, 15:2, 15:3, 15:4, 15:6, 16, 17, 60; C.I. Bat Blue 6; C.I. Acid Blue 45, copper phthalocyanine pigment in which a phthalocyanine skeleton is substituted with 1 to 5 phthalimidemethyl groups, Green 7 and Green 36.

The coloring pigment for yellow includes, for example, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. Bat Yellow 1, 3, 20, and Orange 36.

The content of the coloring agent in the toner is not specifically limited and can be appropriately selected according to the purposes, and is preferably from 1% by mass to 15% by mass, and more preferably from 3% by mass to 10% by mass. When the content is less than 1% by mass, a tinting strength of the toner decreases. On the other hand, when the content is more than 15% by mass, poor dispersion of the pigment in the toner occurs and thus decrease in the tinting strength and deterioration of electrical properties of the toner may occur.

The coloring agent may be used as a master batch which is combined with a resin. The resin is not specifically limited and can be appropriately selected from known resins according to the purposes and includes, for example, styrene or a polymer of a substituted styrene, styrene-based copolymer, polymethyl methacrylate resin, polybutyl methacrylate resin, polyvinyl chloride resin, polyvinyl acetate resin, polyethylene resin, polypropylene resin, polyester resin, epoxy resin, epoxypolyol resin, polyurethane resin, polyamide resin, polyvinyl butyral resin, polyacrylic acid resin, rosin, modified rosin, terpene resin, aliphatic hydrocarbon resin, alicyclic hydrocarbon resin, aromatic-based petroleum resin, chlorinated paraffin and paraffin. These resins may be used alone or in combination.

The styrene or the polymer of the substituted styrene includes, for example, polyester resin, polystyrene resin, poly p-chlorostyrene resin and polyvinyltoluene resin. The styrene-based copolymer includes, for example, styrene-p-chlorostyrene copolymer, styrene-propylene copolymer, styrene-vinyltoluene copolymer, styrene-vinyl naphthaline copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer and styrene-maleate ester copolymer.

The master batch can be prepared by mixing and kneading a resin for a master batch and the coloring agent while applying a high shear force. In this case, an organic solvent is preferably added so as to enhance an interaction between the coloring agent and the resin. Also, a so-called flushing method is preferable because a wet cake of a coloring agent can be used as it is without being dried. The flushing method is a method comprising ming and kneading an aqueous paste containing water of a coloring agent with an organic solvent and migrating the coloring agent to the resin side, thereby removing moisture and a organic solvent component. A high shear dispersing device such as three roll mill is preferably used for mixing and kneading described above.

-Releasing Agent-

The releasing agent is not specifically limited and can be appropriately selected from known releasing agents and includes, for example, waxes such as carbonyl group-containing wax, polyolefin wax and long chain hydrocarbon. These releasing agents may be used alone or in combination. Among these releasing agents, carbonyl group-containing wax is preferable.

The carbonyl group-containing wax includes, for example, polyalkanate ester, polyalkanol ester, polyalkanoic acid amide, polyalkylamide and dialkylketone. The polyalkanoate ester includes, for example, carnauba wax, montan wax, trimethylolpropane tribehenate, pentaerythritol tetrabehenate, pentaerythritol diacetate dibehenate, glycerin tribehenate and 1,18-octadecanediol distearate. The polyalkanol ester includes, for example, tristearyl trimellitate and distearyl maleate. The polyalkanoic acid amide includes, for example, dibehenylamide. The polyalkylamide includes, for example, trimellitic acid tristearylamide. The dialkylketone includes, for example, distearylketone. Among these carbonyl group-containing waxes, a polyalkanate ester is particularly preferable.

The polyolefin wax includes, for example, polyethylene wax and polypropylene wax.

The long chain hydrocarbon includes, for example, paraffin wax and sazol wax.

The melting point of the releasing agent is not specifically limited and can be appropriately selected according to the purposes, and is preferably from 40° C. to 160° C., preferably from 50° C. to 120° C., and particularly preferably from 60° C. to 90° C. When the melting point is lower than 40° C., an adverse influence may be exerted on heat resistant storage stability. When the melting point is higher than 160° C., cold offset may occur upon fixation at low temperature.

The melting point of the releasing agent can be determined as follows using a differential scanning calorimeter (manufactured by Seiko Electronic Industry Co., Ltd., DSC210) in the following manner. That is, sample is heated to 200° C. and cooled to 0° C. from the same temperature at a temperature-fill rate of 10° C./min, and thus a maximum peak temperature of heat of fusion can be determined as a melting point.

The melt viscosity of the releasing agent is preferably from 5 cps to 1000 cps, and more preferably from 10 cps to 100 cps, in terms of a value measured at a temperature which is 20° C. higher than a melting point of the wax. When the melt viscosity is less than 5 cps, releasabiliy may deteriorate. When the melt viscosity is more than 1,000 cps, it is sometimes impossible to obtain the effect of improving hot offset resistance and low-temperature fixation properties.

The content of the releasing agent in the toner is not specifically limited and can be appropriately selected according to the purposes, and is preferably from 0% by mass to 40% by mass, and more preferably from 3% by mass to 30% by mass.

When the content is more than 40% by mass, fluidity of the toner may deteriorate.

-Charge Control Agent-

The charge control agent is not specifically limited and can be appropriately selected from known charge control agents according to the purposes. When a colored material is used, a color tone may vary and therefore a colorless or nearly white material is preferable and includes, for example, triphenylmethane-based dye, chelate molybdate pigment, rhodamine-based dye, alkoxy-based amine, quaternary ammonium salt (including fluorine modified quaternary ammonium salt), alkylamide, single substance of phosphorus or a compound thereof, single substance of tungsten or a compound thereof, fluorine-based activator, a metal salt of salicylic acid, and a metal salt of a salicylic acid derivative. These charge control agents may be used alone or in combination.

The charge control agent may be commercially available and the commercially available charge control agent includes, for example, quaternary ammonium salt Bontron P-51, oxynaphthoic acid-based metal complex E-82, salicylic acid-based metal complex E-84 and phenol-based condensate E-89 (al of which are manufactured by Orient Chemical Industries, LTD.); quaternary ammonium salt molybdenum complex TP-302 and TP-415 (manufactured by Hodogaya Chemical Co., LTD.), quaternary ammonium salt Copy Charge PSY VP2038, triphenylmethane derivative Copy Blue PR, quaternary ammonium salt Copy Charge NEG VP2036 and Copy Charge NX VP434 (all of which are manufactured by HEKISUTO Co.); LRA-901 and boron complex LR-147 (manufactured by Japan Carlit Co., Ltd.); quinacridone and azo-based pigment; and polymer-based compounds having a functional group such as sulfonic acid group, carboxyl group or quaternary ammonium salt.

The charge control agent may be dissolved or dispersed after melt-kneading with the master batch, or directly dissolved or dispersed in the organic solvent, together with each component of the toner, or may be fixed to the surface of the toner after preparing toner particles.

The content of the charge control agent in the toner varies depending on the kind of the binder resin, the presence or absence of the additive and dispersion method and is not unconditionally defined, and is preferably from 0.1 parts by mass to 10 parts by mass, and more preferably from 0.2 parts by mass to 5 parts by mass per 100 parts by mass of the binder resin. When the content is less than 0.1 parts by mass, charge controllability may not be obtained sometimes. On the other hand, the content is more than 10 parts by mass, chargeability of the toner becomes too large and the effect of a main charge control agent deteriorates, and thus an electrostatic suction force with the developing roller increases, resulting in deterioration of fluidity of the developer and decrease in image density.

-External Additive-

The external additive is not specifically limited and can be appropriately selected from known external additives according to the purposes and includes, for example, fine silica particles, hydrophobized fine silica particles, fatty acid metal salt (for example, zinc stearate, aluminum stearate, etc.); metal oxide (for example, titania, alumina, tin oxide, antimony oxide, etc.) or a hydrophobized substance thereof and a fluoropolymer. Among these external additives, hydrophobized fine silica particles, titania particles and hydrophobized fine titania particles are preferable.

The fine silica particles include, for example, HDK H 2000, HDK H 2000/4, HDK H 2050EP, HVK21 and HDK H1303 (all of which are manufactured by HEMSUTO Co.); and R972, R974, RX200, RY200, R202, R805 and R812 (all of which are manufactured by Nippon Aerosil Co., Ltd.). The fine titania particles includes, for example, P-25 (manufactured by Nippon Aerosil Co., Ltd.); STT-30 and STT-65C-S (all of which are manufactured by Titan Kogyo Kabushiki Kaisha); TAF-140 (manufactured by FUJI TITANIUM INDUSTRY CO., LTD.); and MT-150W, MT-500B, MT-600B and MT-150A (all of which are manufactured by TAYCA Corporation). The hydrophobized fine titanium oxide particles includes, for example, T-805 (manufactured by Nippon Aerosil Co., Ltd.); STT-30A and STT-65S-S (all of which are manufactured by Titan Kogyo Kabushiki Kaisha); TAF-500T and TAF-1500T (all of which are manufactured by FUJI TITANIUM INDUSTRY CO., LTD.); MT-100S, MT-100T (all of which are manufactured by TAYCA Corporation) and IT-S (manufactured by Ishihara Sangyo Kaisha, Ltd.).

The hydrophobized fine silica particles, hydrophobized fine titania particles and hydrophobized fine alumina particles can be obtained by treating hydrophilic fine particles with a silane coupling agent such as methyltrimethoxysilane, methyltriethoxysilane or octyltrimethoxysilane.

The hydrophobizing agent includes, for example a silane coupling agent such as dialkyl-dihalogenated silane, trialkyl-halogenated silane, alkyl-trihalogenated silane or hexaalkyl-disilazane, silylating agent, silane coupling agent having a fluorinated alkyl group, organic titanate-based coupling agent, aluminum-based coupling agent, silicone oil, and silicone varnish.

Also, silicone oil-treated inorganic fine particles obtained by optionally treating inorganic fine particles with silicone oil under heating are preferable.

The inorganic fine particles include, for example, silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, blood red, antimony trioxide, magnesium oxide, zirconium hydroxide, barium sulfate, barium carbonate, calcium carbonate, silicon carbide and silicon nitride. Among these inorganic fine particles, silica and titanium dioxide are particularly preferable.

The silicone oil includes, for example, dimethyl silicone oil, methylphenyl silicone oil, chlorophenyl silicone oil, methylhydrogen silicone oil, alkyl modified silicone oil, fluorine modified silicone oil, polyether modified silicone oil, alcohol modified silicone oil, amino modified silicone oil, epoxy modified silicone oil, epoxy-polyether modified silicone oil, phenol modified silicone oil, carboxyl modified silicone oil, mercapto modified silicone oil, acryl or methacryl modified silicone oil and $\alpha$-methylstyrene modified silicone oil.

The average particle size of primary particles of the inorganic fine particles is preferably from 1 nm to 100 nm, and more preferably from 3 nm to 70 nm. When the average particle size is less than 1 nm, the inorganic fine particles are embedded in the toner and the function may not be effectively exerted. On the other hand, when the average particle size is more than 100 nm, the surface of the latent electrostatic image bearing member may be uniformly scratched. As the external additive, inorganic fine particles and hydrophobized inorganic fine particles can be used in combination. The average particle size of the drophobized primary particles is preferably from 1 nm to 100 nm, and more preferably from 5 nm to 70 nm. It is preferable to contain at least two kinds of inorganic fine particles in which the average particle size of hydrophobized primary particles is 20 nm or less, and it is more preferable to contain at least one kind of inorganic fine particles having the average particle size of 30 nm or more. The specific surface area as measured by the BET method of the inorganic fine particles is preferably from 20 $m^2/g$ to 500 $m^2/g$.

The content of the external additive in the toner is preferably from 0.1% by mass to 5% by mass, and more preferably from 0.3% by mass to 3% by mass.

As the external additive, fine resin particles can also be added. Examples thereof include fine resin particles made of polystyrene obtained by soap free emulsion polymerization, suspension polymerization or dispersion polymerization; fine resin particles made of a copolymer of methacrylate ester or acrylate ester; fine resin particles made of polycondensed resin such as silicone, benzoguanamine or nylon; and polymer particles of thermosetting resin. By using in combination with these fine resin particles, it is possible to enhance chargeability of the toner, reduce the reverse charged toner and reduce background smear. The content of the fine resin particles in the toner is preferably from 0.01% by mass to 5% by mass, and more preferably from 0.1% by mass to 2% by mass.

-Other Components-

The other components are not specifically limited and can be appropriately selected according to the purposes and include, for example, a fluidity improver, a cleanability improver, a magnetic material and a metal soap.

The fluidity improver enhances hydrophobicity by a surface treatment and can prevent deterioration of fluidity and chargeability even under a high humidity and includes, for example, a silane coupling agent, a silylating agent, a silane coupling agent having a fluorinated alkyl group, an organic titanate-based coupling agent, an aluminum-based coupling agent, a silicone oil and a modified silicone oil.

The cleanability improver is added to the toner so as to remove the latent electrostatic image bearing member or the developer left on the intermediate transfer member after transfer and includes, for example, a fatty acid metal salt such as zinc stearate, calcium stearate or stearic acid; and fine polymer particles produced by soap free emulsion polymerization, such as fine polymethyl methacrylate particles or fine polystyrene particles. The fine polymer particles preferably show comparatively narrow particle size distribution and preferably has a volume average particle size of 0.01 μm to 1 μm.

The magnetic material is not specifically limited and can be appropriately selected from known magnetic materials according to the purposes and includes, for example, iron powder, magnetite and ferrite. Among these magnetic materials, a white magnetic material is preferable in view of color tone.

-Method for Preparation of Toner-

The method for preparation of the toner is not specifically limited and can be appropriately selected from conventionally known methods for preparation of the toner according to the purposes and includes, for example, a kneading and grinding method, a polymerization method, a dissolution suspension method and a spray granulation method.

-Kneading and Grinding Method-

The kneading and grinding method is a method of melt-kneading toner materials containing at least a binder resin and a coloring agent and grinding the resulting kneaded mixture, followed by grinding to obtain base particles of the toner.

In the melt-kneading process, the toner materials are mixed and the mixture is charged in a melt-kneader and then melt-kneaded. As the melt-kneader, for example, a single- or twin-screw continuous kneader or a batch type kneader using a roll mill can be used. For example, a KTF type twin screw extruder manufactured by KOBE STEEL., LTD., a TEM type extruder manufactured by TOSHIBA MACHINE CO., LTD., a twin screw extruder manufactured by KCK Co., a PCM type twin screw extruder manufactured by Ikegai Tekkosho K.K. and a cokneader manufactured by Buss Co. are preferably used. This melt-kneading process is preferably under proper conditions so as not to cause cleavage of the molecular chain of the binder resin. Specifically, the melt-kneading temperature is set with reference to the softening point of the binder resin. When the melt-kneading temperature is too higher than the softening point, severe cleavage occurs. On the other hand, when the melt-kneading temperature is too lower, dispersion may not proceed.

In the grinding process, the kneaded mixture obtained in the kneading process is ground. In this grinding process, it is preferred that the kneaded mixture is coarsely ground and then finely ground. In this case, it is possible to preferably use a system in which the kneaded mixture is ground by colliding against an impact plate in a jet stream, or particles are ground by colliding with each other in a jet stream, or particles are ground in a narrow gap between a rotor rotating mechanically and a stator.

In the classifying process, the ground product obtained by grinding is classified to obtain particles having a predetermined particle size. Classification can be performed by removing the portion of fine particles using a cyclone separator, a decanter or a centrifuge.

After the completion of grinding and classification, the ground product is classified in an air flow by a centrifugal force, and thus toner base particles having a predetermined particle size can be prepared.

Next, an external additive is externally added to toner base particles. An external additive is coated on the surface of toner base particles while being segmented by mixing the toner base particles and the external additive with stirring. At this time, it is important in view of durability to adhere the external additive such as inorganic fine particles or fine resin particles onto the toner base particles, uniformly and firmly.

-Polymerization Method-

According to the method for preparation of a toner using the polymerization method, for example, a toner material containing at least urea or urethane bondable modified polyester-based resin and a coloring agent is dissolved or dispersed in an organic solvent. The resulting solution or dispersion is dispersed in an aqueous medium and subjected to the polyaddition reaction, and then the solvent of the dispersion solution is removed, followed by washing.

The urea or urethane-bondable modified polyester-based resin includes, for example, a polyester prepolymer having an isocyanate group obtained by reacting a carboxyl group or a hydroxyl group at the end of a polyester with a polyhydric isocyanate compound (PIC). A modified polyester resin obtained by crosslinking and/or extension of the molecular chain through the reaction of the polyester prepolymer and amines can improve hot offset properties while maintaining low-temperature fixation properties.

The polyhydric isocyanate compound (PIC) includes, for example, aliphatic polyhydric isocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); araliphatic diisocyanates (α,α,α',α'-tetramethylxylylene diisocyanate, etc.); isocyanates; and those obtained by blocking the polyisocyanate with a phenol derivative, oxime or caprolactam. These polyhydric isocyanate compounds may be used alone or in combination.

With respect to a ratio of the polyhydric isocyanate compound (PIC), an equivalent ratio of an isocyanate group [NCO] to a hydroxyl group [OH] of a polyester having a hydroxyl group, [NCO]/[OH], is preferably from 5/1 to 1/1, more preferably from 4/1 to 1.2/1, and still more preferably from 2.5/1 to 1.5/1.

The number of isocyanate groups contained per one molecule of in the polyester prepolymer having an isocyanate group (A) is preferably 1, more preferably from 1.5 to 3 on average, and still more preferably from 1.8 to 2.5 on average.

The amines (B) to be reacted with the polyester prepolymer include, for example, a divalent amine compound (B1), a trihydric or higher polyhydric amine compound (B2), an aminoalcohol (B3), aminomercaptan (B4), amino acid (B5), and a compound (B6) in which amino groups of B1 to B5 are blocked.

The divalent amine compound (B1) includes, for example aromatic diamines (phenylenediamine, diethyltoluenediamine, 4,4'-diaminodiphenylmethane, etc.); alicyclic diamines (4,4'-diamino-3,3'-dimethyldicyclohexylmethane, diaminecyclohexane, isophoronediamine, etc.); and aliphatic diamines (ethylenediamine, tetramethylenediamine, hexamethylenediamine, etc.).

The trihydric or higher polyhydric amine compound (B2) includes, for example, diethylenetriamine and triethylenetetramine.

The aminoalcohol (B3) includes, for example, ethanolamine and hydroxyethylaniline.

The aminomercaptan (B4) includes, for example, aminoethylmercaptan and aminopropylmercaptan.

The amino acid (B5) includes, for example, aminopropionic acid and aminocaproic acid.

The compound (B6) in which amino groups of B1 to B5 are blocked, for example, a ketimine compound and an oxazolidine compound, which are obtained from the amines B1 to B5 and ketones (acetone, methyl ethyl ketone, methyl isobutyl ketone, etc.). Among these amines (B), B1 and a mixture of B1 and a small amount of B2 are particularly preferable.

With respect to a ratio of the amines (B), an equivalent ratio of an isocyanate group [NCO] in a polyester prepolymer having an isocyanate group (A) to an amino group [NHx] in amines (B), [NCO]/[NHx], is preferably from ½ to ²⁄₁, more preferably from ¹·⁵⁄₁ to ¹⁄₁.₅, and still more preferably from ¹·²⁄₁to ¹⁄₁.₂.

According to the method for preparation of a toner using the above polymerization method, it is possible to prepare a toner having a small particle size and a spherical shape can be prepared with less environmental burden at low cost.

Toner color is not specifically limited and can be appropriately selected according to the purposes and may be at least one selected from black toner, cyan toner, magenta toner and yellow toner. Each color can be obtained by appropriately selecting the coloring agent and a color toner is preferable.

The weight average particle size of the toner is not specifically limited and can be appropriately selected according to the purposes. The weight average particle size of the toner can be determined in the following manner.

[Weight Average Particle Size of Toner]

Measuring device: Coulter Multisizer II (manufactured by BECKMAN COULTER Co.)

Aperture diameter: 100 μm

Analyzing software: Coulter Multisizer Acucomp Version 1.19 (manufactured by BECKMAN COULTER Co.)

Electrolytic solution: Isotone II (manufactured by BECKMAN COULTER Co.)

Dispersion solution: 5 mass % electrolytic solution of EMULGEN 109P (manufactured by Kao Corporation, polyoxyethylene lauryl ether, HLB=13.6)

Dispersion conditions: Th 5 ml of a dispersion solution 1, 10 mg of a sample is added and dispersed for one minute using an ultrasonic disperser, followed by the addition of 25 ml of an electrolytic solution 25 ml and further dispersion for one minute using the ultrasonic disperser.

Measurement conditions: In a beaker, 100 ml of an electrolytic solution and a dispersion solution are added and 30,000 particles are measured at a density at which the particle sizes of 30,000 particles can be measured in 20 seconds, and then the weight average particle size is determined from the particle size distribution.

[Developer]

The developer comprises at least the toner and also comprises appropriately selected other components such as carrier. The developer may be a one-component developer or a two-component developer. When used for high-speed printer coping with improvement of recent information processing rate, the developer is preferably a two-component developer in view of increased lifetime.

In a case of a one-component developer using the toner, there is less variation in toner particle size even after toner have been reloaded many times for a long period, and neither toner filming to a developing roller nor fusion to a layer thickness controlling member (a blade for decreasing the thickness of the toner layer) occur. In addition, stable developability and excellent images can be obtained even after the developing unit has been used (agitation) for a long period of time. In a case of the two-component developer using the toner, even after long-time toner reloading, the developer causes less variation in toner particle size and also excellent stable developability can be obtained even when a developing unit is stirred for a long period of time.

-Carrier-

The carrier is not specifically limited and can be appropriately selected according to the purposes, and preferably comprises a resin layer and a core material coated with the resin layer.

The material of the core material is not specifically limited and can be appropriately selected from known materials and is preferably, for example, a manganese-strontium (Mn—Sr)-based material or manganese-magnesium (Mn—Mg)-based material of 50 emu/g to 90 emu/g. In view of securing image density, a highly magnetized material such as iron powder (100 emu/g or more) or magnetite (75 emu/g to 120 emu/g) is preferable. Also, a weakly magnetized material such as copper zinc (Cu—Zn)-based material (30 emu/g to 80 emu/g) is preferable because it is possible to decrease contact to a latent electrostatic image bearing member in which the toner is in a napping state, and it is advantageous to form a high quality image. These materials may be used alone or in combination.

The particle size of the core material is preferably from 10 μm to 200 μm, and more preferably from 40 μm to 100 μm, in terms of an average particle size (volume average particle size ($D_{50}$)). When the average particle size (volume average particle size ($D_{50}$)) is less than 10 μm, in the distribution of carrier particles, the amount of fine powders increases and magnetization per one particles decreases, and thus carrier scatter may occur. On the other hand, when the average particle size is more than 200 μm, the specific surface area decreased and scatter of the toner may occur. In case of full color including many solid portions, reproduction of the solid portion may deteriorate.

The material of the resin layer is not specifically limited and can be appropriately selected from known resins according to the purposes and includes, for example, amino-based resin, polyvinyl-based resin, polystyrene-based resin, halogenated olefin resin, polyester-based resin, polycarbonate-based resin, polyethylene resin, polyvinyl fluoride resin, polyvinylidene fluoride resin, polytrifluoroethylene resin, polyhexafluoropropylene resin, a copolymer of polyvinylidene fluoride and an acryl monomer, a copolymer of polyvinylidene fluoride and vinyl fluoride, a fluoroterpolymer (fluorinated three-layered (multi-layered) copolymer) such as terpolymer of tetrafluoroethylene, polyvinylidene fluoride and a non-fluorinated monomer, and a silicone resin. These materials may be used alone or in combination. Among these materials, a silicone resin is particularly preferable.

The silicone resin is not specifically limited and can be appropriately selected from conventionally known silicone resins according to the purposes and examples thereof include, for example, straight silicone resins having only organosoloxane bonds; and silicone resins modified with alkyl resins, polyester resins, epoxy resins, acrylic resins or urethane resins.

The silicone resin used is commercially available and the straight silicone resin includes, for example, KR271, KR255 and KR152 manufactured by Shin-Etsu Chemical Co., Ltd.; and SR2400, SR2406 and SR2410 manufactured by Dow Corning Toray Silicone Co., Ltd.

The modified silicone resin used is commercially available and includes, for example, KR206 (modified with alkyl), KR5208 (modified with acryl), ES1001N (modified with epoxy) and KR305 (modified with urethane) manufactured by Shin-Etsu Chemical Co., Ltd.; and SR2115 (modified with epoxy) and SR2110 (modified with alkyl) manufactured by Dow Corning Toray Silicon Co., Ltd.

The silicone resin can also be used alone, or can be used in combination with a crosslinkable component or a charge amount control component.

If necessary, the resin layer may contain a conductive powder and the conductive powder includes, for example, metal powder, carbon black, titanium oxide, tin oxide and zinc oxide. The average particle size of the conductive powder is preferably 1 μm or less. When the average particle size is more than 1 μm, it may become difficult to control the electrical resistance.

The resin layer can be formed, for example, by dissolving the silicone resin in a solvent to prepare a coating solution and uniformly coating the coating solution on the surface of the core material using a known coating method, followed by drying and further baking. The coating method includes, for example, a dipping method, a spraying method and a brush coating method.

The solvent is not specifically limited and can be appropriately selected according to the purposes and includes, for example, toluene, xylene, methyl ethyl ketone, methyl isobutyl ketone, cellosolve and butyl acetate.

The baking method is not specifically limited and may be a method using an external heating system or an internal heating system and includes, for example, a method using a fixed type electric furnace, a flow type electric furnace, a rotary electric furnace or a burner furnace, and a method using microwave.

The amount of the resin layer in the carrier is preferably from 0.01% by mass to 5.0% by mass. When the amount is less than 0.01% by mass, it may be impossible to from a uniform resin layer on the surface of the core material. On the other hand, when the amount is more than 5.0% by mass, since the resulting resin layer has too large thickness, granulation of carriers occur and uniform carrier particles may not be obtained.

When the developer is a two-component developer, the content of the carrier in the two-component developer is not specifically limited and can be appropriately selected according to the purposes, and is preferably, for example, from 90% by mass to 98% by mass, and more preferably from 93% by mass to 97% by mass.

With respect to a mixing ratio of the toner to the carrier in the two-component-based developer, the amount of the toner is preferably from 1 part by mass to 10.0 parts by mass per 100 parts by mass of the carrier.

The developing unit may be a unit using a dry developing system or a wet developing system. The developing unit may be a single-color developing unit or a multi-color developing unit and includes, for example, a developing unit comprising a stirrer capable of charging by frictional stirring of the toner or developer and a rotatable magnet roller.

In the developing unit, for example, the toner and the carrier are mixed with stirring and the toner is charged by friction upon mixing with stirring, thereby maintaining on the surface of the rotating magnet roller in a napping state to form a magnetic brush. Since the magnet roller is arranged in the vicinity of the latent electrostatic image bearing member, a portion of the toner, which constitutes the magnetic brush formed on the surface of the magnet roller, moves to the surface of the latent electrostatic image bearing member by an electric suction force. As a result, the latent electrostatic image is developed with the toner to form a visualized image made of the toner on the surface of the latent electrostatic image bearing member.

The developer to be contained in the developing unit is a developer containing the toner and the developer may be a one-component developer or a two-component developer.

[One-Component Developing Unit]

As the one-component developing unit, a one-component developing apparatus comprising a developer bearing member to which a toner is fed, and a layer thickness controlling member which forms a thin layer of the toner on the surface of the developer bearing member is preferably used.

Figure 5:
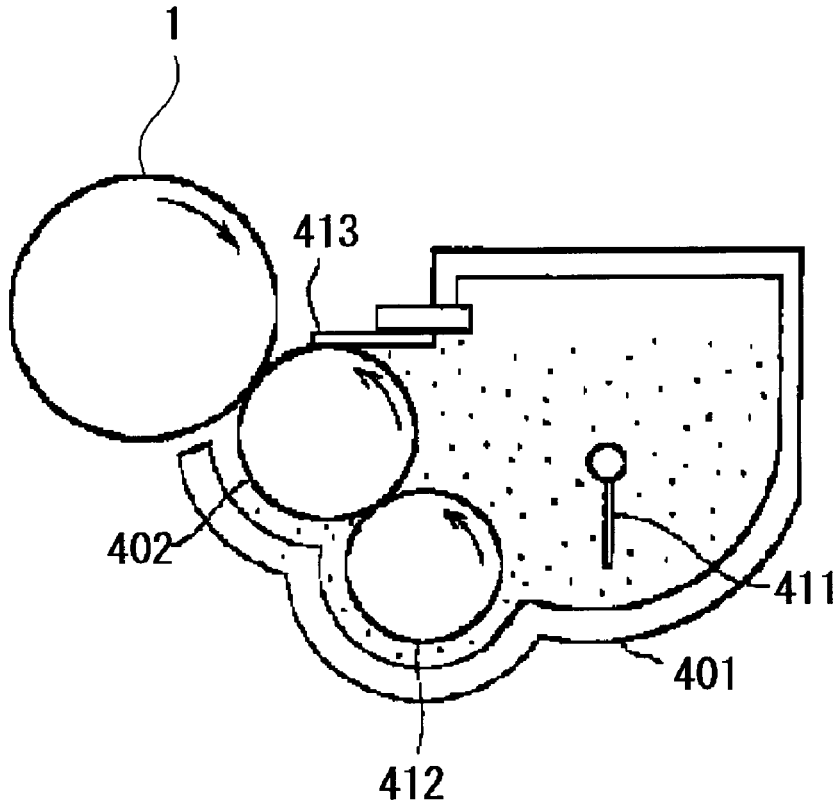
FIG. 5 is a schematic view showing an example of a one-component developing unit in the image forming apparatus of the present invention.

FIG. 5 is a schematic view showing an example of a one-component developing apparatus. According to this one-component developing apparatus, using a one-component developer composed of a toner, a toner layer is formed on a developing roller 402 as a developer bearing member and the toner layer on the developing roller 402 is transported while making contact with a photoconductor drum 1 as a latent electrostatic image bearing member, thereby performing contact one-component development in which the latent electrostatic image on the photoconductor drum 1 is developed.

In FIG. 5, the toner in a casing 401 is stirred by rotation of an agitator 411 as a stirring unit and is mechanically fed to a feeding roller 412 as a toner feeding member. The feeding roller 412 is formed of a polyurethane foam and has pliability, and also has a structure which easily retains a toner in a cell of a diameter of 50 μm to 500 μm. Also, JIS-A hardness of the feeding roller is comparatively as low as 10° to 30° and the feeding roller can also be uniformly brought into contact with the developing roller 402.

The feeding roller 412 is rotatably driven so as to transfer in the same direction as that of the developing roller 402 so that the surfaces are transported in the reverse direction at the opposing section of both rollers. Also, a linear velocity ratio (feeding roller/developing roller) is preferably from 0.5 to 1.5. Also, the feeding roller 412 may be rotated in the direction opposite the developing roller 402 so that the surfaces are transported in the reverse direction at the opposing section of both rollers. In the present embodiment, the feeding roller 412 was rotated in the same direction as that of the developing roller 402 and the linear velocity ratio was set to 0.9. The bite quantity of the guide member 8 of the feeding roller 412 to the developing roller 402 is set within a range from 0.5 mm to 1.5 mm. In the present embodiment, when a unit effective width is 240 mm (A4 vertical size), a required torque is from 14.7 N·cm to 24.5 N·cm.

The developing roller 402 comprises a conductive substrate and a surface layer made of a rubber material formed on the conductive substrate and has a diameter of 10 mm to 30 mm, and also surface roughness Rz is adjusted within a range from 1 μm to 4 μm by appropriately roughening the surface. The value of surface roughness Rz preferably accounts for 13% to 80% of the average particle size of the toner. Consequently, the toner is transported without being embedded in the surface of the developing roller 402. The surface roughness Rz of the developing roller 402 preferably accounts for 20% to 30% of the average particle size of the toner so as not to retain the low-charged toner.

The rubber material includes, for example, a silicone rubber, a butadiene rubber, a NBR rubber, a hydrin rubber and an EPDM rubber. The surface of the developing roller 402 is preferably coated with a coat layer so as to stabilize quality with time. The material of the coat layer includes, for example, a silicone-based material and a Teflon®-based material. The silicone-based material is excellent in toner chargeability and the Teflon®-based material is excellent in releasabiliy. To obtain conductivity, a conductive material such as carbon black may be contained. The thickness of the coat layer is preferably from 5 μm to 50 μm. When the thickness is not within the above range, defects such as cracking are likely to occur.

The toner having predetermined polarity (negative polarity in case of this embodiment) present on or in the feeding roller 412 is retained on a developing roller 402 by interposing between developing rollers 402 each rotating in an opposite direction at a contact point through rotation, or an electrostatic force applied after negative charge is obtained by frictional electrification effect, or the transportation effect through surface roughness of the developing roller 402. However, the toner layer on the developing roller 402 is not uniform and excessive toner adheres (1 mg/cm$^2$ to 3 mg/cm$^2$). Therefore, a toner thin layer having a uniform thickness is formed on the developing roller 402 by bringing the controlling blade 413 as the layer thickness controlling member into contact with the developing roller 402. The tip portion of the controlling blade 413 faces the downstream side to the rotating direction of the developing roller 402 and the center portion of the controlling blade 413 is brought into contact with the roller, that is, it is in a so-called press contact state. It is also possible to set in the reverse direction and to realize edge contact.

The material of the controlling blade is preferably metal such as SUS304, and the thickness is from 0.1 mm to 0.15 mm. In addition to the metal, a rubber material such as polyurethane rubber having a thickness of 1 mm to 2 mm and a resin material having comparatively high hardness such as silicone resin can be used. Since the resistance can be decreased by blending carbon black, in addition to the metal, an electric field can also be formed with the developing roller 402 by connecting a bias power supply.

With respect to a controlling blade 413 as the layer thickness controlling member, a free end length from a holder is preferably from 10 mm to 15 mm. When the free end length is more than 15 mm, a developing unit becomes larger and it becomes impossible to compactly accommodate in the image forming apparatus. On the other hand, when the free end length is less than 10 mm, oscillation is likely to occur when a controlling blade is brought into contact with the surface of the developing roller 402 and thus an abnormal image such as stepwise unevenness in the lateral direction on the image.

The contact pressure of the controlling blade 413 is preferably within a range from 0.049 N/cm to 2.45 N/cm. When the contact pressure is more than 2.45 N/cm, the amount of the toner adhered on the developing roller 402 decreases and the toner charge amount excessively increases, and thus the developing amount may decrease and the image density may decrease. When the contact pressure is less than 0.049 N/cm, a thin layer is not uniformly formed and a mass of the toner may pass through the controlling blade, and thus image quality may drastically deteriorate. In this embodiment, a developing roller 402 having JIS-A hardness of 30° was used and a 0.1 mm thick SUS plate was used as the controlling blade 413, and the contact pressure was set to 60 gf/cm. At this time, the objective amount of the toner adhered on the developing roller could be obtained.

The contact angle of the controlling blade 413 as the layer thickness controlling member is preferably from 10° to 45° to a tangent line of the developing roller 402 in the direction in which the tip portion faces toward the downstream side of the developing roller 402. The toner, which is not required for formation of a toner thin layer sandwiched between the controlling blade 413 and the developing roller 402, is removed from the developing roller 402 to form a thin layer having a uniform thickness within the objective range from 0.4 mg/cm$^2$ to 0.8 mg/cm$^2$ per unit area. At this time, in this example, the toner charge is finally within a range from −10 μC/g to −30 μC/g and development is performed in the state of facing the latent electrostatic image on the photoconductor drum 1.

Therefore, according to the one-component developing apparatus of this embodiment, the distance between the surface of the photoconductor drum 1 and that of the developing roller 402 further decreases as compared with the case of a conventional two-component developing unit and developability is enhanced, and thus it becomes possible to develop at a lower potential.

[Two-Component Developing Unit]

The two-component developing unit is preferably a two-component development apparatus which comprises an internally fixed magnetic field generating unit and also comprises a rotatable developer bearing member capable of bearing on its surface a two-component developer composed of a magnetic carrier and a toner.

Figure 6:
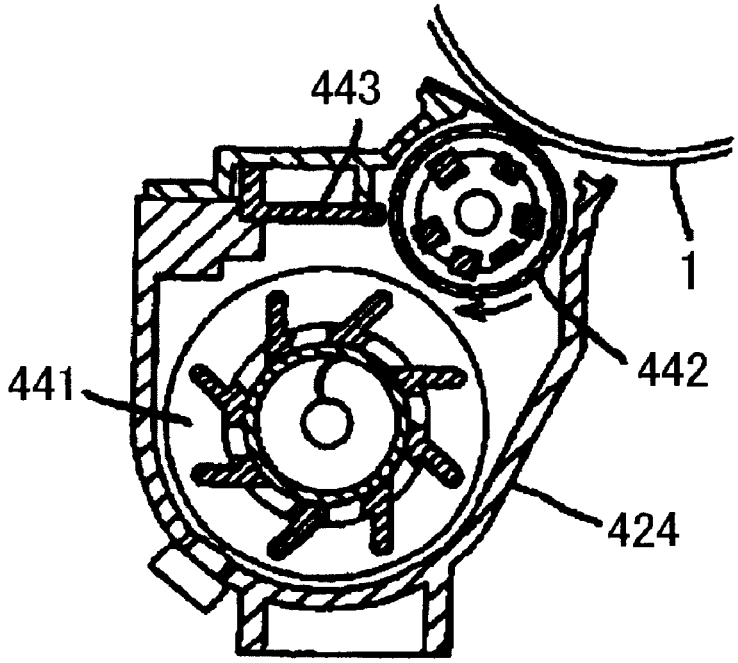
FIG. 6 is a schematic view showing an example of a two-component developing unit in the image forming apparatus of the present invention.

Herein, FIG. 6 shows an example of a two-component development apparatus using a two-component developer comprising a toner and a magnetic carrier. In the two-component development apparatus shown in FIG. 6, a two-component developer is stirred and transported by a screw 441 and then fed to a developing sleeve 442 as a developer bearing member. The two-component developer to be fed to the developing sleeve 442 is controlled by a doctor blade 443 as a layer thickness controlling member and the amount of the developer to be fed is controlled by a doctor gap as a gap between the doctor blade 443 and the developing sleeve 442. When the doctor gap is too small, the image density is insufficient because of too small amount of the developer. On the other hand, when the doctor gap is too large, the developer is excessively fed and thus there arises a problem that the carrier is deposited on a photoconductor drum 1 as the latent electrostatic image bearing member. Thus, in the developing sleeve 442, a magnet as a magnetic field generating unit, which forms a magnetic field, is provided so as to cause a napping state of the developer on the peripheral surface. The developer is deposited on the developing sleeve 442 in a chain-shaped napping state so as to along with a magnetic line in a normal line direction of a magnetic force produced from the magnet to form a magnetic brush.

The developing sleeve 442 and the photoconductor drum 1 are proximately arranged at a fixed interval (development gap) and the developed area is formed at the opposite portion of both of them. The developing sleeve 442 is formed in a cylindrical form made of a non-magnetic material such as aluminum, brass, stainless steel or a conductive resin and is rotated by a rotation driving mechanism (not shown). The magnetic brush is transferred to the developed area by rotation of the developing sleeve 442. To the developing sleeve 442, a developing voltage is applied from a power supply for development (not shown) and the toner on the magnetic brush is separated from the carrier by a developing electric field formed between the developing sleeve 442 and the photoconductor drum 1 and is developed on the latent electrostatic image on the photoconductor drum 1. To the developing voltage, an alternating current may be superposed.

The development gap is preferably about 5 times to about 30 times more than the particle size of the developer. When the particle size of the developer is 50 μm. the development gap is preferably set within a range from 0.5 mm to 1.5 mm. When the development gap is more than the above range, it may become difficult to attain a desired image density.

Also, the doctor gap is preferably the same as or more than the development gap. The drum size and the drum linear velocity of the photoconductor drum 1 as well as the sleeve diameter and the sleeve linear velocity of the developing sleeve 442 are decided by limitation of the copying velocity and the size of the apparatus. A ratio of the sleeve linear velocity to the drum linear velocity is preferably adjusted to 1.1 or more so as to obtain a required image density. It is also possible that a sensor is arranged at the position after the development and the amount of the toner deposited is detected from an optical reflectance, thus controlling the process conditions.

<Transferring Step and Transferring Unit>

The transferring step is a step of transferring the visualized image onto a recording medium and is performed using a transferring unit. The transferring unit is roughly classified into a transferring unit which directly transfers a visualized image on a latent electrostatic image bearing member onto a recording medium, and a secondary transferring unit which primarily transfers a visualized image onto the intermediate transfer member and then secondarily transfers the visualized image on the recording medium.

The visualized image can be transferred by charging the latent electrostatic image bearing member using a transfer charger, and transfer can be performed by the transferring unit. In a preferable aspect, the transferring unit comprises a primary transferring unit which transfers a visualized image onto an intermediate transfer member to form a composite transferred image, and a secondary transferring unit which transfers the composite transferred image onto a recording medium.

-Intermediate Transfer Member-

The intermediate transfer member is not specifically limited and can be appropriately selected from known transfer units according to the purposes and preferably includes, for example, a transfer belt and a transfer roller.

The static friction coefficient of the intermediate transfer member is preferably from 0.1 to 0.6, and more preferably from 0.3 to 0.5. The volume resistivity of the intermediate transfer member is preferably within a range of several Ω×cm to $10^3$ Ω×cm. When the volume resistivity of the intermediate transfer member is adjusted within a range of several Ω×cm and $10^3$ Ω×cm, since charge of the intermediate transfer member itself is prevented and also charge applied by the charge applying unit is less likely to be left on the intermediate transfer member, transfer unevenness upon secondarily transfer can be prevented. Also, it is possible to easily apply a transfer bias upon secondary transfer.

The material of the intermediate transfer member is not specifically limited and can be appropriately selected from known materials according to the purposes and is preferably the following.

(1) A material having high Young's modulus (tensile elastic modulus) is used as the material of a single-layered belt and the material includes, for example PC (polycarbonate), PVDF (polyvinylidene fluoride), PAT (polyalkylene terephthalate), a blend material of PC (polycarbonate) and PAT (polyalkylene terephthalate), a blend material of ETFE (ethylene tetrafluoroethylene copolymer) and PC, a blend material of ETFE and PAT, a blend material of PC and PAT, and carbon black dispersed thermocurable polyimide. The single-layered belt having high Young's modulus has such an advantage that it causes less deformation against stress upon formation of the image and is less likely to cause rib shift upon formation of the image.

(2) It is a belt with two- or three-layer configuration, comprising the belt (1) having high Young's modulus as a base layer and a surface layer or a intermediate layer formed on the outer periphery, and such a belt with two- or three-layer configuration has performance capable of preventing voids of a line image caused by the hardness of the ingle-layered belt.

(3) It is an elastic belt having comparatively low Young's modulus using a resin, a rubber or an elastomer, and such an elastic belt has an advantage that it scarcely causes voids of the line image because of softness thereof. Also, since meandering can be prevented by increasing the width of the elastic belt to those of a driving roller and a laying roll and utilizing elasticity of the belt edge protruding from the roller, low cost can be realized without requiring a rib and a meandering preventing device. Among these elastic belts, the elastic belt (3) is particularly preferable.

The elastic belt deforms in conformity with a toner layer and a recording medium with poor smoothness at the transfer portion. That is, since the elastic belt deforms in conformity with local irregularity, good adhesion is obtained without excessively increase a transfer pressure to the toner layer and voids of characters do not occur, and also a transfer image having excellent uniformity can be obtained even in case of using a recording medium having poor flatness.

The resin used in the elastic belt is not specifically limited and can be appropriately selected according to the purposes and includes, for example, polycarbonate resin, fluorine-based resin (ETFE, PVDF), styrene-based resin (homopolymer or copolymer containing styrene or substituted styrene) such as polystyrene resin, chloropolystyrene resin, poly-α-methylstyrene resin, styrene-butadiene copolymer, styrene-vinyl chloride copolymer, styrene-vinyl acetate copolymer, styrene-maleic acid copolymer, styrene-acrylate ester copolymer (for example, styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylate ester copolymer (for example, styrene-methyl methacrylate copolymer, styrene-ethyl methacrylate copolymer, styrene-phenyl methacrylate copolymer, etc.), styrene-α-chloromethyl acrylate copolymer, or styrene-acrylonitrile-acrylate ester copolymer, methyl methacrylate resin, butyl methacrylate resin, ethyl acrylate resin, butyl acrylate resin, modified acrylic resin (for example, silicone modified acrylic resin, vinyl chloride resin modified acrylic resin, acryl-urethane resin, etc.), vinyl chloride resin, styrene-vinyl acetate copolymer, vinyl chloride-vinyl acetate copolymer, rosin modified maleic acid resin, phenol resin, epoxy resin, polyester resin, polyesterpolyurethane resin, polyethylene resin, polypropylene resin, polybutadiene, polyvinylidene chloride resin, ionomer resin, polyurethane resin, silicone resin, ketone resin, ethylene-ethyl acrylate copolymer, xylene resin, polyvinyl butyral resin, polyamide resin and modified polyphenylene oxide resin. These resins may be used alone or in combination.

The rubber used in the elastic belt is not specifically limited and can be appropriately selected according to the purposes and includes, for example, natural rubber, butyl rubber, fluorine-based rubber, acryl rubber, EPDM rubber, NBR rubber, acrylonitrile-butadiene-styrene rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber and hydrogenated nitrile rubber. These rubbers may be used alone or in combination.

The elastomer used in the elastic belt is not specifically limited and can be appropriately selected according to the purposes and includes, for example, polystyrene-based thermoplastic elastomer, polyolefin-based thermoplastic elastomer, polyvinyl chloride-based thermoplastic elastomer, polyurethane-based thermoplastic elastomer, polyamide-based thermoplastic elastomer, polyurea thermoplastic elastomer, polyester-based thermoplastic elastomer and fluorine-based thermoplastic elastomer. These elastomers may be used alone or in combination.

The conductive agent for controlling a resistance value used in the elastic belt is not specifically limited and can be appropriately selected according to the purposes and includes, for example, carbon black, graphite, powders of metal such as aluminum or nickel; and conductive metal oxides such as tin oxide, titanium oxide, antimony oxide, indium oxide, potassium titanate, antimony oxide-tin oxide complex oxide (ATO) and indium oxide-tin oxide complex oxide (ITO). The conductive metal oxide may be coated with insulating fine particles of barium sulfate, magnesium silicate or calcium carbonate.

Also, the surface layer of the elastic belt is preferably a surface layer which can prevent contamination of a latent electrostatic image bearing member with an elastic material and reduce frictional resistance of the surface of the belt, thereby decreasing adhesion of the toner and enhancing cleaning properties and secondary transferability. The surface layer preferably contains a binder resin such as polyurethane resin, polyester resin or epoxy resin; and a material capable of enhancing lubricating ability by decreasing surface energy, for example, powders or particles of fluororesin, fluorine compound, fluorinated carbon, titanium dioxide or silicone carbide. It is also possible to use a fluorine-based rubber material in which a fluorine rich surface layer is formed by subjecting to a heat treatment, thereby decreasing surface energy.

The method for producing the elastic belt is not specifically limited and can be appropriately selected according to the purposes and includes, for example, (1) a centrifugal molding method comprising casting a material in a rotating cylindrical mold to form a belt, (2) a spray coating method comprising spraying a liquid coating material to form a film, (3) a dipping method comprising dipping a cylindrical mold in a solution of a material and pulling up the mold, (4) a casting method comprising casting in an inner mold or an outer mold, and (5) a method comprising winding a compound around a cylindrical mold, followed by vulcanization and further grinding.

Also, the method for prevention of elongation of the elastic belt is not specifically limited and can be appropriately selected according to the purposes and includes, for example, (1) a method comprising adding a material capable of preventing elongation in a core layer and (2) a method comprising forming a rubber layer on a core layer which causes less elongation.

The material which prevents elongation is not specifically limited and can be appropriately selected according to the purposes and includes, for example, natural fibers such as cotton and silk fibers; synthetic fibers such as polyester fiber, nylon fiber, acryl fiber, polyolefin fiber, polyvinyl alcohol fiber, polyvinyl chloride fiber, polyvinylidene chloride fiber, polyurethane fiber, polyacetal fiber, polyfluoroethylene fiber and phenol fiber; inorganic fibers such as carbon fiber, glass fiber and boron fiber; and metal fibers such as iron fiber and copper fiber. These materials are used after being formed into a woven fabric or yarn.

The method for formation of a core layer is not specifically limited and can be appropriately selected according to the purposes and includes, for example, (1) a method comprising covering a metal mold with a cylindrically-shaped woven fabric over and forming a coating layer thereon, (2) a method comprising dipping a cylindrically-shaped woven fabric in a liquid rubber to form a coating layer on one or both surfaces of a core layer, and (3) a method comprising spirally winding a yarn around a metal mold at optional pitches and forming a coating layer thereon.

The thickness of the coating layer varies depending on hardness of the coating layer. When the thickness is too large, cracking is likely to occur on the surface because of large expansion and contraction of the surface, Too large thickness (about 1 mm or more) is not preferable because expansion and contraction increase and thus elongation and contraction of the image increase.

The transferring unit (primary transferring unit, secondary transferring unit) preferably comprises at least a transferring device which causes separating charging of the visualized image formed on the latent electrostatic image bearing member to the recording medium side. One or two transferring devices may be arranged. Examples of the transferring device include corona transferring device utilizing corona discharge, transferring belt, transfer roller, pressure transfer roller and adhesive transferring device.

The recording medium is typically a plain paper and is not specifically limited and can be appropriately selected according to the purposes as long as it can transfer the unfixed image after development, and a PET base for OHP can also be used.

-Transferring Unit of Tandem Type Image Forming Apparatus-

The tandem type image forming apparatus is an apparatus in which a plurality of image forming elements each including at least a latent electrostatic image bearing member, a charging unit, a developing unit and a transferring unit, are arranged. This tandem type image forming apparatus is equipped with four image forming elements for yellow, magenta, cyan and black colors, so that a visualized image is formed in the four image forming elements in parallel and superposed on a recording medium or an intermediate transfer member, and therefore a full color image can be formed at high speed.

Figure 7:
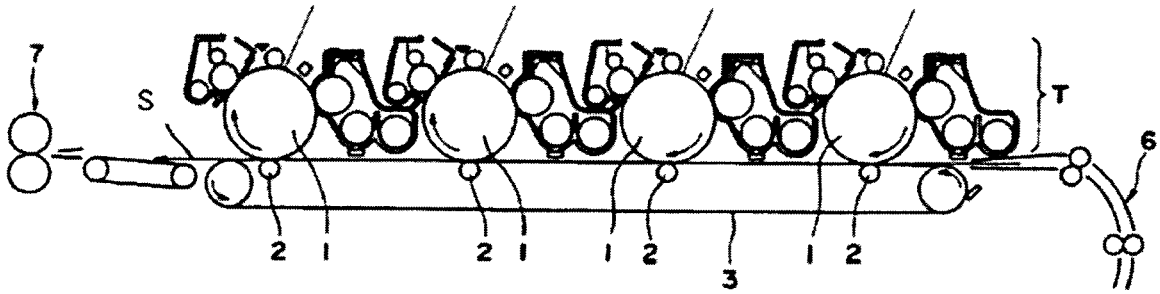
FIG. 7 is a schematic view showing an example of a direct transferring system in the tandem type image forming apparatus of the present invention.
Figure 8:
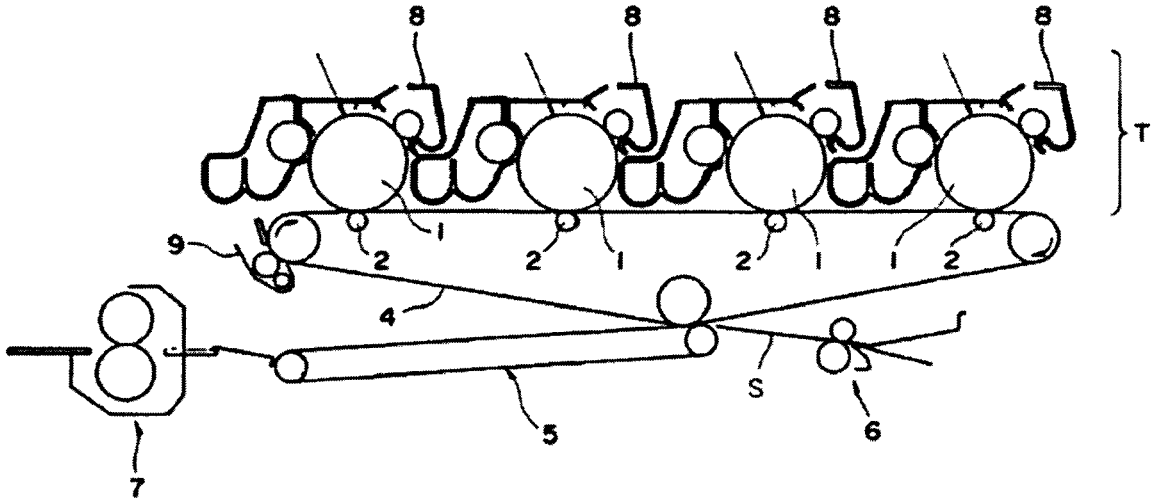
FIG. 8 is a schematic view showing an example of an indirect transferring system in the tandem type image forming apparatus of the present invention.

The tandem type image forming apparatus is classified into (1) a direct transferring system wherein the visualized image formed on each of the latent electrostatic image bearing member 1 is sequentially transferred by a transferring unit 2 onto a recording medium S of which surface passes a transfer position that opposes the latent electrostatic image bearing member 1 of each of the plural image forming elements as shown in FIG. 7; and (2) an indirect transferring system wherein the visualized image on the latent electrostatic image bearing member 1 of each of the plural image forming elements is sequentially transferred by the transferring unit (primary transferring unit) 2 once onto an intermediate transfer member 4, then the image on the intermediate transfer member 4 is transferred by a secondary transferring unit 5 onto the recording medium S all at once as shown in FIG. 8. While a transfer belt is used as the secondary transferring unit in the constitution shown in FIG. 8, a roller may also be used.

When the direct transferring system of (1) and the indirect transferring system of (2) are compared, the direct transferring system of (1) makes it necessary to dispose a paper feeder 6 at a position upstream side of the tandem type image forming section T comprising an arrangement of the latent electrostatic image bearing members 1, and dispose a fixing device 7 as a fixing unit at the downstream side, which makes the apparatus larger in size in the direction of transporting the recording medium. The indirect transferring system of (2), in contrast, has such an advantage that secondary transfer position may be determined relatively freely, and that the paper feeder 6 and the fixing device 7 can be arranged over the tandem type image forming section T, so as to make the apparatus smaller in size.

Also in the case of the direct transferring system of (1), the fixing device 7 is arranged closer to the tandem type image forming section T in order to avoid making the apparatus larger in size in the direction of transporting the recording medium. This makes it impossible to dispose the fixing device 7 with a sufficient margin to allow the recording medium S to flex. As a result, the fixing device 7 is likely to affect the imaging forming step carried out in the upstream, due to the impact of the tip of the recording medium S entering the fixing device 7 (the impact is particularly significant when the recording medium is thicker), and/or the difference between the transportation speed of the recording medium passing the fixing device 7 and the transportation speed of the recording medium being carried by the transfer belt. The indirect transferring system of (2), in contrast, allows it to dispose the fixing device 7 with a sufficient margin to allow the recording medium S to flex, and therefore the fixing device 7 hardly affects the imaging forming step.

For the reason described above, the indirect transferring system is viewed as more promising in recent years. In such a color image forming apparatus, residual toner left on the latent electrostatic image bearing member 1 after the primary transfer is removed by cleaning the surface of the latent electrostatic image bearing member 1 by a cleaning device 8, so as to prepare for the next image forming operation. Also the residual toner left on the intermediate transfer member 4 after the secondary transfer is removed by cleaning the surface of the intermediate transfer member 4 by an intermediate transfer member cleaning device 9, so as to prepare for the next image forming operation.

<Fixing Step and Fixing Unit>

The fixing step is a step in which the visualized image transferred onto the recording medium is fixed by a fixing unit.

While the fixing unit is not specifically limited and can be appropriately selected according to the purposes, a fixing device having a fixing member and a heat source for heating the fixing member is preferably used.

The fixing member is not specifically limited and can be appropriately selected according to the purposes as long as it is capable of making contact and forming a nipping section, and may be a combination of an endless belt and a roller or a combination of rollers. In order to reduce the duration of warm-up period and decrease the energy consumption, it is preferable to employ the combination of an endless belt and a roller, or a method of heating the surface of the fixing member by induction heating.

The fixing member includes, for example, a heating and pressurizing unit (a combination of a heating unit and a pressurization unit) known in the prior art may be used. The heating and pressurizing unit, in case the combination of the endless belt and the roller is employed, may be a combination of a heating roller, a pressurizing roller and an endless belt. In case the combination of the rollers is employed, a combination of a heating roller and a pressurizing roller may be used.

When an endless belt is used as the fixing member, the endless belt is preferably formed from a material having a low heat capacity, in such a constitution as an anti-offset layer is provided on a base material. The base material may be formed from, for example, nickel or polyimide, and the anti-offset layer may be formed from, for example, silicone rubber or fluorine-based resin.

When a roller is used as the fixing member, a core metal of the roller is preferably formed from a non-elastic material in order to prevent it from deforming under a high pressure. The non-elastic material is not specifically limited and can be appropriately selected according to the purposes and preferably includes, for example, a material having high heat conductivity such as aluminum, iron, stainless steel or brass. The roller is preferably coated with the anti-offset layer on the surface thereof. The material used to form the anti-offset layer is not specifically limited and can be appropriately selected according to the purposes and preferably includes, for example, RTV silicone rubber, tetrafluoroethylene-perfluoroalkyl vinyl ether (PFA) or polytetrafluoroethylene (PTFE).

In the fixing step, an image may be fixed on the recording medium by transferring the image formed from the toner onto the recording medium and passing the recording medium having the image transferred thereon through the nipping section or, alternatively, transferring and fixing of the image onto the recording medium may be performed simultaneously in the nipping section.

The fixing step may be carried out every time the image of different color is transferred onto the recording medium, or may be carried out only once after superposing the images of different colors.

The nipping section is constituted from at least two fixing members arranged in contact with each other.

The surface pressure of the nipping section is not specifically limited and can be appropriately selected according to the purposes, and the surface pressure is preferably 5 $N/cm^2$ or more, more preferably from 7 $N/cm^2$ to 100 $N/cm^2$, and still more preferably from 10 $N/cm^2$ to 60 $N/cm^2$. When the surface pressure of the nipping section is too high, the roller may have lower durability. When the surface pressure of the nipping section is lower than 5 $N/cm^2$, sufficient fixing effect may not be achieved.

The temperature at which an image formed from the toner is fixed onto the recording medium (namely the surface temperature of the fixing member heated by the heating unit) is not specifically limited and can be appropriately selected according to the purposes, and the temperature is preferably from 120° C. to 170° C., and more preferably from 120° C. to 160° C. When the fixing temperature is lower than 120° C., sufficient fixing effect may not be achieved and, while fixing temperature higher than 170° C. is not desirable in view of energy saving.

The fixing unit is roughly classified into (1) those adopting internal heating mode in which the fixing unit has at least either a roller or a belt, while a surface thereof which does not make contact with the toner is heated and the image transferred onto the recording medium is heated and pressurized to as to be fixed; and (2) those adopting external heating mode in which the fixing unit has at least either a roller or a belt, while a surface thereof which makes contact with the toner is heated and the image transferred onto the recording medium is heated and pressurized so as to be fixed. Note that fixing units in which the internal heating mode and external heating mode is combined may be employed.

A fixing unit adopting internal heating mode may be exemplified by one wherein the fixing member has a heating unit incorporated therein. Such a heating unit may be a heat source such as electric heater or halogen lamp.

A fixing unit adopting external heating mode (2) is preferably one wherein at least a part of the surface of at least one of the fixing members is heated by the heating unit. The heating is not specifically limited and can be appropriately selected according to the purposes and includes, for example, an electromagnetic induction heating unit.

The electromagnetic induction heating unit is not specifically limited and can be appropriately selected according to the purposes and preferably includes, for example, one that has a unit configured to generate a magnetic field and a unit configured to generate heat by electromagnetic induction.

The electromagnetic induction heating unit preferably has such a constitution that comprises an induction coil arranged in the vicinity of the fixing member (for example, a heating roller), a shield layer whereon the induction coil is provided, and an insulation layer arranged on the side opposite to the surface of the shield layer whereon the induction coil is provided. In this case, the heating roller is preferably constituted from a magnetic material or a heat pipe.

The induction coil is preferably arranged so as to enclose at least a semicylindrical portion on the side of the heating roller opposite to the surface thereof whereon the heating roller and the fixing member (such as pressurizing roller, endless belt, etc.) make contact with each other.

-Fixing Unit Adopting Internal Heating Mode-

Figure 9:
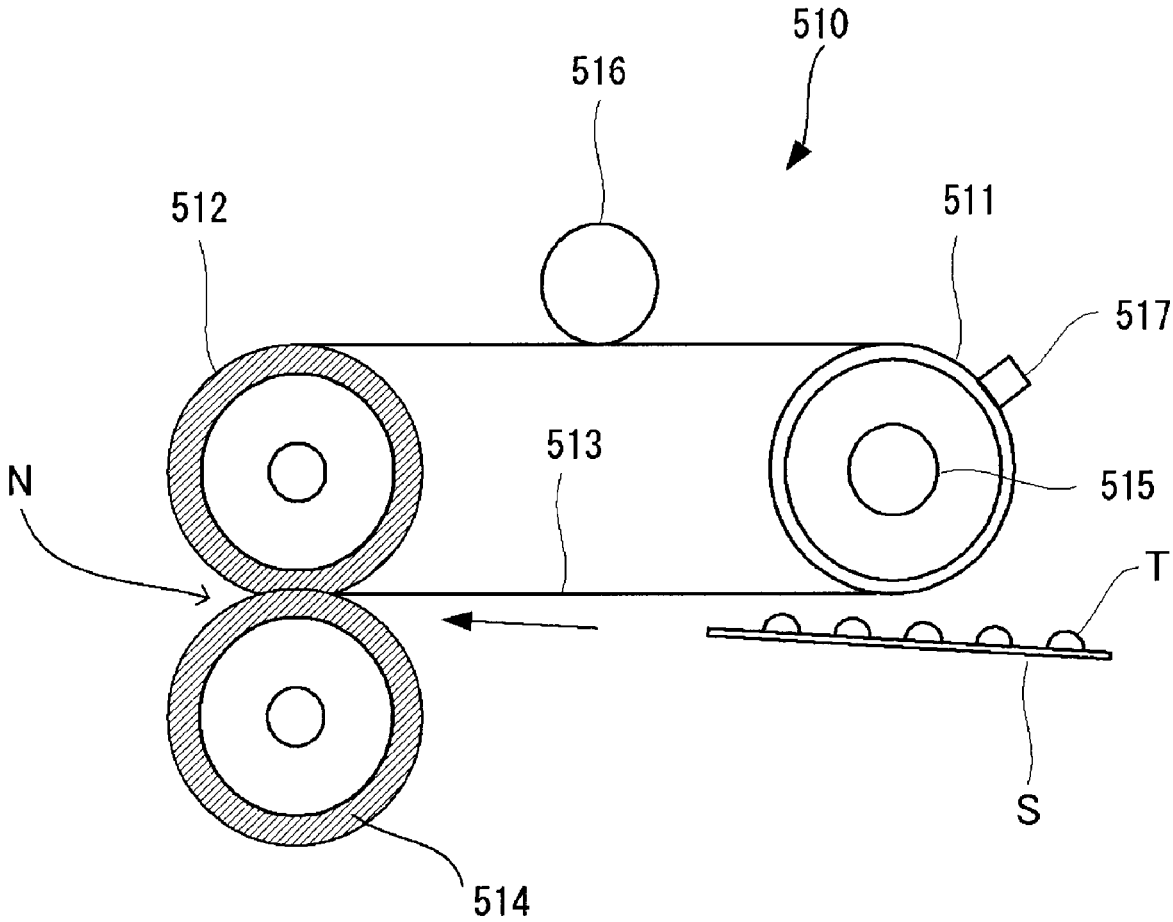
FIG. 9 is a schematic view showing an example of a fixing unit of a belt system in the image forming apparatus of the present invention.

FIG. 9 shows a belt type fixing device as an example of the fixing unit adopting internal heating mode. The belt type fixing device 510 shown in FIG. 9 comprises a heating roller 511, a fixing roller 512, a fixing belt 513 and a pressurizing roller 514.

The fixing belt 513 is stretched across the heating roller 511 and the fixing roller 512 which are arranged rotatably, and is heated to a predetermined temperature by the heating roller 511. The heating roller 511 incorporates a heat source 515 provided therein, and is designed so that the temperature thereof can be controlled by a temperature sensor 517 mounted in the vicinity of the heating roller 511. The fixing roller 512 is arranged inside of the fixing belt 513 so as to be rotatable while making contact with the inner surface of the fixing belt 513. The pressurizing roller 514 is arranged rotatably outside of the fixing belt 513 while making contact with the outer surface of the fixing belt 513 so as to press the fixing roller 512. Surface hardness of the fixing belt 513 is lower than the surface hardness of the pressurizing roller 514. In the nipping section N which is formed between the fixing roller 512 and the pressurizing roller 514, an intermediate region located between the introducing end of the recording medium S and the discharging end is positioned on the side of the fixing roller 512 than on the side of the introducing end and the discharging end.

In the belt type fixing device 510 shown in FIG. 9, first, the recording medium S whereon the toner image T to be fixed is formed is transported to the heating roller 511. Then the toner image T formed on the recording medium S is heated to melt by the heating roller 511 and the fixing belt 513 which are heated to a predetermined temperature by the built-in heat source 515. Under this condition, the recording medium S is inserted into the nipping section N formed between the fixing roller 512 and the pressurizing roller 514. The recording medium S inserted into the nipping section N is brought into contact with the surface of the fixing belt 513 which runs in synchronization with the rotation of the fixing roller 512 and the pressurizing roller 514, and is pressed while passing the nipping section N, so that the toner image T is fixed on the recording medium S.

Then the recording medium S whereon the toner image T is fixed passes between the fixing roller 512 and the pressurizing roller 514, to be separated from the fixing belt 513 and is transported to a tray (not shown). At this time, the recording medium S is discharged toward the pressurizing roller 514 and the recording medium S is prevented from being entangled with the fixing belt 513. The fixing belt 513 is cleaned by a cleaning roller 516.

Figure 10:
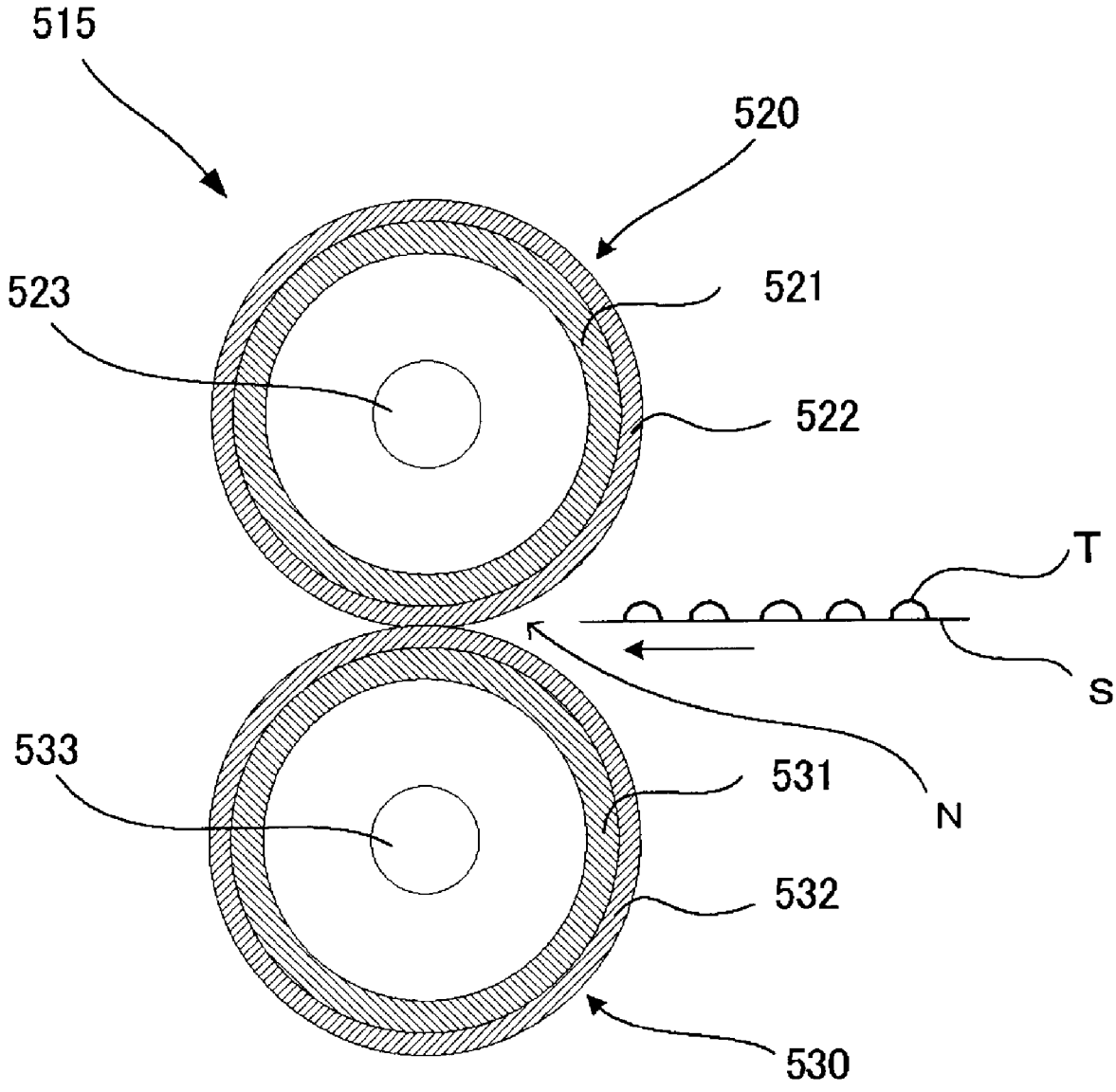
FIG. 10 is a schematic view showing an example of a fixing unit of a heating roller system in the image forming apparatus of the present invention.

A heating roll type fixing device 515 shown in FIG. 10 has a heating roller 520 serving as the fixing member and a pressurizing roller 530 arranged in contact therewith.

The heating roller 520 has a hollow metal cylinder 521 of which surface is covered by an anti-offset layer 522, with a heating lamp 523 incorporated therein. The pressurizing roller 530 has a metal cylinder 531 of which surface is covered by an anti-offset layer 532. The pressurizing roller 530 may also have the metal cylinder 531 of hollow shape, with a heating lamp 533 arranged inside thereof.

The heating roller 520 and the pressurizing roller 530 are urged by a spring (not shown) into contact with each other while being capable of rotating and forming the nipping section N. Surface hardness of the anti-offset layer 522 of the heating roller 520 is lower than the surface hardness of the anti-offset layer 532 of the pressurizing roller 530. In the nipping section N formed between the heating roller 520 and the pressurizing roller 530, an intermediate region located between the introducing end of the recording medium S and the discharging end is positioned on the side of the heating roller 520 than on the side of the introducing end and the discharging end.

In the heating roll type fixing device 515 shown in FIG. 10, first, the recording medium S whereon the toner image T to be fixed is formed is transported to the nipping section N formed between the heating roller 520 and the pressurizing roller 530. Then the toner T on the recording medium S is heated to melt by the heating roller 520 which is heated to a predetermined temperature by the built-in heating lamp 523 and, while passing the nipping section N, pressure is applied by the pressurizing roller 530, so that the toner image T is fixed on the recording medium S.

Then the recording medium S whereon the toner image T is fixed passes between the heating roller 520 and the pressurizing roller 530 and is transported to the tray (not shown). At this time, the recording medium S is discharged toward the pressurizing roller 530 and the recording medium S is prevented from being caught by the pressurizing roller 530. The heating roller 520 is cleaned by a cleaning roller (not shown).

-Fixing Unit Adopting External Heating Mode-

Figure 11:
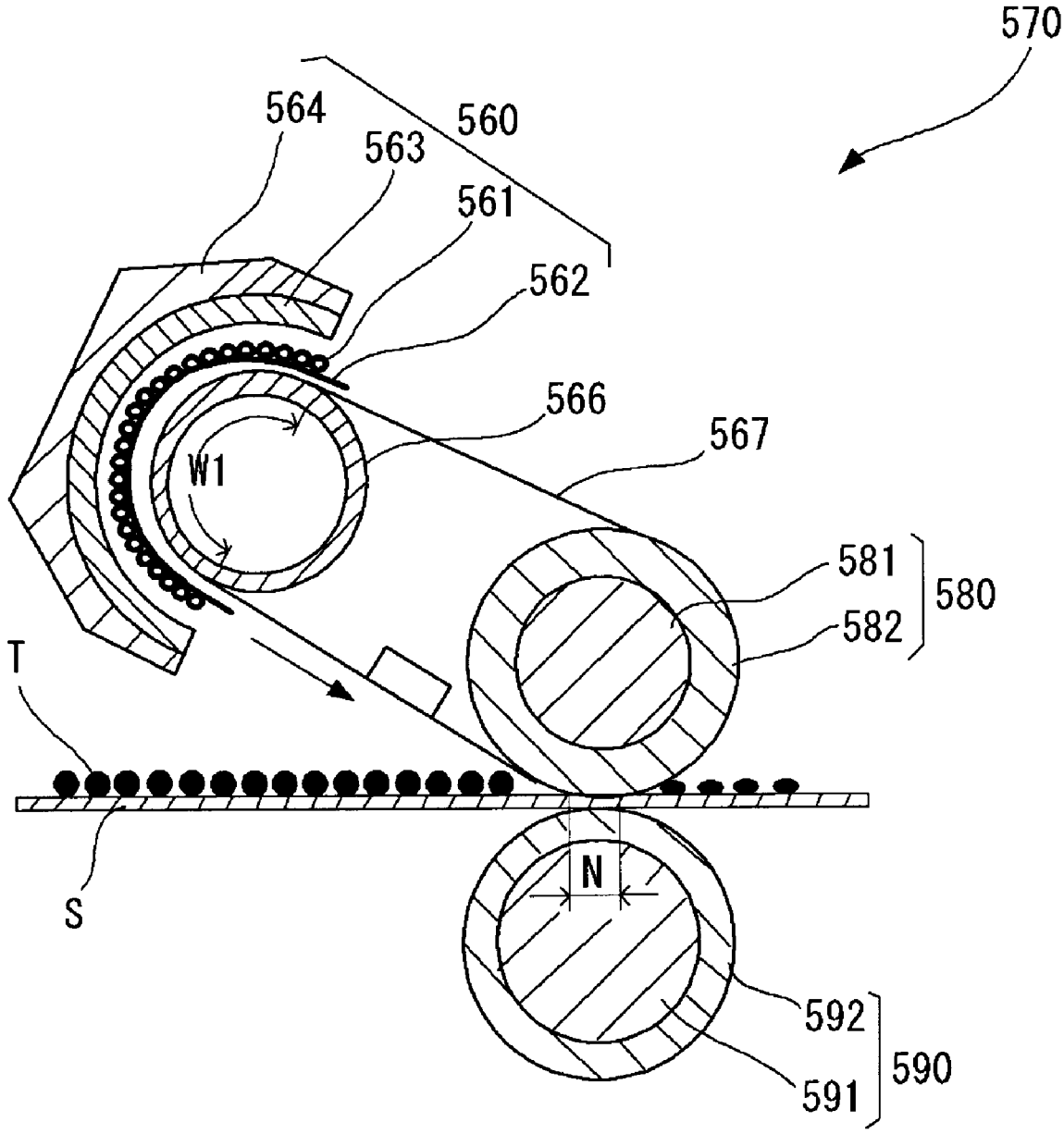
FIG. 11 is a schematic view showing an example of a fixing unit of an electromagnetic induction heating system in the image forming apparatus of the present invention.

FIG. 11 shows an electromagnetic induction heating type fixing device 570 as an example of the fixing unit adopting external heating mode. The electromagnetic induction heating type fixing device 570 comprises a heating roller 566, a fixing roller 580, a fixing belt 567, a pressurizing roller 590 and an electromagnetic induction heating unit 560.

The fixing belt 567 is stretched across the heating roller 566 and the fixing roller 580 which are arranged rotatably, and is heated to a predetermined temperature by the heating roller 566.

The heating roller 566 has a hollow cylindrical member made of a magnetic metal such as iron, cobalt, nickel or an alloy thereof, which is 20 mm to 40 mm in outer diameter and 0.3 mm to 1.0 mm in wall thickness and has a low heat capacity to allow quick heat-up.

The fixing roller 580 has a core metal 581 made of stainless steel or other metal, of which surface is covered by an elastic layer 582 formed from silicone rubber which has heat insulating property and is in solid or foamed condition. The fixing roller 580 is arranged on the inside of the fixing belt 567 rotatably while making contact with the inner surface of the fixing belt 567. The fixing roller 580 has an outer diameter of about 20 mm to 40 mm, larger than that of the heating roller 566, in order to form the nipping section N having a predetermined width between the pressurizing roller 590 and the fixing roller 580 under the pressure of the pressurizing roller 590. The elastic layer 582 is formed to have a thickness of about 4 mm to 6 mm, and the heating roller 566 has a heat capacity smaller than that of the fixing roller 580, so as to reduce the time required to warm up the heating roller 566.

The pressurizing roller 590 has a core metal 591 consisting of a cylindrical member made of a metal having high electrical conductivity such as copper or aluminum, of which surface is covered by an elastic layer 592 having high heat resistance and high toner releasing property. The pressurizing roller 590 is arranged on the outside of the fixing belt 567 rotatably while making contact with the outer surface of the fixing belt 567 so as to apply a pressure to the fixing roller 580. The core metal 591 may also be formed from SUS, instead of the metals described above.

The electromagnetic induction heating unit 560 is arranged in the vicinity of the heating roller 566 along the axial direction of the heating roller 566. The electromagnetic induction heating unit 560 comprises an excitation coil 561 which is a unit configured to generate magnetic field, and a coil guide plate 562 around which the excitation coil 561 is wound. The coil guide plate 562 has a semicylindrical shape arranged near the outer peripheral surface of the heating roller 566, and the excitation coil 561 is formed by winding a long wire around the coil guide plate 562 alternately in the axial direction of the heating roller 566. The excitation coil 561 is connected to a drive power source (not shown) having an oscillation circuit of variable frequency. Arranged outside of the excitation coil 561 is an excitation coil core 563 formed in semicylindrical shape from a ferromagnetic material such as ferrite, being fixed on an excitation coil core support member 564 in the vicinity of the excitation coil 561.

In the electromagnetic induction heating type fixing device 570 shown in FIG. 11, when electric power is supplied to the excitation coil 561 of the electromagnetic induction heating unit 560, an alternating magnetic field is generated around the electromagnetic induction heating unit 560, so that the heating roller 566 arranged near the excitation coil 561 and surrounded by the excitation coil 561 is preheated uniformly and efficiently by the eddy current induced therein. The recording medium S whereon the toner image T to be fixed is formed is transported to the nipping section N between the fixing roller 580 and the pressurizing roller 590. Then the toner image T formed on the recording medium S is heated to melt by the fixing belt 567 which is heated, in a contact area W1 making contact with the heating roller 566, by the heating roller 566 which is heated to a predetermined temperature by the electromagnetic induction heating unit 560. Under this condition, the recording medium S is inserted into the nipping section N formed between the fixing roller 580 and the pressurizing roller 590. The recording medium S inserted into the nipping section N is brought into contact with the surface of the fixing belt 567 which runs in synchronization with the rotation of the fixing roller 580 and the pressurizing roller 590, and is pressed while passing the nipping section N, so that the toner image T is fixed on the recording medium S.

Then the recording medium S having the toner image T fixed thereon passes between the fixing roller 580 and the pressurizing roller 590, separated from the fixing belt 567 and is transported to the tray (not shown). At this time, the recording medium S is discharged toward the pressurizing roller 590 and the recording medium S is prevented from being entangled with the fixing belt 567. The fixing belt 567 is cleaned by a cleaning roller (not shown).

Figure 12:
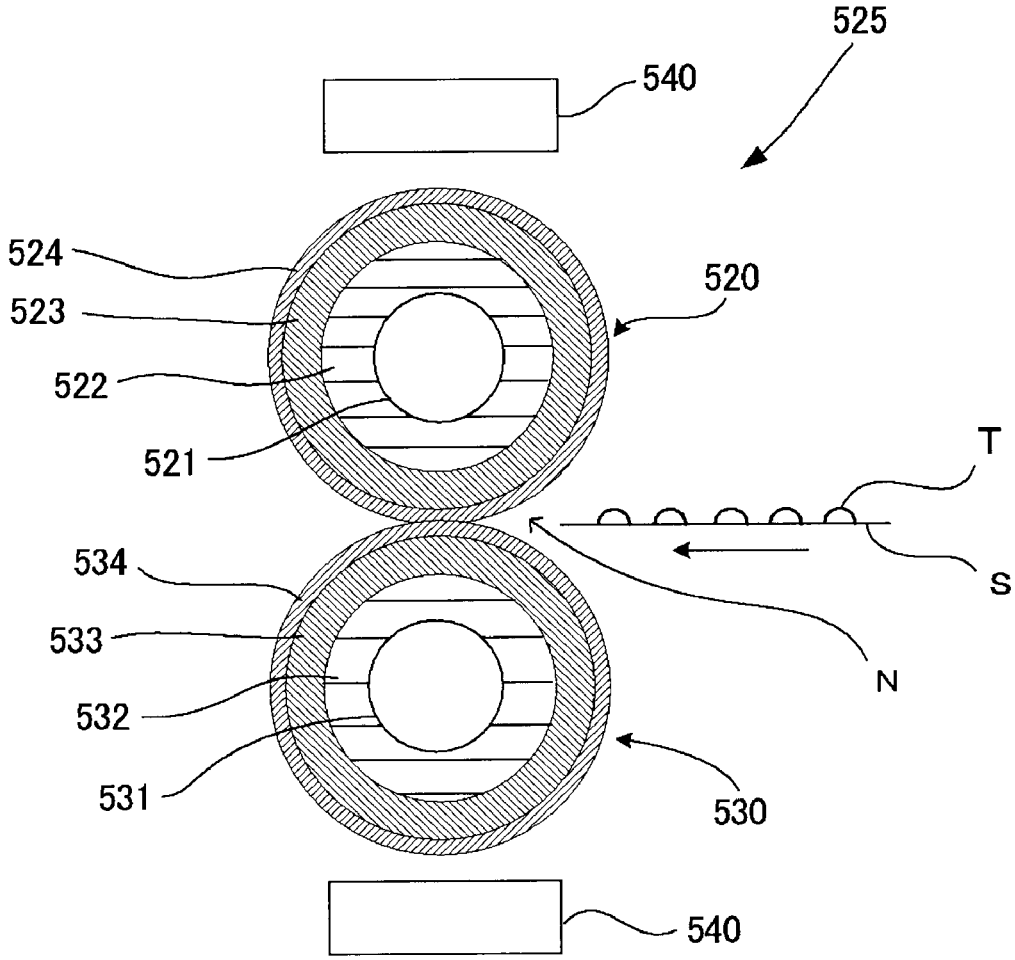
FIG. 12 is a schematic view showing an example of a fixing unit of an electromagnetic induction heating system in the image forming apparatus of the present invention.

A roll type fixing device 525 based on induction heating method shown in FIG. 12 is a fixing unit comprising a fixing roller 520 serving as the fixing member, a pressurizing roller 530 arranged in contact therewith and an electromagnetic induction heat source 540 which heats the fixing roller 520 and the pressurizing roller from the outside.

The fixing roller 520 has a core metal 521 of which surface is covered by a heat insulating elastic layer 522, a heat generating layer 523 and a releasing layer 524 which are formed in this order. The pressurizing roller 530 has a core metal 531 of which surface is covered by a heat insulating elastic layer 532, a heat generating layer 533 and a releasing layer 534 which are formed in this order. The releasing layer 524 and the releasing layer 534 are formed from tetrafluoroethylene-perfluoroalkyl vinyl ether (PFA).

The fixing roller 520 and the pressurizing roller 530 are urged by a spring (not shown) into contact with each other while being capable of rotating and forming a nipping section N.

The electromagnetic induction heat source 540 is arranged in the vicinity of the fixing roller 520 and the pressurizing roller 530, and heats the heat generating layer 523 and the heat generating layer 533 by electromagnetic induction.

In the fixing device shown in FIG. 12, the fixing roller 520 and the pressurizing roller 530 are preheated uniformly and efficiently by the electromagnetic induction heat source 540. Since the device is constituted from a combination of rollers, high surface pressure can be easily achieved in the nipping section N.

<Cleaning Step and Cleaning Unit>

The cleaning step is a step of removing the toner left on the latent electrostatic image bearing member, which can be carried out preferably by the cleaning unit.

As the developing unit has a developing agent carrier which makes contact with the surface of the latent electrostatic image bearing member so as to develop the latent electrostatic image formed on the latent electrostatic image bearing member while the residual toner on the latent electrostatic image bearing member is recovered, the latent electrostatic image bearing member can be cleaned without providing a cleaning unit (cleaningless system).

The cleaning unit is not specifically limited and can be appropriately selected from known cleaners according to the purposes as long as it is capable of removing the residual toner left on the latent electrostatic image bearing member and includes, for example, magnetic brush cleaner, electrostatic brush cleaner, magnetic roller cleaner, cleaning blade, brush cleaner or web cleaner. Among these cleaners, it is particularly preferable to employ the cleaning blade which has high toner removing capability and is compact and inexpensive.

A rubber blade of the cleaning blade may be formed from urethane rubber, silicone rubber, fluororubber, chloroprene rubber or butadiene rubber, among which urethane rubber is particularly preferable.

Figure 13:
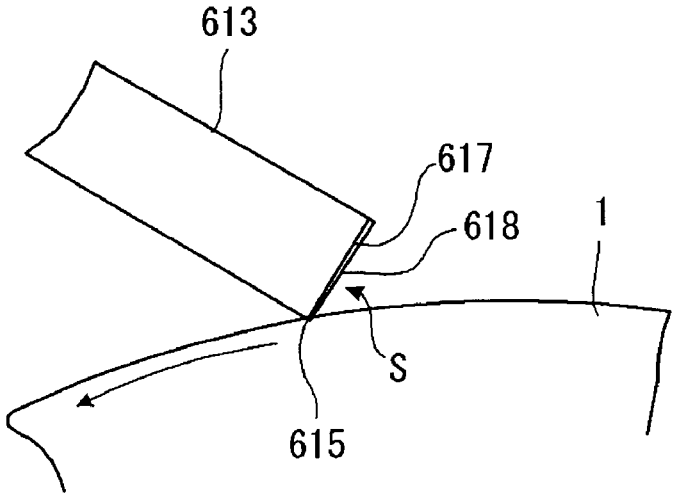
FIG. 13 is a schematic view showing an example of a cleaning blade in the image forming apparatus of the present invention.

FIG. 13 is an enlarged view of a portion around a contact area 615 between the cleaning blade 613 and the latent electrostatic image bearing member. The cleaning blade 613 has a toner blocking surface 617 separated from the surface of a photoconductor drum 1 by a space S which expands from a contact area 615 toward the upstream in the rotating direction of the latent electrostatic image bearing member. In this embodiment, the toner blocking surface 617 extends from the contact area 615 toward the upstream in the rotating direction of the latent electrostatic image bearing member so that space S has an acute angle.

The toner blocking surface 617 has a coated portion 618 which has a friction coefficient higher than that of the cleaning blade 613 as shown in FIG. 13. The coated portion 618 is formed from a material (high friction material) having a friction coefficient higher than that of the cleaning blade 613. The high friction material may be, for example, DLC (diamond-like carbon), although the high friction material is not limited to DLC. The coated portion 618 is provided on the toner blocking surface 617 over an area which does not touch the surface of the photoconductor drum 1.

The cleaning unit, while not shown in the drawing, comprises a toner recovery vane which recovers the residual toner that has been scraped by the cleaning blade, and a toner recovery coil which transports the residual toner recovered by the toner recovery vane to a restoration section.

-Image Forming Apparatus of Cleaningless System-

Figure 14:
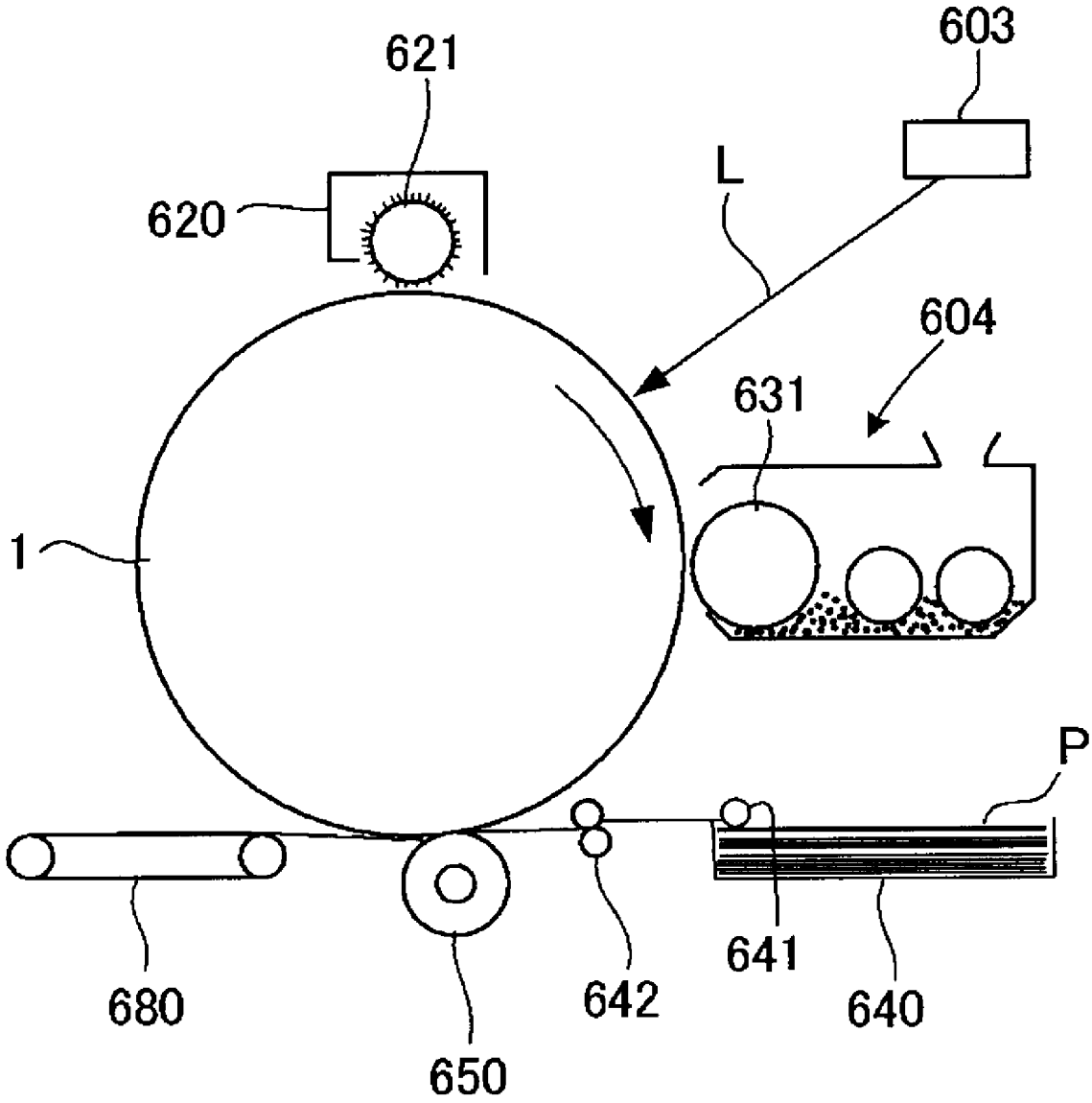
FIG. 14 is a schematic view showing an example of a cleaningless type image forming apparatus in the image forming apparatus of the present invention.

FIG. 14 is a schematic view showing an example of a cleaningless image forming apparatus in which the developing unit also serves as the cleaning unit.

In FIG. 14, the numeral 1 denotes the photoconductor drum serving as the latent electrostatic image bearing member, 620 denotes a brush charging device serving as a contact charging unit, 603 denotes an exposure device serving as an exposure unit, 604 denotes a processor serving as the developing unit, 640 denotes a paper feeder cassette, 650 denotes a roller transferring unit and P denotes the recording medium.

In the cleaningless image forming apparatus, the toner remaining after transfer on the surface of the photoconductor drum 1 is moved to the position of the contact charging device 620 which is in contact with the photoconductor drum 1, by the subsequent turn of the photoconductor drum 1, and is temporarily recovered by the magnetic brush (not shown) of the brush charging member 621 which is in contact with the photoconductor drum 1. The toner once recovered is discharged again onto the surface of the photoconductor drum 1, and is finally recovered by a developing agent carrier 631 together with the developing agent in the processor 604, while the photoconductor drum 1 is used repetitively for image forming.

The expression that the developing unit 604 serves also as the cleaning unit means a method of recovering a small amount of toner left on the photoconductor drum 1 after transfer by development bias (difference between the DC voltage applied to the developing agent carrier 631 and the surface potential of the photoconductor drum 1).

In the cleaningless image forming apparatus in which the developing unit serves also as the cleaning unit, the toner remaining after transfer is recovered by the processor 604 and is used in the subsequent operations. As a result, waste toner is eliminated and the apparatus is rendered maintenance-free and free of cleaner, thereby providing remarkable advantage with regard to the space and achieving remarkable reduction in size of the image forming apparatus.

<Other Step and Other Unit>

The decharging step is a step of removing the electrostatic charge by applying a decharging bias to the latent electrostatic image bearing member, and can be preferably carried out by a decharging unit.

The decharging unit is not specifically limited and can be appropriately selected from known decharging devices according to the purposes as long as it is capable of applying a decharging bias to the latent electrostatic image bearing member, and includes, for example, a decharging lamp.

The recycling step is a step of recycling the electrophotographic toner which has been recovered in the cleaning step to the developing unit, and can be preferably carried out by a recycling unit. The recycling unit is not specifically limited and includes, for example, a known transportation unit.

The controlling step is a step of controlling the steps described above, and can be preferably carried out by a controlling unit.

The controlling unit is not specifically limited and can be appropriately selected according to the purposes as long as it is capable of controlling the operations of the units described above, and includes, for example, device as sequencer or computer.

-Image Forming Apparatus and Image Forming Method-

An embodiment of implementing the image forming method by the image forming apparatus of the present invention will now be described with reference to FIG. 15. The image forming apparatus 100 shown in FIG. 15 comprises a photoconductor drum 10 serving as the latent electrostatic image bearing member, a charging roller 20 serving as the charging unit, exposure 30 generated by an exposure device serving as the exposure unit, a processor 40 serving as the developing unit, an intermediate transfer member 50, a cleaning blade 60 serving as the cleaning unit and a decharging lamp 70 serving as the decharging unit.

The intermediate transfer member 50 is an endless belt designed to be movable in the direction indicated by an arrow in the drawing by three rollers 51 over which the belt is stretched. Part of the three rollers 51 serves also as a transfer bias roller which is capable of applying a predetermined bias (primary transfer bias) to the intermediate transfer member 50. Arranged in the vicinity of the intermediate transfer member 50 is an intermediate transfer member clearing blade 90, and a transfer roller 80 is arranged to oppose thereto as the transferring unit which is capable of applying a transfer bias for transferring (secondary transfer) the visualized image (toner image) to the recording medium 95. Arranged around the intermediate transfer member 50 is a corona charging device 58 for applying electric charge to the visualized image formed on the intermediate transfer member 50, located between the contact area of the latent electrostatic image bearing member 10 and the intermediate transfer member 50 and the contact area of the intermediate transfer member 50 and the recording medium 95, in the rotating direction of the intermediate transfer member 50.

The processor 40 comprises a developing belt 41 serving as the developing agent carrier, a black developing unit 45K, a yellow developing unit 45Y, a magenta developing unit 45M and a cyan developing unit 45C which are arranged around the developing belt 41. The black developing unit 45K comprises a developing agent container 42K, a developing agent feeding roller 43K and a developing roller 44K. The yellow developing unit 45Y comprises a developing agent container 42Y, a developing agent feeding roller 43Y and a developing roller 44Y. The magenta developing unit 45M comprises a developing agent container 42M, a developing agent feeding roller 43M and a developing roller 44M. The cyan developing unit 45C comprises a developing agent container 42C, a developing agent feeding roller 43C and a developing roller 44C. The developing belt 41 is an endless belt, which is stretched over plural belt rollers so as to be capable of running thereon, and a part of which makes contact with the latent electrostatic image bearing member 10.

Figure 15:
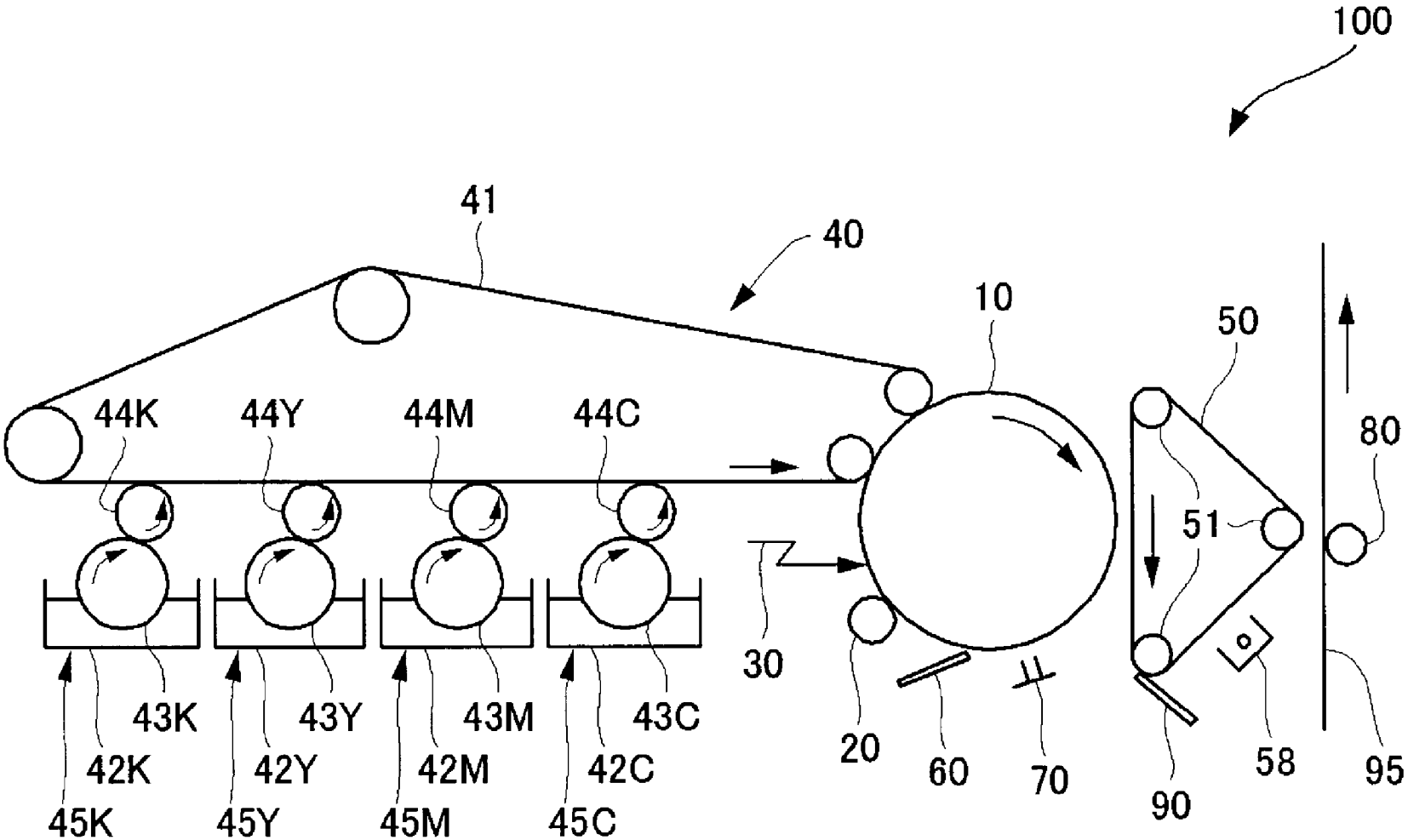
FIG. 15 is a schematic view showing an example of the image forming apparatus of the present invention.

In the image forming apparatus 100 shown in FIG. 15, the charging roller 20 first charges the photoconductor drum 10 uniformly. An exposure device (not shown) applies imagewise exposure 30 on the photoconductor drum 10 to form a latent electrostatic image. The latent electrostatic image formed on the photoconductor drum 10 is developed by supplying toner from the processor 40 to form a visible image. The visible image is transferred onto the intermediate transfer member 50 by a voltage applied from the roller 51 (primary transfer), and is further transferred onto the recording medium 95 (secondary transfer). As a result, the transferred image is formed on the recording medium 95. The toner left on the latent electrostatic image bearing member 10 is removed by the cleaning blade 60, while the electric charge on the latent electrostatic image bearing member 10 is once removed by the decharging lamp 70.

Figure 16:
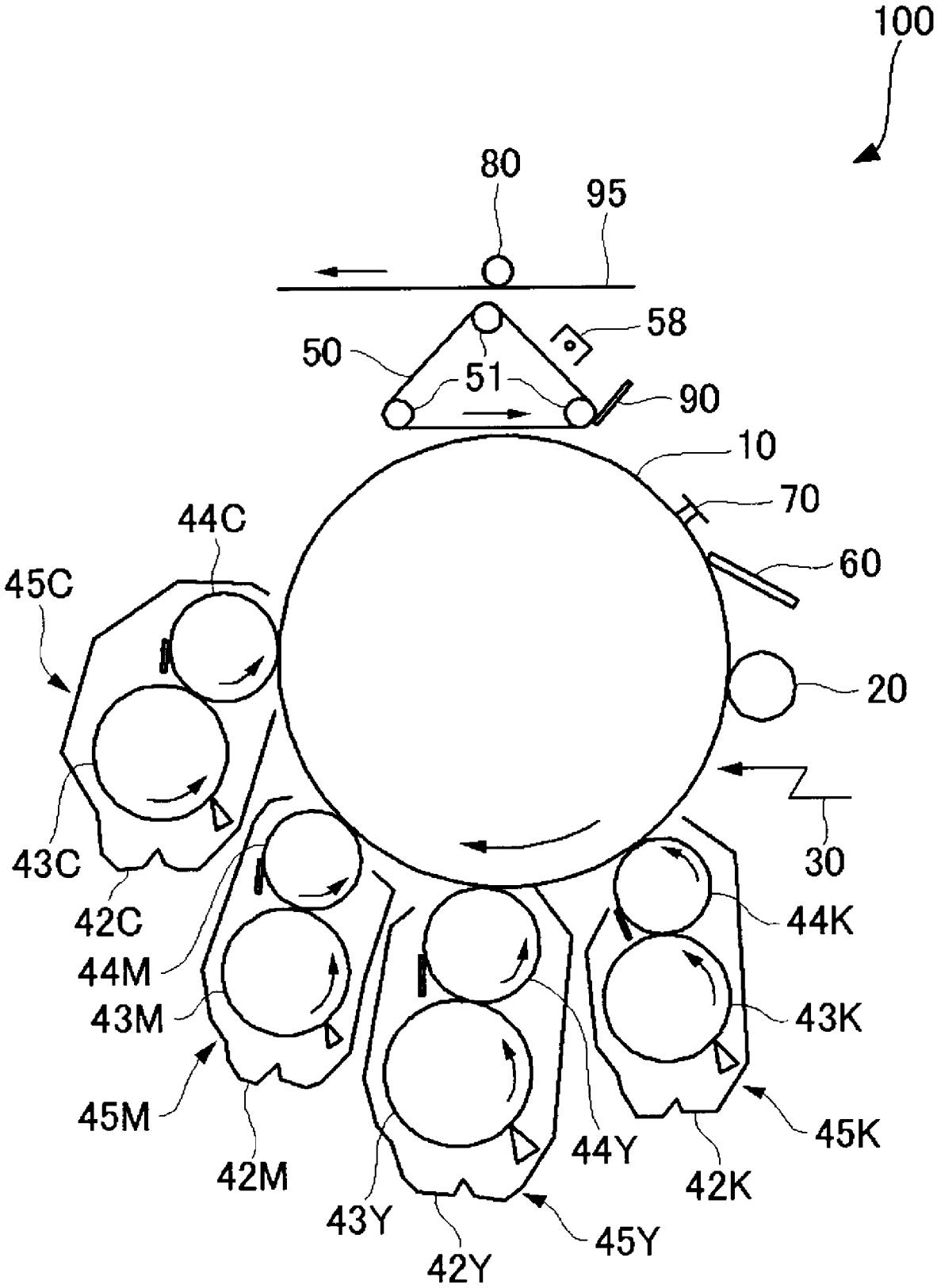
FIG. 16 is a schematic view showing an example of another example of the image forming apparatus of the present invention.

Another embodiment of implementing the image forming method of the present invention by the image forming apparatus of the present invention will now be described with reference to FIG. 16. The image forming apparatus 100 shown in FIG. 16 has a constitution similar to that of the image forming apparatus 100 shown in FIG. 15, except for the fact that the developing belt 41 serving as the developing agent carrier of the image forming apparatus 100 shown in FIG. 15 is not provided and that the black developing unit 45K, the yellow developing unit 45Y, the magenta developing unit 45M and the cyan developing unit 45C are arranged to directly oppose around the latent electrostatic image bearing member 10, and has similar operation and effect. In FIG. 16, components identical with those shown in FIG. 15 are denoted with the identical numerals.

-Tandem Type Image Forming Apparatus and Image Forming Method-

Figure 17:
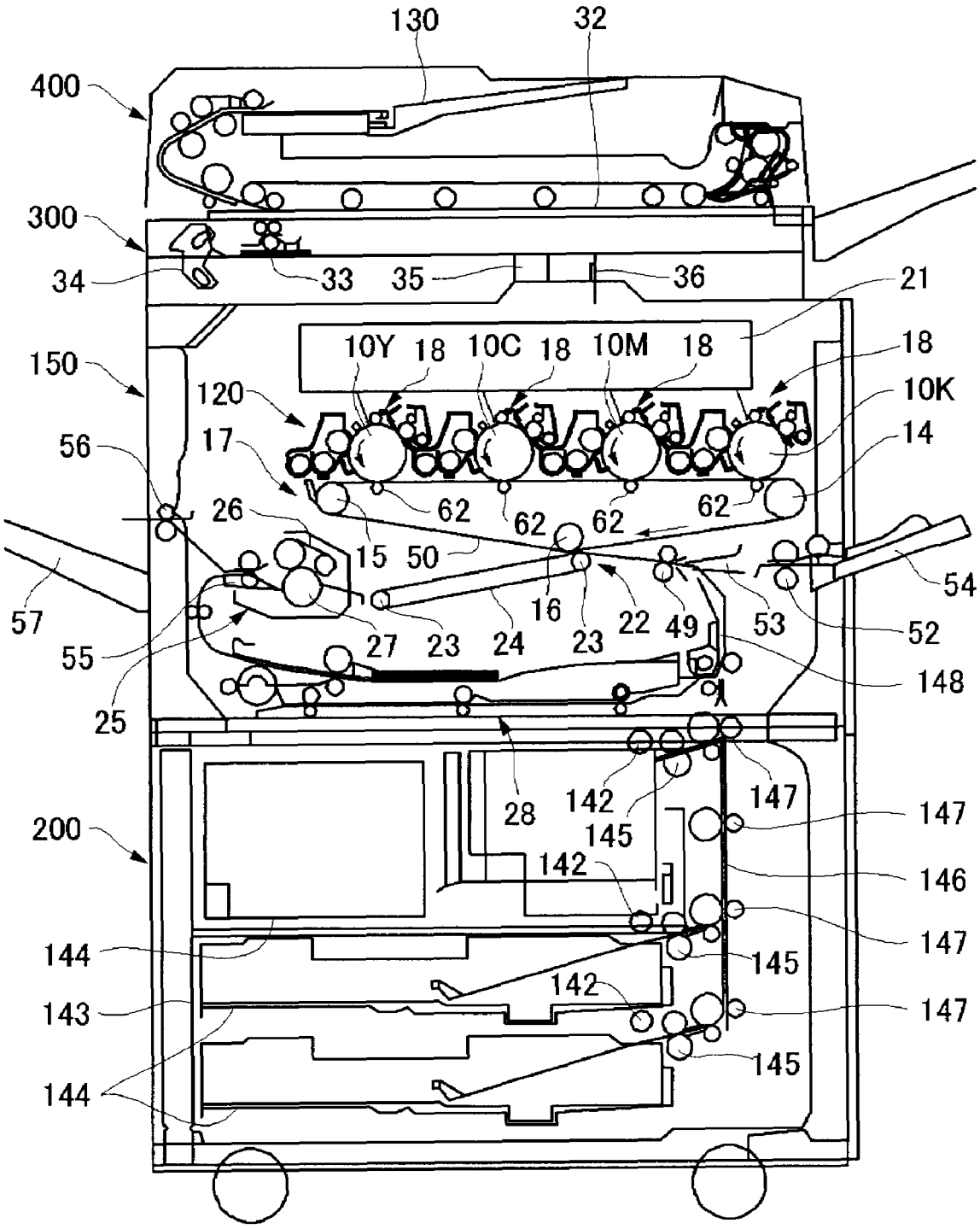
FIG. 17 is a schematic view showing an example of the tandem type image forming apparatus of the present invention.

Another embodiment of implementing the image forming method of the present invention by the image forming apparatus of the present invention will now be described with reference to FIG. 17. The tandem type image forming apparatus shown in FIG. 17 is a tandem type color image forming apparatus. The tandem type color image forming apparatus comprises a copying device 150, a paper feeding table 200, a scanner 300 and an automatic document feeding device (ADF) 400.

The copying device 150 has the intermediate transfer member 50 having the form of endless belt arranged at the center thereof. The intermediate transfer member 50 is stretched over support rollers 14, 15 and 16 so as to move clockwise in FIG. 17. Arranged in the vicinity of the support roller 15 is an intermediate transfer member cleaning unit 17 which removes the residual toner from the intermediate transfer member 50. A tandem developing unit 120 is provided which is constituted from four image forming units 18 for yellow, cyan, magenta and black colors arranged in tandem opposing each other along the direction of the intermediate transfer member 50 which is stretched across the support roller 14 and the support roller 15. Arranged in the vicinity of the tandem developing unit 120 is an exposure device 21. Arranged on the side of the intermediate transfer member 50 opposite to the tandem developing unit 120 is a secondary transferring unit 22. In the secondary transferring unit 22, a secondary transfer belt 24 which is an endless belt is stretched over a pair of rollers 23, so that the recording medium carried on the secondary transfer belt 24 and the intermediate transfer member 50 can make contact with each other. Arranged in the vicinity of the secondary transferring unit 22 is a fixing device 25.

Arranged in the vicinity of the secondary transferring unit 22 and the fixing device 25 is an inverting device 28 which turns over the recording medium for the purpose of forming images on both sides of the recording medium.

The formation of a full-cover image (color copy) using the tandem developing unit 120 will now be described. First, an original document is set on a document stage 130 of the automatic document feeding device (ADF) 400, or on a contact glass 32 of the scanner 300 by opening the automatic document feeding device 400 and then the automatic document feeding device 400 is closed.

When the start switch (not shown) is pressed, the scanner 300 operates and a first carriage 33 and a second carriage 34 start to run, after the original document has been transported onto the contact glass 32 in case the original document was set on the automatic document feeding device 400, or immediately in case the original document was set on the contact glass 32. Then the light from the light source is applied by the first carriage 33 while the light reflected on the original document surface is reflected on a mirror of the second carriage 34, transmitted through a focusing lens 35 and is received by a reading sensor 36, so that color original document (the color image) is read to generate image information of black, yellow, magenta and cyan colors.

Figure 18:
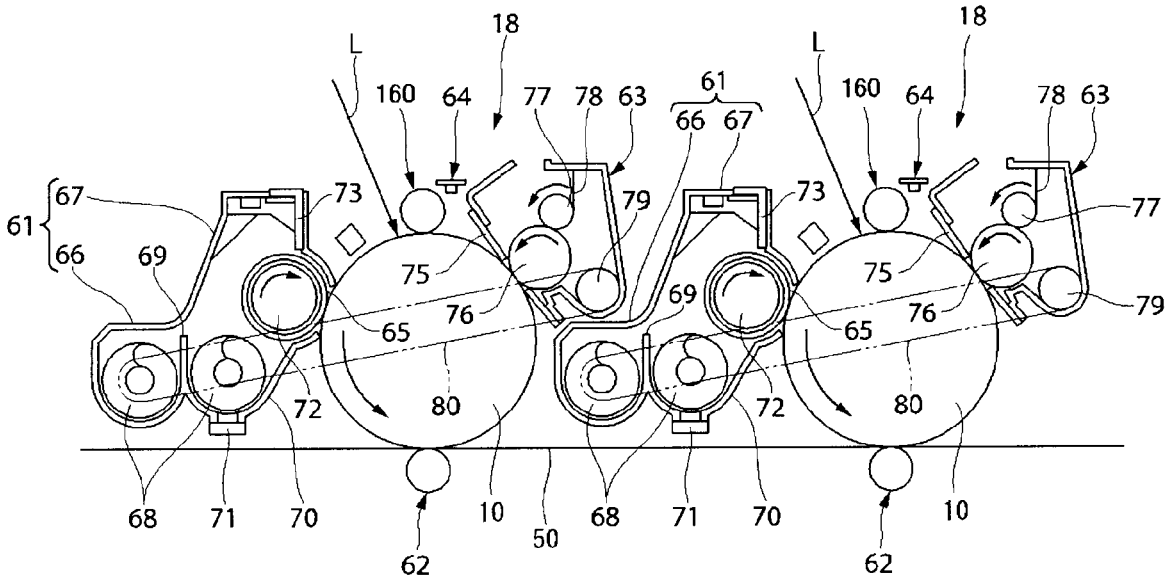
FIG. 18 is an enlarged view showing image forming units of the image forming apparatus of FIG. 17.

The image information of each of the black, yellow, magenta and cyan colors is sent to the corresponding image forming units 18 (black image forming unit, yellow image forming unit, magenta image forming unit and cyan image forming unit) of the tandem developing unit 120, so that toner images of black, yellow, magenta and cyan colors are formed in the respective image forming units. The image forming units 18 (the black image forming unit, the yellow image forming unit, the magenta image forming unit and the cyan image forming unit) of the tandem developing unit 120 comprise, as shown in FIG. 18, the latent electrostatic image bearing member 10 (latent electrostatic image bearing member for black 10K, latent electrostatic image bearing member for yellow 10Y, latent electrostatic image bearing member for magenta 10M and latent electrostatic image bearing member for cyan 10C), a charging device 160 for uniformly charging the latent electrostatic image bearing member 10, the exposure device which imagewise radiates (L in FIG. 18) the latent electrostatic image bearing member of each color according to the image information of the respective colors, a processor 61 which develops the latent electrostatic image using the color toners (yellow toner, magenta toner, cyan toner and black toner) and forms the toner images from the respective color toners, a transfer charging device 62 for transferring the toner images onto the intermediate transfer member 50, a cleaning device 63 and a decharging device 64, so as to be capable of forming the monochrome images (black image, yellow image, magenta image and cyan image) according to the image information of the respective colors. The black image, yellow image, magenta image and cyan image are sequentially transferred (primary transfer) onto the intermediate transfer member 50 which is driven to run by the support rollers 14, 15 and 16, as the black image formed on the latent electrostatic image bearing member for black 10K, yellow image formed on the latent electrostatic image bearing member for yellow 10Y, magenta image formed on the latent electrostatic image bearing member for magenta 10M and cyan image formed on the latent electrostatic image bearing member for cyan 10C. Then the black image, the yellow image, the magenta image and the cyan image are superposed on the intermediate transfer member 50 to form a synthesized color image (transferred color image).

In the paper feeding table 200, one of the paper feed rollers 142 is selectively driven to rotate so as to feed the recording medium from one of the paper feed cassettes provided in multiple stages in a paper bank 143, while sending the recording medium which is separated one by one by a separating roller 145 into a paper feed passage 146, the recording medium being guided by the transportation roller 147 into a paper feed passage 148 within the copying device 150 and brought into contact with a resist roller 49 so as to stop. Alternatively, the recording medium placed on a manual feed tray 54 is supplied by rotating the paper feed roller 142, and is put into a manual paper feed passage 53 while being separated one by one by a separating roller 52 and is brought into contact with the resist roller 49 so as to stop. While the resist roller 49 is usually used while being grounded, it may be used while being biased in order to remove paper dust generated from the recording medium. The resist roller 49 is driven to rotate in synchronization with the transferred color image synthesized on the intermediate transfer member 50, so that the recording medium is supplied to between the intermediate transfer member 50 and the secondary transferring unit 22. Then the synthesized color image (transferred color image) is transferred by the secondary transferring unit 22 onto the recording medium (secondary transfer) to form the color image on the recording medium. The residual toner on the intermediate transfer member 50 after transferring the image is cleaned by the intermediate transfer member cleaning device 17.

The recording medium having the color image being transferred and formed thereon is transported by the secondary transferring unit 22 to the fixing device 25, so that the synthesized color image (transferred color image) is fixed on the recording medium by heat and pressure in the fixing device 25. Then the passage is selected by a selector claw 55 so that the recording medium is discharged by the discharge roller 56 and stacked on a paper discharge tray 57. Alternatively, the passage is selected by the selector claw 55 so that the recording medium is turned over by the inverting device 28 and guided to the transferring position again, where the image is formed also on the back of the recording medium, before being discharged by the discharge roller 56 and stacked on a paper discharge tray 57.

<Toner Container>

A toner container contains therein the toner or developer.

The container is not specifically limited and can be appropriately selected from known containers and preferably includes, for example, a container comprising a toner container body and a cap.

The size, shape, structure and material of the toner container body are not specifically limited and can be appropriately selected according to the purposes and, for example, the shape is preferably a cylindrical shape, and particularly preferably a shape in which spiral irregularity is formed on the internal periphery and the toner as the content can be migrated to the side of a discharge port and also a portion or all of the spiral section has a bellow function.

The material of the toner container body is not specifically limited and is preferably excellent in dimensional accuracy and preferably includes, for example, a resin. For example, a polyester resin, polyethylene resin, a polypropylene resin, a polystyrene resin, a polyvinyl chloride resin, polyacrylic acid, a polycarbonate resin, an ABS resin and a polyacetal resin are particularly preferable.

The toner container is easily stored and transported and is excellent in handling properties, and also can be preferably used to refill the toner by detachably attaching to the process cartridge or the image forming apparatus of the present invention.

(Process Cartridge)

The process cartridge of the present invention comprises at least: a latent electrostatic image bearing member; and a developing unit configured to develop a latent electrostatic image formed on the latent electrostatic image bearing member with a toner to form a visualized image, the process cartridge being detachable from an image forming apparatus body; and further comprises other units, which are optionally selected appropriately, such as a charging unit, an exposing unit, a transferring unit, a cleaning unit and a decharging unit.

The toner comprises a binder resin and a coloring agent, and the binder resin comprises a polyester-based resin (A) and a polyester-based resin (B) having a melting point which is at least 10° C. higher than that of the polyester-based resin (A), the polyester-based resins (A) is a resin which is derived from a (meth)acrylic acid-modified rosin and which has a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which has a polyester unit obtained by condensation polymerization of an alcohol component and a carboxylic acid component containing any one of a fumaric acid-modified rosin and a maleic acid-modified rosin.

As the polyester-based resins (A) and (B), the same polyester resin as that explained in the above image forming apparatus and image forming method can be used.

The developing unit comprises at least a developer container containing the toner or developer and a developer bearing member which supports and transports the toner or developer contained in the developer container, and may further comprise a layer thickness controlling member fro controlling the thickness of the toner layer to be supported on the developer bearing member.

Specifically, either a one-component developing unit or a two-component developing unit explained in the image forming apparatus and image forming method can be preferably used.

As the charging unit, the exposing unit, the transferring unit, the cleaning unit and the decharging unit, the same units as those in the above-mentioned image forming apparatus can be appropriately selected and used.

It is possible to detachably provide various electrophotographic image forming apparatuses, facsimiles and printers with the process cartridge, and it is particularly preferable to detachably provide the image forming apparatus of the present invention.

Figure 19:
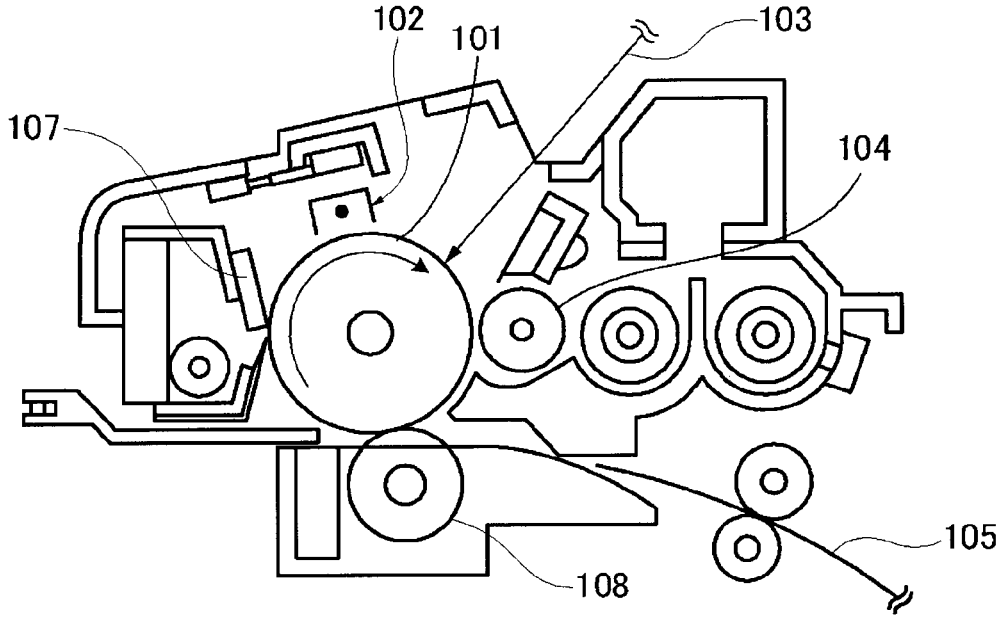
FIG. 19 is a schematic view showing an example of the process cartridge of the present invention.

Herein, the process cartridge incorporates, for example, a latent electrostatic image bearing member 101 and includes a charging unit 102, a developing unit 104, a transferring unit 108 and a cleaning unit 107, and also optionally comprises other units, as shown in FIG. 19. In FIG. 19, the numeral 103 denotes exposure by an exposing unit and 105 denotes a recording medium, respectively.

Next, an image forming process by a process cartridge shown in FIG. 19 is illustrated. While a latent electrostatic image bearing member 101 rotates in the direction of the arrow, a latent electrostatic image corresponding to the exposed image is formed on the surface upon charge by a charging unit 102 and exposure 103 by an exposing unit (not shown). The latent electrostatic image thus formed is developed by the developing unit 104 and the resulting visualized image is transferred onto a recording medium 105 by a transferring unit 108 and then printed out. After transfer of the image, the surface of the latent electrostatic image bearing member is cleaned by a cleaning unit 107 and decharging is performed by a decharging unit (not shown), and then the above operation is repeated again.

EXAMPLE

Examples of the present invention will now be described, but the present invention is not specifically limited in scope to these Examples. In the following Examples and Comparative Examples, various physical properties of resins and rosins were measured in the following manner.

<Measurement of Softening Point of Polyester Resin>

Using Flow Tester (manufactured by Shimadzu Corporation, CFT-500D), 1 g of each polyester-based binder resin as a sample was extruded through a nozzle having a diameter of 1 mm and a length of 1 mm by applying a load of 1.96 MPa from a plunger while heating at a temperature raising rate of 6° C./min. A fall amount of the plunger in Flow Tester to the temperature was plotted and the temperature, at which a half amount of the sample was flowed out, was taken as a softening point.

<Measurement of Glass Transition Temperature (Tg) of Resin and Rosin>

Using a differential scanning calorimeter (manufactured by Seiko Electronic Industry Co., Ltd., DSC210), 0.01 g to 0.02 g of each polyester-based binder resin as a sample was weighed in an aluminum pan. After heating to 200° C., the sample cooled from the same temperature to 0° C. at a temperature falling rate of 10° C./min was heated at a temperature raising rate of 10° C./min, and then the temperature at an intersection point of an extension line of a base line at a temperature lower than an endothermic maximum peak temperature and a tangent line showing a maximum slope from a rising slope of a peak to a peak top was taken as a glass transition temperature.

<Measurement of Softening Point of Rosin>

(1) Preparation of Sample

Ten grams of a rosin was melted on a hot plate at 170° C. for 2 hours. In an opening state, the rosin was cooled under an environment of a temperature of 25° C. and a relative humidity of 50% was naturally cooled for one hour and then ground by a coffee mill (National MK-61M) for 10 seconds to obtain a sample.

(2) Measurement

Using Flow Tester (manufactured by Shimadzu Corporation, CFT-500D), 1 g of each polyester-based binder resin as a sample was extruded through a nozzle having a diameter of 1 mm and a length of 1 mm by applying a load of 1.96 MPa from a plunger while heating at a temperature raising rate of 6° C./min. A fall amount of the plunger in Flow Tester to the temperature was plotted and the temperature, at which a half amount of the sample was flowed out, was taken as a softening point.

<Acid Value of Resin and Rosin>

According to the method defined in JIS K0070, an acid value was measured. In case of only a measuring solvent, a mixed solvent of ethanol and ether defined in JIS K0070 was replaced by a mixed solvent of acetone and toluene (acetone: toluene=1:1 (volume ratio)).

<Hydroxyl Value of Resin>

A hydroxy value was measured according to the method defined in JIS K0070.

<Content of Low Molecular Weight Component Having Molecular Weight of 500 or Less>

Molecular weight distribution was measured by gel permeation chromatography (GPC). First, to 30 mg of each polyester-based binder resin, 10 ml of tetrahydrofuran was added and, after mixing using a ball mill for one hour, insoluble components were removed by filtering through a fluororesin filter having a pore size of 2 μm "FP-200" (manufactured by Sumitomo Electric Industries, Ltd.) to prepare a sample solution.

Tetrahydrofuran as an eluate was allowed to flow at a flow rate of 1 ml per minute and a column in a constant temperature bath at 40° C. was stabilized and, after injecting 100 μL of the sample solution, the measurement was performed. "GMHLX+G3000HXL" (manufactured by TOSOH CORPORATION) was used as an analytic column and a calibration curve of a molecular weight was made using several kinds of monodisperse polystyrenes ($2.63\times10^3$, $2.06\times10^4$, $1.02\times10^5$ manufactured by TOSOH CORPORATION, and $2.10\times10^3$, $7.00\times10^3$, $5.04\times10^4$ manufactured by GL Sciences Inc.) as standard sample.

Next, the content of a low molecular weight component having a molecular weight of 500 or less (%) was calculated as the proportion of an area of the corresponding region in a chart area obtained by an RI (refractive index) detector.

<Measurement of SP Value of Rosin>

Each sample (2.1 g) in a molten state was poured into a predetermined ring and cooled to room temperature, and then a SP value was measured under the following conditions according to JIS B7410.

Measuring device: Automatic ring-and-ball softening point tester (ASP-MGK2, manufactured by MEITECH Company, Ltd.)

Temperature raising rate: 5° C./minutes

Heating initiation temperature: 40° C.

Measuring solvent: glycerin

<Measurement of Degree of Modification of Rosin with (Meth)acrylic Acid>

The degree of modification with (meth)acrylic acid can be calculated using the following equation (Aa):

[Equation 4]

$$\text{Degree of Modification with (Meth)acrylic acid} = [(X_{a1}-Y)/(X_{a2}-Y)]\times100 \quad \text{Equation (Aa)}$$

where $X_{a1}$ denotes an SP value of a (meth)acrylic acid-modified rosin whose modification degree is to be calculated, $X_{a2}$ denotes a saturated SP value of a (meth)acrylic acid-modified rosin obtained by reacting 1 mol of (meth)acrylic acid with 1 mol of rosin, and Y denotes a SP value of a rosin.

The saturated SP value means an SP value measured when the reaction of the (meth)acrylic acid with the rosin is performed until the SP value of the resulting (meth)acrylic acid-modified rosin reaches a saturated value.

<Measurement of Degree of Modification of Rosin with Fumaric Acid>

The degree of modification with fumaric acid can be calculated using the following equation (Af):

[Equation 5]

$$\text{Degree of Modification with fumaric acid}=[(X_{f1}-Y)/(X_{f2}-Y)]\times 100 \quad \text{Equation (Af)}$$

where $X_{f1}$ denotes a SP value of a fumaric acid-modified rosin whose modification degree is to be calculated, $X_{f2}$ denotes a saturated SP value of a fumaric acid-modified rosin obtained by reacting 1 mol of fumaric acid with 0.7 mol of a rosin, and Y denotes a SP value of a rosin.

The SP value denoted by $X_{f2}$ is an SP value of a fumaric acid-modified rosin obtained by raising the temperature of a mixture of 1 mol of fumaric acid, 0.7 mol of a rosin and 0.4 g of t-butylcatechol from 160° C. to 200° C. over 2 hours, followed by reaction at 200° C. for 2 hours and further distillation under reduced pressure of 5.3 kPa.

<Measurement of Degree of Modification of Rosin with Maleic Acid>

The degree of modification of rosin with (meth)acrylic acid was calculated using the following equation (Am):

[Equation 6]

$$\text{Degree of Modification with Maleic Acid}=[(X_{m1}-Y)/(X_{m2}-Y)]\times 100 \quad \text{Equation (Am)}$$

where $X_{m1}$ denotes an SP value of a maleic acid-modified rosin whose modification degree is to be calculated, $Xm_2$ denotes a saturated SP value of a maleic acid-modified rosin obtained by reacting 1 mol of maleic acid with 1 mol of a rosin at 230° C., and Y denotes a SP value of rosin.

In the above equations (Aa), (Af) and (Am), if it is assumed that the acid value is x (mgKOH/g), it means that 1 g of rosin is reacted with x mg ($x\times10^{-3}$ g) of potassium hydroxide (molecular weight: 56.1), and thus the molecular weight corresponding to 1 mol of rosin can be calculated using the following equation: Molecular weight=(56,100/x).

and a purified rosin were analyzed in the following manner using the head space GC-MS method. The results are shown in Table 1.

<Measuring Conditions of Head Space GC-MS Method>

A. Head Space Sampler (Manufactured by Agilent Co., HP7694)

Sample temperature: 200° C.
Loop temperature: 200° C.
Transfer line temperature: 200° C.
Sample heat balance time: 30 minutes
Vial pressure gas: helium (He)
Vial pressure time: 0.3 minutes
Loop filling time: 0.03 minutes
Loop equilibrium time: 0.3 minutes
Injection time: 1 minute B. Gas Chromatography (GC) Equipment (Manufactured by Agilent Co., HP6890)

Analytic column: DB-1 (60 m-320 μm-5 μm)
Carrier: helium (He)
Flow conditions: 1 ml/min
Injection inlet temperature: 210° C.
Column head pressure: 34.2 kPa
Injection mode: split
Split ratio: 10:1
Oven temperature conditions: 45° C. (3 min)-10° C./min-280° C. (15 min)

C. Mass Spectrometry (MS) Equipment (Manufactured by Agilent Co., HP5973)

Ionization method: EI (electron impact) method
Interface temperature: 280° C.
Ion source temperature: 230° C.
Quadrupole temperature: 150° C.
Detection mode: Scan 29 m/s to 350 m/s

TABLE 1

| | Hexanoic acid | Pentanoic acid | Benzaldehyde | N-hexanol | 2-pentylfuran | SP value (° C.) Softening point (° C.) | Acid value (mgKOH/g) | Molecular weight of one mol |
|---|---|---|---|---|---|---|---|---|
| Unpurified rosin | $0.9\times10^7$ | $0.6\times10^7$ | $0.6\times10^7$ | $1.8\times10^7$ | $1.1\times10^7$ | 77<br>74.3 | 169 | 332 |
| Purified rosin | $0.4\times10^7$ | $0.2\times10^7$ | $0.2\times10^7$ | $1.4\times10^7$ | $0.7\times10^7$ | 76.8<br>75.1 | 166 | 338 |

Synthesis Example 1

-Purification of Rosin-

In a 2,000 ml volumetric distilling flask equipped with a distilling tube, a reflux condenser and a receiver, 1,000 g of a tall rosin (glass transition temperature (Tg)=37.2° C.) was added, followed by distillation under reduced pressure of 1 kPa to collect a distillate at 195° C. to 250° C. as a fraction. Hereinafter, a tall rosin subjected to purification is referred to as an unpurified rosin and a rosin collected as a fraction is referred to as a purified rosin (glass transition temperature (Tg)=39.2° C.).

Twenty grams of each rosin was pulverized in a coffee mill (National MK-61M) for 5 seconds and passed through a sieve with an opening size of 1 mm, and then 0.5 g of the rosin powder was weighed in a 20 ml-vial for head space. After sampling a head space gas, impurities in an unpurified rosin <Measurement of SP Value of Acrylic Acid-Modified Rosin Using Unpurified Rosin>

In a 1,000 ml volumetric flask equipped with a distilling tube, a reflux condenser and a receiver, 332 g (1 mol) of an unpurified rosin (SP value: 77.0° C.) and 72 g (1 mol) of acrylic acid were added. After heating from 160° C. to 230° C. over 8 hours, it was confirmed that a SP value does not increase at 230° C. and the unreacted acrylic acid and a low boiling point substance were distilled off under reduced pressure of 5.3 kPa to obtain an acrylic acid-modified rosin.

An SP value of the resulting acrylic acid-modified rosin, that is, a saturated SP value of an acrylic acid-modified rosin using an unpurified rosin was 110.1° C.

<Measurement of Saturated SP Value of Acrylic Acid-modified Rosin Using Purified Rosin>

In a 1,000 ml volumetric flask equipped with a distilling tube, a reflux condenser and a receiver, 338 g (1 mol) of a purified rosin (SP value: 76.8° C.) and 72 g (1 mol) of acrylic acid were added. After heating from 160° C. to 230° C. over 8 hours, it was confirmed that a SP value does not increase at 230° C. and the unreacted acrylic acid and a low boiling point substance were distilled off under reduced pressure of 5.3 kPa to obtain an acrylic acid-modified rosin.

An SP value of the resulting acrylic acid-modified rosin, that is, a saturated SP value of an acrylic acid-modified rosin using an unpurified rosin was 110.4° C.

Synthesis Example 2

-Synthesis of Acrylic Acid-Modified Rosin A-

In a 10 L volumetric flask equipped with a distilling tube, a reflux condenser and a receiver, 6,084 g (18 mol) of a purified rosin (SP value: 76.8° C.) and 907.9 g (12.6 mol) of acrylic acid were added. After heating from 160° C. to 220° C. over 8 hours, the reaction was performed at 220° C. for 2 hours and distillation was performed under reduced pressure of 5.3 kPa to obtain an acrylic acid-modified rosin A. A SP value of the resulting acrylic acid-modified rosin A was 110.4° C. and the degree of modification with acrylic acid was 100.

Synthesis Example 3

-Synthesis of Acrylic Acid-Modified Rosin B-

In a 10 L volumetric flask equipped with a distilling tube, a reflux condenser and a receiver, 6,084 g (18 mol) of a purified rosin (SP value: 76.8° C.) and 648.5 g (9.0 mol) of acrylic acid were added. After heating from 160° C. to 220° C. over 8 hours, the reaction was performed at 220° C. for 2 hours and distillation was performed under reduced pressure of 5.3 kPa to obtain an acrylic acid-modified rosin B. A SP value of the resulting acrylic acid-modified rosin B was 99.1° C., the glass transition temperature was 53.2° C., and the degree of modification with acrylic acid was 66.

Synthesis Example 4

-Synthesis of Acrylic Acid-Modified Rosin C-

In a 10 L volumetric flask equipped with a distilling tube, a reflux condenser and a receiver, 5.976 g (18 mol) of an unpurified rosin (SP value: 77.0° C.) and 907.6 g (12.6 mol) of acrylic acid were added. After heating from 160° C. to 220° C. over 8 hours, the reaction was performed at 250° C. for 2 hours and distillation was performed at 250° C. under reduced pressure of 5.3 kPa to obtain an acrylic acid-modified rosin C. A SP value of the resulting acrylic acid-modified rosin C was 110.1° C., the glass transition temperature was 54.5° C., and the degree of modification with acrylic acid was 100.

<Measurement of SP Vale of Fumaric Acid-Modified Rosin Using Unpurified Rosin to be Used as $Xf_2$ Value>

In a 1,000 ml volumetric distilling flask equipped with a distilling tube, a reflux condenser and a receiver, 332 g (1 mol) of an unpurified rosin (SP value=77.0° C.), 81 g (0.7 mol) of fumaric acid and 0.4 g of t-butylcatechol were charged, heated from 160° C. to 200° C. over 2 hours and then reacted at 200° C. for 2 hours. The unreacted fumaric acid and a low boiling point substance were distilled off by distilling at 200° C. under reduced pressure of 5.3 kPa to obtain a fumaric acid-modified rosin.

An SP value of the resulting fumaric acid-modified rosin, that is, a SP value of the resulting fumaric acid-modified rosin using an unpurified rosin was 130.6° C.

<Measurement of SP Vale of Fumaric Acid-Modified Rosin Using Purified Rosin to be Used as $Xf_2$ Value>

In a 1,000 ml volumetric distilling flask equipped with a distilling tube, a reflux condenser and a receiver, 388 g (1 mol) of a purified rosin (SP value=76.8° C.), 81 g (0.7 mol) of fumaric acid and 0.4 g of t-butylcatechol were charged, heated from 160° C. to 200° C. over 2 hours and then reacted at 200° C. for 2 hours. The unreacted fumaric acid and a low boiling point substance were distilled off by distilling at 200° C. under reduced pressure of 5.3 kPa to obtain a fumaric acid-modified rosin.

An SP value of the resulting fumaric acid-modified rosin, that is, a SP value of the resulting fumaric acid-modified rosin using a purified rosin was 130.9° C.

Synthesis Example 5

-Synthesis of Fumaric Acid-Modified Rosin A-

In a 10 L volumetric distilling flask equipped with a distilling tube, a reflux condenser and a receiver, 5,408 g (16 mol) of a purified rosin (SP value=76.8° C.), 928 g (8 mol) of fumaric acid and 0.4 g of t-butylcatechol were charged, heated from 160° C. to 200° C. over 2 hours and then reacted at 200° C. for 2 hours. The reaction solution was distilled at 200° C. under reduced pressure of 5.3 kPa to obtain a fumaric acid-modified rosin A.

The resulting fumaric acid-modified rosin A showed an SP value of 130.8° C., a glass transition temperature of 74.4° C. and the degree with fumaric acid of 100.

Synthesis Example 6

-Synthesis of Fumaric Acid-Modified Rosin B-

In a 10 L volumetric distilling flask equipped with a distilling tube, a reflux condenser and a receiver, 5,408 g (16 mol) of a purified rosin (SP value=76.8° C.), 278 g (2.4 mol) of fumaric acid and 0.4 g of t-butylcatechol were charged, heated from 160° C. to 200° C. over 2 hours and then reacted at 200° C. for 2 hours. The reaction solution was distilled at 200° C. under reduced pressure of 5.3 kPa to obtain a fumaric acid-modified rosin B.

The resulting fumaric acid-modified rosin B showed a SP value of 98.4° C., a glass transition temperature of 48.3° C. and the degree with fumaric acid of 40.

Synthesis Example 7

-Synthesis of Fumaric Acid-Modified Rosin C-

In a 10 L volumetric distilling flask equipped with a distilling tube, a reflux condenser and a receiver, 5,312 g (16 mol) of an unpurified rosin (SP value=77.0° C.), 928 g (8 mol) of fumaric acid and 0.4 g of t-butylcatechol were charged, heated from 160° C. to 200° C. over 2 hours and then reacted at 200° C. for 2 hours. The reaction solution was distilled at 200° C. under reduced pressure of 5.3 kPa to obtain a fumaric acid-modified rosin C.

The resulting fumaric acid-modified rosin C showed a SP value of 130.4° C., a glass transition temperature of 72.1° C. and the degree with fumaric acid of 100.

<Measurement of SP Vale of Maleic Acid-Modified Rosin Using Unpurified Rosin>

In a 1,000 ml volumetric distilling flask equipped with a distilling tube, a reflux condenser and a receiver, 332 g (1 mol) of an unpurified rosin (SP value=77.0° C.) and 98 g (1 mol) of maleic anhydride were charged and then heated from 160° C. to 230° C. over 8 hours. After confirming that the SP value did not increase at 230° C., the unreacted maleic anhydride and a low boiling point substance were distilled off at 230° C. under reduced pressure of 5.3 kPa to obtain a maleic acid-modified rosin.

An SP value of the resulting maleic acid-modified rosin, that is, a saturated SP value of the resulting maleic acid-modified rosin using an unpurified rosin was 116° C.

<Measurement of SP Vale of Maleic Acid-Modified Rosin Using Purified Rosin>

In a 1,000 ml volumetric distilling flask equipped with a distilling tube, a reflux condenser and a receiver, 338 g (1 mol) of a purified rosin (SP value=76.8° C.) and 98 g (1 mol) of maleic anhydride were charged and then heated from 160° C. to 230° C. over 8 hours. After confirming that the SP value did not increase at 230° C., the unreacted maleic anhydride and a low boiling point substance were distilled off at 230° C. under reduced pressure of 5.3 kPa to obtain a maleic acid-modified rosin.

An SP value of the resulting maleic acid-modified rosin, that is, a saturated SP value of the resulting maleic acid-modified rosin using a purified rosin was 116° C.

Synthesis Example 8

-Synthesis of Maleic Acid-Modified Rosin A-

In a 10 L volumetric distilling flask equipped with a distilling tube, a reflux condenser and a receiver, 6,084 g (18 mol) of an unpurified rosin (SP value=76.8° C.) and 1,323 g (13.5 mol) of maliec anhydride were charged, heated from 160° C. to 220° C. over 8 hours and then reacted at 220° C. for 2 hours. The reaction solution was distilled at 220° C. under reduced pressure of 5.3 kPa to obtain a maleic acid-modified rosin A. The resulting maleic acid-modified rosin A showed a SP value of 116.2° C., a glass transition temperature of 57.6° C. and the degree with maleic acid of 101.

Synthesis Example 9

-Synthesis of Maleic Acid-Modified Rosin A-

In a 10 L volumetric distilling flask equipped with a distilling tube, a reflux condenser and a receiver, 5,976 g (18 mol) of an unpurified rosin (SP value=77.0° C.) and 529 g (5.4 mol) of maliec anhydride were charged, heated from 160° C. to 220° C. over 8 hours and then reacted at 220° C. for 2 hours. The reaction solution was distilled at 220° C. under reduced pressure of 5.3 kPa to obtain a maleic acid-modified rosin B. The resulting maleic acid-modified rosin B showed a SP value of 96.4° C. and the degree with maleic acid of 50.

Synthesis Examples 10 to 14 and 16 to 21

-Synthesis of Resins 1 to 5 and 7 to 12-

An alcohol component, a carboxylic acid component other than trimellitic anhydride, and an esterifying catalyst shown in Table 2 and Table 3 were charged in a 5 liter volumetric four-necked flask equipped with a distilling tube through which hot water at 98° C. passes, the distilling tube being equipped with a reflux condensing tube through with chilled water at room temperature passes at the upper portion, a nitrogen introducing tube, a dewatering tube, a stirrer and a thermocouple. After the condensation polymerization reaction was performed under a nitrogen atmosphere at 160° C. for 2 hours, the temperature was raised to 210° C. over 6 hours, and then the reaction was performed under 66 kPa for one hour. After cooling to 200° C., trimellitic anhydride shown in Table 2 and Table 3 was introduced and the reaction was performed under a normal pressure (101.3 kPa) for one hour. The temperature was raised to 210° C., and then the reaction was performed under 40 kPa until the temperature reaches a desired softening point, and thus resins 1 to 5 and 7 to 12 were synthesized.

Synthesis Example 15

-Synthesis of Resin 6-

An alcohol component excluding glycerin, a carboxylic acid component excluding trimellitic anhydride, and an esterifying catalyst shown in Table 2 were charged in a 5 liter volumetric four-necked flask equipped with a distilling tube through which hot water at 98° C. passes, the distilling tube being equipped with a reflux condensing tube through with chilled water at room temperature passes at the upper portion, a nitrogen introducing tube, a dewatering tube, a stirrer and a thermocouple. After the condensation polymerization reaction was performed under a nitrogen atmosphere at 160° C. for 2 hours, the temperature was raised to 210° C. over 6 hours, and then the reaction was performed under 66 kPa for one hour. After cooling to 180° C., glycerin shown in Table 2 was introduced and the temperature was raised to 200° C. at a rate of 5° C./30 minutes. The reaction was performed at 200° C. under a normal pressure (101.3 kPa) for one hour, and then the reaction was performed under 66.0 kPa for one hour. Then, trimellitic anhydride shown in Table 2 was introduced and the reaction was performed under a normal pressure (101.3 kPa) for one hour. The temperature was raised to 210° C., and then the reaction was performed under 40 kPa until the temperature reaches a desired softening point to obtain a resin 6.

TABLE 2

| | | Synthesis Example No. | | | | | |
|---|---|---|---|---|---|---|---|
| | | 10 | 11 | 12 | 13 | 14 | 15 |
| | Resin No. | 1 | 2 | 3 | 4 | 5 | 6 |
| Alcohol component | Ethylene glycol | — | — | — | — | — | — |
| | 1,2-propanediol | 933 g | 897 g | 1187 g | 883 g | 1192 g | 933 g |
| | 1,3-propanediol | 56 g | 224 g | — | 220 g | — | 56 g |
| | 2,3-butanediol | — | — | — | — | — | — |
| | Glycerin | 231 g | 127 g | 72 g | 133 g | 72 g | 231 g |
| Carboxylic acid component | Terephthalic acid | 1914 g | 1730 g | 2074 g | 1807 g | 2084 g | 1914 g |
| | Trimellitic anhydride | 369 g | 340 g | 274 g | 418 g | 274 g | 369 g |
| | Unpurified rosin* | — | — | — | — | — | — |
| | Fumaric acid modified rosin A | 996 g | — | — | — | — | 996 g |
| | Fumaric acid modified rosin B | — | — | — | 1037 g | — | — |

TABLE 2-continued

| | | Synthesis Example No. | | | | | |
|---|---|---|---|---|---|---|---|
| | | 10 | 11 | 12 | 13 | 14 | 15 |
| | Fumaric acid modified rosin C | — | — | — | — | — | — |
| | Maleic acid modified rosin A | — | 1182 g | — | — | — | — |
| | Maleic acid modified resin B | — | — | — | — | — | — |
| | Acrylic acid modified resin A | — | — | 896 g | — | — | — |
| | Acrylic acid modified resin B | — | — | — | — | 880 g | — |
| | Acrylic acid modified resin C | — | — | — | — | — | — |
| Esterifying catalyst | Dibutyltin oxide | — | — | — | — | 18 g | — |
| | Tin(II) dioctanoate | 25 g | 25 g | 25 g | 25 g | — | 25 g |
| | Titanium diisopropylate bistriethanolaminate | — | — | — | — | — | — |
| | Content(mass %)of rosin in carboxylic acid component | 30.4 | 36.3 | 27.6 | 31.8 | 27.2 | 30.4 |
| Physical properties of resin | Acid value (mgKOH/g) | 28.8 | 25.5 | 35.8 | 23.6 | 33.6 | 32.5 |
| | Hydroxyl value (mgKOH/g) | 18.9 | 24.8 | 26.9 | 15.6 | 25.1 | 21.6 |
| | Softening point (° C.) | 148.6 | 140.9 | 103.5 | 135.8 | 106.6 | 128.6 |
| | Glass transition temperature (° C.) | 68.5 | 64.2 | 58.8 | 62.2 | 56.8 | 64.3 |
| | Content (%) of low molecular weight component having molecular weight of 500 or less | 4.3 | 6.3 | 7.4 | 9.3 | 10.2 | 7.6 |

*Unpurified rosin: unmodified rosin

TABLE 3

| | | Synthesis Example No. | | | | | |
|---|---|---|---|---|---|---|---|
| | | 16 | 17 | 18 | 19 | 20 | 21 |
| | Resin No. | 7 | 8 | 9 | 10 | 11 | 12 |
| Alcohol component | Ethylene glycol | — | — | 106 g | — | — | — |
| | 1,2-propanediol | 1107 g | 933 g | 1107 g | 1255 g | 881 g | 1064 g |
| | 1,3-propanediol | — | 56 g | — | — | 228 g | — |
| | 2,3-butanediol | 154 g | — | — | — | — | — |
| | Glycerin | 79 g | 231 g | 80 g | — | 169 g | — |
| Carboxylic acid component | Terephthalic acid | 2077 g | 1914 g | 2077 g | 2032 g | 2132 g | 1720 g |
| | Trimellitic anhydride | 494 g | 369 g | 494 g | 274 g | 399 g | 54 g |
| | Unpurified rosin* | — | — | — | — | 528 g | 1027 g |
| | Fumaric acid modified rosin A | — | — | — | — | — | — |
| | Fumaric acid modified rosin B | — | — | — | — | — | — |
| | Fumaric acid modified rosin C | — | 996 g | — | — | — | — |
| | Maleic acid modified rosin A | — | — | — | — | — | — |
| | Maleic acid modified resin B | — | — | — | 332 g | — | — |
| | Acrylic acid modified resin A | — | — | — | — | — | — |
| | Acrylic acid modified resin B | 590 g | — | — | — | — | — |
| | Acrylic acid modified resin C | — | — | 590 g | — | — | — |
| Esterifying catalyst | Dibutyltin oxide | — | — | — | — | 20 g | 20 g |
| | Tin(II) dioctanoate | — | 25 g | 25 g | 25 g | — | — |
| | Titanium diisopropylate bistriethanolaminate | 25 g | — | — | — | — | — |
| | Content(mass %)of rosin in carboxylic acid component | 18.7 | 30.4 | 18.7 | 12.6 | 17.3 | 36.7 |
| Physical properties of resin | Acid value (mgKOH/g) | 33.4 | 27.6 | 40.2 | 32.9 | 34.7 | 27.8 |
| | Hydroxyl value (mgKOH/g) | 28.5 | 18.1 | 38.5 | 22.6 | 18.3 | 20.3 |
| | Softening point (° C.) | 116.8 | 144.3 | 110.2 | 129.3 | 143.5 | 105.1 |
| | Glass transition temperature (° C.) | 67 | 66.5 | 60.5 | 73 | 58.2 | 54.5 |
| | Content (%) of low molecular weight component having molecular weight of 500 or less | 7.9 | 5.6 | 7.9 | 4.6 | 11 | 14.4 |

*Unpurified rosin: unmodified rosin

Preparation Example 1

-Preparation of Master Batch 1-

A pigment with the following composition, a binder resin 3 and pure water were mixed in proportions (mass ratio) of 1:1:0.5 and then kneaded using a twin roller. Kneading was performed at 70° C. and water was vaporized by raising the roller temperature to 120° C. to obtain a master batch 1 comprising a cyan toner master batch 1 (TB-C1), a magenta toner master batch 1 (TB-M1), a yellow toner master batch 1 (TB-Y1) and a black toner master batch 1 (TB-K1).

| [Formulation of Cyan Toner Master Batch 1 (TB-C1)] | |
|---|---|
| Binder resin 3 | 100 parts by mass |
| Cyan pigment (C.I. Pigment Blue 15:3) | 100 parts by mass |
| Pure water | 50 parts by mass |

| [Formulation of Magenta Toner Master Batch 1 (TB-M1)] | |
|---|---|
| Binder resin 3 | 100 parts by mass |
| Magenta pigment (C.I. Pigment Red 122) | 100 parts by mass |
| Pure water | 50 parts by mass |

| [Formulation of Yellow Toner Master Batch 1 (TB-Y1)] | |
|---|---|
| Binder resin 3 | 100 parts by mass |
| Yellow pigment (C.I. Pigment Yellow 180) | 100 parts by mass |
| Pure water | 50 parts by mass |

| [Formulation of Black Toner Master Batch 1 (TB-K1)] | |
|---|---|
| Binder resin 3 | 100 parts by mass |
| Black pigment (carbon black) | 100 parts by mass |
| Pure water | 50 parts by mass |

Preparation Example 2

-Preparation of Master Batch 2-

In the same manner as in Preparation Example 1, except that a binder resin 3 was replaced by a binder resin 5 in Preparation Example 1, a master batch 2 comprising a cyan toner master batch 2 (TB-C2), a magenta toner master batch 2 (TB-M2), a yellow toner master batch 2 (TB-Y2) and a black toner master batch 2 (TB-K2) was obtained.

Preparation Example 3

-Preparation of Master Batch 3-

In the same manner as in Preparation Example 1, except that a binder resin 3 was replaced by a binder resin 7 in Preparation Example 1, a master batch 3 comprising a cyan toner master batch 3 (TB-C3), a magenta toner master batch 3 (TB-M3), a yellow toner master batch 3 (TB-Y3) and a black toner master batch 3 (TB-K3) was obtained.

Preparation Example 4

-Preparation of Master Batch 4-

In the same manner as in Preparation Example 1, except that a binder resin 3 was replaced by a binder resin 9 in Preparation Example 1, a master batch 4 comprising a cyan toner master batch 4 (TB-C4), a magenta toner master batch 4 (TB-M4), a yellow toner master batch 4 (TB-Y4) and a black toner master batch 4 (TB-K4) was obtained.

Preparation Example 5

-Preparation of Master Batch 5-

In the same manner as in Preparation Example 1, except that a binder resin 3 was replaced by a binder resin 10 in Preparation Example 1, a master batch 5 comprising a cyan toner master batch 5 (TB-C5), a magenta toner master batch 5 (TB-M5), a yellow toner master batch 5 (TB-Y5) and a black toner master batch 5 (TB-K5) was obtained.

Preparation Example 6

-Preparation of Master Batch 6-

In the same manner as in Preparation Example 1, except that a binder resin 3 was replaced by a binder resin 12 in Preparation Example 1, a master batch 6 comprising a cyan toner master batch 6 (TB-C6), a magenta toner master batch 6 (TB-M6), a yellow toner master batch 6 (TB-Y6) and a black toner master batch 6 (TB-K6) was obtained.

TABLE 4

| | | | Binder resin formulation | | Pigment formulation | | |
|---|---|---|---|---|---|---|---|
| | | | Name of resin | Amount (parts by mass) | Name of Pigment | Amount (parts by mass) | Pure water amount (parts by mass) |
| Master batch 1 | Cyan | TB-C1 | Binder resin 3 | 100 | C.I.Pigment blue 15:3 | 100 | 50 |
| | Magenta | TB-M1 | Binder resin 3 | 100 | C.I.pigment red 122 | 100 | 50 |
| | Yellow | TB-Y1 | Binder resin 3 | 100 | C.I.pigment yellow 180 | 100 | 50 |
| | Black | TB-K1 | Binder resin 3 | 100 | Carbon black | 100 | 50 |
| Master batch 2 | Cyan | TB-C1 | Binder resin 5 | 100 | C.I.Pigment blue 15:3 | 100 | 50 |
| | Magenta | TB-M1 | Binder resin 5 | 100 | C.I.pigment red 122 | 100 | 50 |
| | Yellow | TB-Y1 | Binder resin 5 | 100 | C.I.pigment yellow 180 | 100 | 50 |
| | Black | TB-K1 | Binder resin 5 | 100 | Carbon black | 100 | 50 |

TABLE 4-continued

| | | | Binder resin formulation | | Pigment formulation | | |
|---|---|---|---|---|---|---|---|
| | | | Name of resin | Amount (parts by mass) | Name of Pigment | Amount (parts by mass) | Pure water amount (parts by mass) |
| Master batch 3 | Cyan | TB-C1 | Binder resin 7 | 100 | C.I.Pigment blue 15:3 | 100 | 50 |
| | Magenta | TB-M1 | Binder resin 7 | 100 | C.I.pigment red 122 | 100 | 50 |
| | Yellow | TB-Y1 | Binder resin 7 | 100 | C.I.pigment yellow 180 | 100 | 50 |
| | Black | TB-K1 | Binder resin 7 | 100 | Carbon black | 100 | 50 |
| Master batch 4 | Cyan | TB-C1 | Binder resin 9 | 100 | C.I.Pigment blue 15:3 | 100 | 50 |
| | Magenta | TB-M1 | Binder resin 9 | 100 | C.I.pigment red 122 | 100 | 50 |
| | Yellow | TB-Y1 | Binder resin 9 | 100 | C.I.pigment yellow 180 | 100 | 50 |
| | Black | TB-K1 | Binder resin 9 | 100 | Carbon black | 100 | 50 |
| Master batch 5 | Cyan | TB-C1 | Binder resin 10 | 100 | C.I.Pigment blue 15:3 | 100 | 50 |
| | Magenta | TB-M1 | Binder resin 10 | 100 | C.I.pigment red 122 | 100 | 50 |
| | Yellow | TB-Y1 | Binder resin 10 | 100 | C.I.pigment yellow 180 | 100 | 50 |
| | Black | TB-K1 | Binder resin 10 | 100 | Carbon black | 100 | 50 |
| Master batch 6 | Cyan | TB-C1 | Binder resin 12 | 100 | C.I.Pigment blue 15:3 | 100 | 50 |
| | Magenta | TB-M1 | Binder resin 12 | 100 | C.I.pigment red 122 | 100 | 50 |
| | Yellow | TB-Y1 | Binder resin 12 | 100 | C.I.pigment yellow 180 | 100 | 50 |
| | Black | TB-K1 | Binder resin 12 | 100 | Carbon black | 100 | 50 |

Preparation Example 7

<Preparation of Toner 1>

In the following manner, a toner 1 comprising a cyan toner 1, a magenta toner 1, a yellow toner 1 and a black toner 1 was prepared.

-Preparation of Cyan Toner 1-

According to the following cyan toner formulation 1, components were premixed using HENSCHEL MIXER (manufactured by MITSUI MIIKE MACHINERY CO., LTD., FM10B) and kneaded using a twin screw extruder (manufactured by Ikegai Corporation, PCM-30). Then, the kneaded mixture was finely ground using a supersonic jet grinder (Rabojet, manufactured by Nippon Pneumatic Mfg. Co., Ltd.) and classified using an air classifier (manufactured by Nippon Pneumatic Mfg. Co., Ltd., MDS-I) to obtain toner base particles having a weight average particle size of 7 μm.

Then, 100 parts by mass of toner base particles and 1.0 parts by mass of colloidal silica (H-2000, manufactured by Clariant Co., Ltd.) were mixed using a sample mill to obtain a cyan toner 1.

| [Cyan Toner Formulation 1] | |
|---|---|
| Resin 3 as polyester-based binder resin (A) | 42 parts by mass |
| Resin 1 as polyester-based binder resin (B) | 50 parts by mass |
| Cyan toner master batch 1 (TB-C1) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

-Preparation of Magenta Toner 1-

In the same manner as in the method for preparing a cyan toner 1, except that the cyan toner formulation 1 was replaced by the following magenta toner formulation 1 in the method for preparing a cyan toner 1, a magenta toner 1 was prepared.

| [Magenta Toner Formulation 1] | |
|---|---|
| Resin 3 as polyester-based binder resin (A) | 41 parts by mass |
| Resin 1 as polyester-based binder resin (B) | 50 parts by mass |
| Magenta toner master batch 1 (TB-M1) | 18 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

-Preparation of Yellow Toner 1-

In the same manner as in the method for preparing cyan toner 1, except that the cyan toner formulation 1 was replaced by the following yellow toner formulation 1 in the method for preparing a cyan toner 1, a yellow toner 1 was prepared.

| [Yellow Toner Formulation 1] | |
|---|---|
| Resin 3 as polyester-based binder resin (A) | 40 parts by mass |
| Resin 1 as polyester-based binder resin (B) | 50 parts by mass |
| Yellow toner master batch 1 (TB-Y1) | 20 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

-Preparation of Black Toner 1-

In the same manner as in the method for preparing cyan toner 1, except that the cyan toner formulation 1 was replaced by the following black toner formulation 1 in the method for preparing a cyan toner 1, a black toner 1 was prepared.

| [Black Toner Formulation 1] | |
|---|---|
| Resin 3 as polyester-based binder resin (A) | 42 parts by mass |
| Resin 1 as polyester-based binder resin (B) | 50 parts by mass |
| Black toner master batch 1 (TB-K1) | 16 parts by mass |

-continued

| [Black Toner Formulation 1] | |
|---|---|
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

Preparation Example 8

<Preparation of Toner 2>

In the same manner as in Preparation Example 7, except that the formulation was replaced by each toner formulation described below in Preparation Example 7, a toner 2 comprising a cyan toner 2, a yellow toner 2, a magenta toner 2 and a black toner 2 was prepared.

| [Cyan Toner Formulation 2] | |
|---|---|
| Resin 3 as polyester-based binder resin (A) | 32 parts by mass |
| Resin 2 as polyester-based binder resin (B) | 60 parts by mass |
| Cyan toner master batch 1 (TB-C1) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Magenta Toner Formulation 2] | |
|---|---|
| Resin 3 as polyester-based binder resin (A) | 31 parts by mass |
| Resin 2 as polyester-based binder resin (B) | 60 parts by mass |
| Magenta toner master batch 1 (TB-M1) | 18 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Yellow Toner Formulation 2] | |
|---|---|
| Resin 3 as polyester-based binder resin (A) | 30 parts by mass |
| Resin 2 as polyester-based binder resin (B) | 60 parts by mass |
| Yellow toner master batch 1 (TB-Y1) | 20 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Black Toner Formulation 2] | |
|---|---|
| Resin 3 as polyester-based binder resin (A) | 32 parts by mass |
| Resin 2 as polyester-based binder resin (B) | 60 parts by mass |
| Black toner master batch 1 (TB-K1) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

Preparation Example 9

<Preparation of Toner 3>

In the same manner as in Preparation Example 7, except that the formulation was replaced by each toner formulation described below in Preparation Example 7, a toner 3 comprising a cyan toner 3, a yellow toner 3, a magenta toner 3 and a black toner 3 was prepared.

| [Cyan Toner Formulation 3] | |
|---|---|
| Resin 5 as polyester-based binder resin (A) | 32 parts by mass |
| Resin 4 as polyester-based binder resin (B) | 60 parts by mass |
| Cyan toner master batch 2 (TB-C2) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Magenta Toner Formulation 3] | |
|---|---|
| Resin 5 as polyester-based binder resin (A) | 31 parts by mass |
| Resin 4 as polyester-based binder resin (B) | 60 parts by mass |
| Magenta toner master batch 2 (TB-M2) | 18 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Yellow Toner Formulation 3] | |
|---|---|
| Resin 5 as polyester-based binder resin (A) | 30 parts by mass |
| Resin 4 as polyester-based binder resin (B) | 60 parts by mass |
| Yellow toner master batch 2 (TB-Y2) | 20 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Black Toner Formulation 3] | |
|---|---|
| Resin 5 as polyester-based binder resin (A) | 32 parts by mass |
| Resin 4 as polyester-based binder resin (B) | 60 parts by mass |
| Black toner master batch 2 (TB-K2) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

Preparation Example 10

<Preparation of Toner 4>

In the same manner as in Preparation Example 7, except that the formulation was replaced by each toner formulation described below in Preparation Example 7, a toner 4 comprising a cyan toner 4, a yellow toner 4, a magenta toner 3 and a black toner 4 was prepared.

[Cyan Toner Formulation 4]

| | |
|---|---|
| Resin 7 as polyester-based binder resin (A) | 22 parts by mass |
| Resin 6 as polyester-based binder resin (B) | 70 parts by mass |
| Cyan toner master batch 3 (TB-C3) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

[Magenta Toner Formulation 4]

| | |
|---|---|
| Resin 7 as polyester-based binder resin (A) | 21 parts by mass |
| Resin 6 as polyester-based binder resin (B) | 70 parts by mass |
| Magenta toner master batch 3 (TB-M3) | 18 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

[Yellow Toner Formulation 4]

| | |
|---|---|
| Resin 7 as polyester-based binder resin (A) | 20 parts by mass |
| Resin 6 as polyester-based binder resin (B) | 70 parts by mass |
| Yellow toner master batch 3 (TB-Y3) | 20 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

[Black Toner Formulation 4]

| | |
|---|---|
| Resin 7 as polyester-based binder resin (A) | 22 parts by mass |
| Resin 6 as polyester-based binder resin (B) | 70 parts by mass |
| Black toner master batch 1 (TB-K1) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

Preparation Example 11

<Preparation of Toner 5>

In the same manner as in Preparation Example 7, except that the formulation was replaced by each toner formulation described below in Preparation Example 7, a toner 5 comprising a cyan toner 5, a yellow toner 5, a magenta toner 5 and a black toner 5 was prepared.

[Cyan Toner Formulation 5]

| | |
|---|---|
| Resin 9 as polyester-based binder resin (A) | 32 parts by mass |
| Resin 8 as polyester-based binder resin (B) | 60 parts by mass |
| Cyan toner master batch 4 (TB-C4) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

[Magenta Toner Formulation 5]

| | |
|---|---|
| Resin 9 as polyester-based binder resin (A) | 31 parts by mass |
| Resin 8 as polyester-based binder resin (B) | 60 parts by mass |
| Magenta toner master batch 4 (TB-M4) | 18 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

[Yellow Toner Formulation 5]

| | |
|---|---|
| Resin 9 as polyester-based binder resin (A) | 30 parts by mass |
| Resin 8 as polyester-based binder resin (B) | 60 parts by mass |
| Yellow toner master batch 4 (TB-Y4) | 20 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

[Black Toner Formulation 5]

| | |
|---|---|
| Resin 9 as polyester-based binder resin (A) | 32 parts by mass |
| Resin 8 as polyester-based binder resin (B) | 60 parts by mass |
| Black toner master batch 4 (TB-K4) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

Preparation Example 12

<Preparation of Toner 6>

In the same manner as in Preparation Example 7, except that the formulation was replaced by each toner formulation described below in Preparation Example 7, a toner 6 comprising a cyan toner 6, a yellow toner 6, a magenta toner 6 and a black toner 6 was prepared.

[Cyan Toner Formulation 6]

| | |
|---|---|
| Resin 3 as polyester-based binder resin (A) | 42 parts by mass |
| Resin 10 as polyester-based binder resin (B) | 50 parts by mass |
| Cyan toner master batch 1 (TB-C1) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

[Magenta Toner Formulation 6]

| | |
|---|---|
| Resin 3 as polyester-based binder resin (A) | 41 parts by mass |
| Resin 10 as polyester-based binder resin (B) | 50 parts by mass |
| Magenta toner master batch 1 (TB-M1) | 18 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Yellow Toner Formulation 6] | |
|---|---|
| Resin 3 as polyester-based binder resin (A) | 40 parts by mass |
| Resin 10 as polyester-based binder resin (B) | 50 parts by mass |
| Yellow toner master batch 1 (TB-Y1) | 20 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Black Toner Formulation 6] | |
|---|---|
| Resin 3 as polyester-based binder resin (A) | 42 parts by mass |
| Resin 10 as polyester-based binder resin (B) | 50 parts by mass |
| Black toner master batch 1 (TB-K1) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

Preparation Example 13

<Preparation of Toner 7>

In the same manner as in Preparation Example 7, except that the formulation was replaced by each toner formulation described below in Preparation Example 7, a toner 7 comprising a cyan toner 7, a yellow toner 7, a magenta toner 7 and a black toner 7 was prepared.

| [Cyan Toner Formulation 7] | |
|---|---|
| Resin 12 as polyester-based binder resin (A) | 42 parts by mass |
| Resin 11 as polyester-based binder resin (B) | 50 parts by mass |
| Cyan toner master batch 6 (TB-C6) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Magenta Toner Formulation 7] | |
|---|---|
| Resin 12 as polyester-based binder resin (A) | 41 parts by mass |
| Resin 11 as polyester-based binder resin (B) | 50 parts by mass |
| Magenta toner master batch 6 (TB-M6) | 18 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Yellow Toner Formulation 7] | |
|---|---|
| Resin 12 as polyester-based binder resin (A) | 40 parts by mass |
| Resin 11 as polyester-based binder resin (B) | 50 parts by mass |
| Yellow toner master batch 6 (TB-Y6) | 20 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Black Toner Formulation 7] | |
|---|---|
| Resin 12 as polyester-based binder resin (A) | 42 parts by mass |
| Resin 11 as polyester-based binder resin (B) | 50 parts by mass |
| Black toner master batch 6 (TB-K6) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

Preparation Example 14

<Preparation of Toner 8>

In the same manner as in Preparation Example 7, except that the formulation was replaced by each toner formulation described below in Preparation Example 8, a toner 8 comprising a cyan toner 8, a yellow toner 8, a magenta toner 8 and a black toner 8 was prepared.

| [Cyan Toner Formulation 8] | |
|---|---|
| Resin 10 as polyester-based resin | 92 parts by mass |
| Cyan toner master batch 5 (TB-C5) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Magenta Toner Formulation 8] | |
|---|---|
| Resin 10 as polyester-based resin | 91 parts by mass |
| Magenta toner master batch 5 (TB-M5) | 18 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Yellow Toner Formulation 8] | |
|---|---|
| Resin 10 as polyester-based resin | 90 parts by mass |
| Yellow toner master batch 5 (TB-M5) | 20 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

| [Black Toner Formulation 8] | |
|---|---|
| Resin 10 as polyester-based resin | 92 parts by mass |
| Black toner master batch 5 (TB-K5) | 16 parts by mass |
| Charge control agent (manufactured by Orient Chemical Industries, LTD., E-84) | 1 part by mass |
| Ester wax (acid value = 5 gm KOH/g, weight average molecular weight = 1,600) | 5 parts by mass |

TABLE 5

| Toner | | Binder resin (A) | Binder resin (B) | Difference in softening point (° C.) between (A) and (B) | Master batch: Master batch | Master batch: Binder resin (A) in master batch | Charge control agent | WAX |
|---|---|---|---|---|---|---|---|---|
| Toner 1 | Cyan | Resin3 (42) | Resin1 (50) | 45 | TB-C1 (16) | Resin3 (8) | E-84 (1) | Ester (5) |
| | Magenta | Resin3 (41) | Resin1 (50) | | TB-M1 (18) | Resin3 (9) | E-84 (1) | Ester (5) |
| | Yellow | Resin3 (40) | Resin1 (50) | | TB-Y1 (20) | Resin3 (10) | E-84 (1) | Ester (5) |
| | Black | Resin3 (42) | Resin1 (50) | | TB-K1 (16) | Resin3 (8) | E-84 (1) | Ester (5) |
| Toner 2 | Cyan | Resin3 (32) | Resin1 (50) | 37 | TB-C1 (16) | Resin3 (8) | E-84 (1) | Ester (5) |
| | Magenta | Resin3 (31) | Resin1 (50) | | TB-M1 (18) | Resin3 (9) | E-84 (1) | Ester (5) |
| | Yellow | Resin3 (30) | Resin1 (50) | | TB-Y1 (20) | Resin3 (10) | E-84 (1) | Ester (5) |
| | Black | Resin3 (32) | Resin1 (50) | | TB-K1 (16) | Resin3 (8) | E-84 (1) | Ester (5) |
| Toner 3 | Cyan | Resin3 (32) | Resin1 (50) | 29 | TB-C1 (16) | Resin5 (8) | E-84 (1) | Ester (5) |
| | Magenta | Resin3 (31) | Resin1 (50) | | TB-M1 (18) | Resin5 (9) | E-84 (1) | Ester (5) |
| | Yellow | Resin3 (30) | Resin1 (50) | | TB-Y1 (20) | Resin5 (10) | E-84 (1) | Ester (5) |
| | Black | Resin3 (32) | Resin1 (50) | | TB-K1 (16) | Resin5 (8) | E-84 (1) | Ester (5) |
| Toner 4 | Cyan | Resin3 (22) | Resin1 (50) | 12 | TB-C1 (16) | Resin7 (8) | E-84 (1) | Ester (5) |
| | Magenta | Resin3 (21) | Resin1 (50) | | TB-M1 (18) | Resin7 (9) | E-84 (1) | Ester (5) |
| | Yellow | Resin3 (20) | Resin1 (50) | | TB-Y1 (20) | Resin7 (10) | E-84 (1) | Ester (5) |
| | Black | Resin3 (22) | Resin1 (50) | | TB-K1 (16) | Resin7 (8) | E-84 (1) | Ester (5) |
| Toner 5 | Cyan | Resin3 (32) | Resin1 (50) | 34 | TB-C1 (16) | Resin9 (8) | E-84 (1) | Ester (5) |
| | Magenta | Resin3 (31) | Resin1 (50) | | TB-M1 (18) | Resin9 (9) | E-84 (1) | Ester (5) |
| | Yellow | Resin3 (30) | Resin1 (50) | | TB-Y1 (20) | Resin9 (10) | E-84 (1) | Ester (5) |
| | Black | Resin3 (32) | Resin1 (50) | | TB-K1 (16) | Resin9 (8) | E-84 (1) | Ester (5) |
| Toner 6 | Cyan | Resin3 (42) | Resin1 (50) | 26 | TB-C1 (16) | Resin3 (8) | E-84 (1) | Ester (5) |
| | Magenta | Resin3 (41) | Resin1 (50) | | TB-M1 (18) | Resin3 (9) | E-84 (1) | Ester (5) |
| | Yellow | Resin3 (40) | Resin1 (50) | | TB-Y1 (20) | Resin3 (10) | E-84 (1) | Ester (5) |
| | Black | Resin3 (42) | Resin1 (50) | | TB-K1 (16) | Resin3 (8) | E-84 (1) | Ester (5) |
| Toner 7 | Cyan | Resin3 (42) | Resin1 (50) | 38 | TB-C1 (16) | Resin12 (8) | E-84 (1) | Ester (5) |
| | Magenta | Resin3 (41) | Resin1 (50) | | TB-M1 (18) | Resin12 (9) | E-84 (1) | Ester (5) |
| | Yellow | Resin3 (40) | Resin1 (50) | | TB-Y1 (20) | Resin12 (10) | E-84 (1) | Ester (5) |
| | Black | Resin3 (42) | Resin1 (50) | | TB-K1 (16) | Resin12 (8) | E-84 (1) | Ester (5) |
| Toner 8 | Cyan | Resin10 (92) | | — | TB-C1 (16) | Resin10 (8) | E-84 (1) | Ester (5) |
| | Magenta | Resin10 (91) | | | TB-M1 (18) | Resin10 (9) | E-84 (1) | Ester (5) |
| | Yellow | Resin10 (90) | | | TB-Y1 (20) | Resin10 (10) | E-84 (1) | Ester (5) |
| | Black | Resin10 (92) | | | TB-K1 (16) | Resin10 (8) | E-84 (1) | Ester (5) |

*In the table, the numbers in parenthesis means "amounts expressed in part by mass" unless otherwise indicated.

-Evaluation of Performances of Toner-

Next, with respect to the resulting toners 1 to 8, rising property of electrification, storage stability and odor were evaluated. The results are shown in Table 6.

<Evaluation Results of Rising Property of Electrification of Toner>

0.6 g of each toner and 19.4 g of silicone ferrite carrier (manufactured by Kanto Denka Kogyo Co., Ltd., average particle size=90 μm) were put in a 50 ml volumetric polyethylene bottle and mixed at 250 r/min, and then a charge amount was measured using a Q/M meter (manufactured by Epping Co.). A ratio of a charge amount after mixing 15 seconds to a maximum charge amount during mixing 600 seconds (a charge amount after mixing 15 seconds/a maximum charge amount during mixing 600 seconds) was calculated and rising property of electrification was evaluated according to the following evaluation criteria.

[Evaluation Criteria]

A: Calculated ratio is 0.8 or more.

B: Calculated ratio is 0.6 or more and less than 0.8.

C: Calculated ratio is 0.4 or more and less than 0.6.

D: Calculated ratio is less than 0.4.

<Method for Evaluation of Toner Storage Stability>

Two samples were prepared by placing 4 g of each toner in an opening type cylindrical container having a diameter of 5 cm and a height of 2 cm. One sample was allowed to stand under an environment of a temperature of 40° C. and a relative humidity of 60%, while the other sample was allowed to stand under an environment of a temperature of 55° C. and a relative humidity of 60% for 72 hours. After standing, the container containing the toner was slightly shaked and it was visually observed whether or not aggregation of the toner occurs. Then, storage stability was evaluated according to the following evaluation criteria.

[Evaluation Criteria]

A: No toner particle aggregation was observed both at 40° C. and 55° C.

B: No toner particle aggregation was observed at 40° C.; however, some toner particles were aggregated at 55° C.

C: Some aggregated toner particles were observed at 40° C., and distinct toner aggregation was observed at 55° C.

D: Distinct toner aggregation was observed both at 40° C. and 55° C.

<Method for Evaluation of Odor of Toner>

20 g of each toner was weighed in an aluminum cup (manufactured by Teraoka Corporation, FM-409 (body)and the aluminum cup was allowed to stand on a hot plate heated to 150° C. for 30 minutes, and then odor generated from the toner was evaluated on the following evaluation criteria.

[Evaluation Criteria]

A: No odor

B: Almost no odor

C: Faint odor; no practical problems

D: Strong odor

Examples 1 to 6 and Comparative Examples 1 to 2

-Formation and Evaluation of Image-

Figure 20:
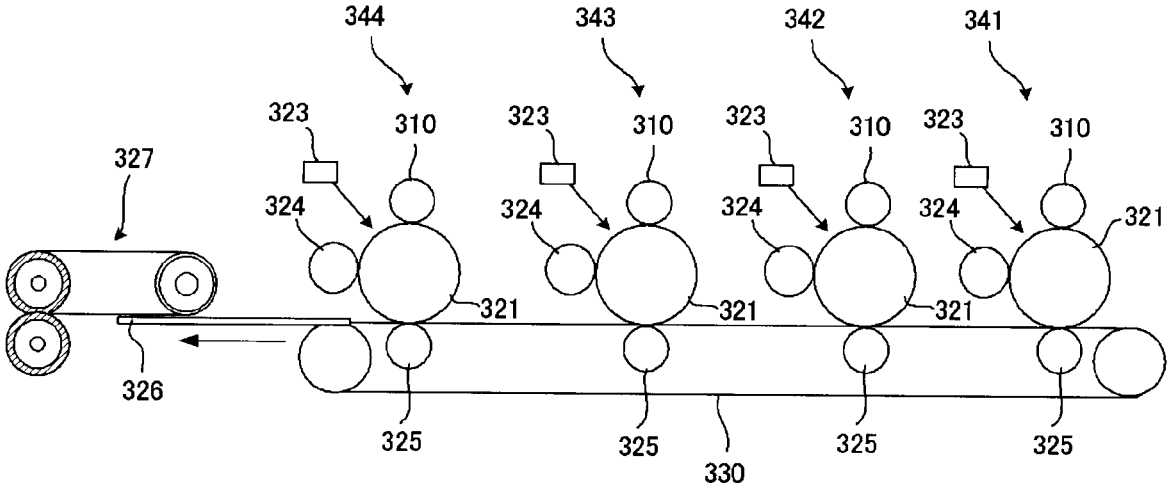
FIG. 20 is a schematic view showing an example of an image forming apparatus A used in Examples.

The toners 1 to 8 thus prepared were charged in an image forming apparatus A shown in FIG. 20 and an image was formed, and then various performances were evaluated. The results are shown in Table 6.

<Image Forming Apparatus A>

An image forming apparatus A shown in FIG. 20 is a tandem type image forming apparatus of a direct transferring system, which employs a contact charging system, a one-component developing system, a direct transferring system, a cleanerless system and an internal heating belt fixing system.

In the image forming apparatus A shown in FIG. 20, a contact type charging roller as shown in FIG. 1 is used as a charging unit 310. A one-component developing apparatus as shown in FIG. 5 is used as a developing unit 324 and this processor employed a cleanerless system capable of recovering the residual toner. A belt type fixing device as shown in FIG. 9 is employed as a fixing unit 327 and this fixing device employs a halogen lamp as a heat source of a heating roller. In FIG. 20, the numeral 330 denotes a conveyance belt.

Regarding image forming element 341 in the image forming apparatus A shown in FIG. 20, a charging unit 310, an exposing unit 323, a developing unit 324 and a transferring unit 325 are provided around a photoconductor drum 321. While the photoconductor drum 321 in the image forming element 341 rotates, a latent electrostatic image corresponding to an exposed image is formed on the surface of the photoconductor drum through charge by the charging unit 310 and exposure by the exposing unit 323. This latent electrostatic image is developed with a yellow toner by the developing unit 324 to form a visualized image on the photoconductor drum 321 by the yellow toner. This visualized image is transferred onto a recording medium 326 by the transferring unit 325, and then the toner left on the photoconductor drum 321 is recovered by the developing unit 324. Similarly, a visualized image of a magenta toner, a cyan toner and a black toner is superposed on the recording medium 326 by each of image forming elements 342, 343 and 344 and the color image formed on the recording medium 326 is fixed by a fixing unit 327.

<Fixation Properties>

-Lower Limit of Fixation Temperature-

Using the image forming apparatus A, adjustment was performed so that a solid image is formed on a thick transfer paper (copying paper <135> manufactured by NBS Ricoh Co., Ltd.) by developing 1.0±0.05 mg/cm$^2$ of toner, and a temperature of a fixing unit was changed, and then a lower limit of fixation temperature was measured. The lower limit of fixation temperature means the fixing unit's temperature at which an image density of 70% or more is ensured after rubbing the resulting fixed image with a pat.

[Evaluation Criteria]

A: Lower limit is lower than 135° C.

B: Lower limit is 135° C. or higher and lower than 145° C.

C: Lower limit is 145° C. or higher and lower than 155° C.

D: Lower limit is higher than 155° C.

Hot Offset Generation Temperature

It was visually observed whether or not hot offset is generated in a fixed image by evaluating fixation in the same manner as in case of the above lower limit of fixation temperature. The fixing roller temperature at which hot offset was generated was taken as a hot offset generation temperature.

[Evaluation Criteria]

A: Hot offset generation temperature is 190° C. or higher

B: Hot offset generation temperature is 185° C. or higher and lower than 190° C.

C: Hot offset generation temperature is 170° C. or higher and lower than 180° C.

D: Hot offset generation temperature is lower than 170° C.

<Image Quality>

With respect to image quality, the presence or absence of change of color tone (hue) caused by an output image, background smear, image density, change, and blurring were evaluated. The presence of abnormal image was visually checked for image quality evaluation based on the following four-rank criteria.

[Evaluation Criteria]

A: No image abnormality was observed; good.

B: Very slight difference in hue, image density and background smear was observed, but it is practically satisfactory under an environment of a normal temperature and humidity.

C: Change in color tone (hue), image density, and background smear was slightly observed.

D: Distinct change in color tone and image density, and background smear were clearly observed, and it is practically unsatisfactory.

<Filming Resistance>

Using the above image forming apparatus A, a running test was performed at a printing rate of an image occupancy ratio of 7% using a 6000 paper sheet manufactured by Ricoh Company, Ltd. After printing 10,000, 30,000 and 50,000 sheets, it was evaluated whether or not filming on a photoreceptor and abnormal image (haltone density unevenness) caused by filming occurs. Frequency of generation of filming increases as the number of sheets to be printed increases. Evaluation was performed according to the following criteria.

[Evaluation Criteria]

A: Good

B: Filming was not generated even after printing 50,000 sheets.

C: Filming was generated after printing 30,000 sheets.

D: Filming was generated after printing 10,000 sheets; practically unsatisfactory level.

<Overall Rank>

The results of various types of toner performance were generally evaluated on the following criteria.

A: Good

B: Practically satisfactory level

D: Practically unsatisfactory level

TABLE 6

| | Toner No. | Rising property of electrification | Storage stability | Odor | Image forming apparatus No. | Fixing properties: Lower limit of fixation temperature | Fixing properties: Hot offset generation temperature | Filming resistance | Image quality | Overal rank |
|---|---|---|---|---|---|---|---|---|---|---|
| Example 1 | Toner 1 | A | A | A | A | A | A | A | A | B |
| Example 2 | Toner 2 | A | B | A | A | A | A | A | A | B |
| Example 3 | Toner 3 | A | B | A | A | A | B | A | A | B |
| Example 4 | Toner 4 | A | A | A | A | B | B | A | A | B |
| Example 5 | Toner 5 | A | B | C | A | B | A | A | A | B |
| Example 6 | Toner 6 | A | C | C | A | A | B | B | B | B |
| Com. Ex. 1 | Toner 7 | C | D | D | A | A | C | B | C | D |
| Com. Ex. 2 | Toner 8 | B | C | C | A | B | B | D | D | D |

Examples 7 to 12 and Comparative Examples 3 to 4

Preparation of Carrier

According to the following coat material formulation, components were dispersed by a stirrer for 10 minutes to prepare a coating solution and this coating solution and 5,000 parts by mass of a core material (Cu—Zn ferrite particles, weight average particle size=35 μm) were charged in a coating device for coating while forming a spinning stream, comprising a fluidized bed, and a rotary bottom plate disc and a stirring blade disc arranged in the fluidized bed, and then the coating solution was coated on a core material. The resulting coated core material was baked in an electric furnace at 250° C. for 2 hours to prepare a carrier.

[Composition of Coating Material]

| | |
|---|---|
| Toluene | 450 parts by mass |
| Silicone resin (SR2400, manufactured by Dow Corning Toray Silicon Co., Ltd., nonvolatile content: 50% by mass) | 450 parts by mass |
| Aminosilane (SH6020, manufactured by Dow Corning Toray Silicon Co., Ltd.) | 10 parts by mass |
| Carbon black | 10 parts by mass |

Preparation of Two-Component Developer

Each of 5% by mass of the toners 1 to 10 thus obtained and 95% by mass of the carrier thus obtained were mixed using a tubular mixer (manufactured by Willy A. Bachofen AG Maschinenfabrik, T2F) for 5 minutes to prepare two-component developers 1 to 8.

Formation and Evaluation of Image

Image Formation and Evaluation

Figure 21:
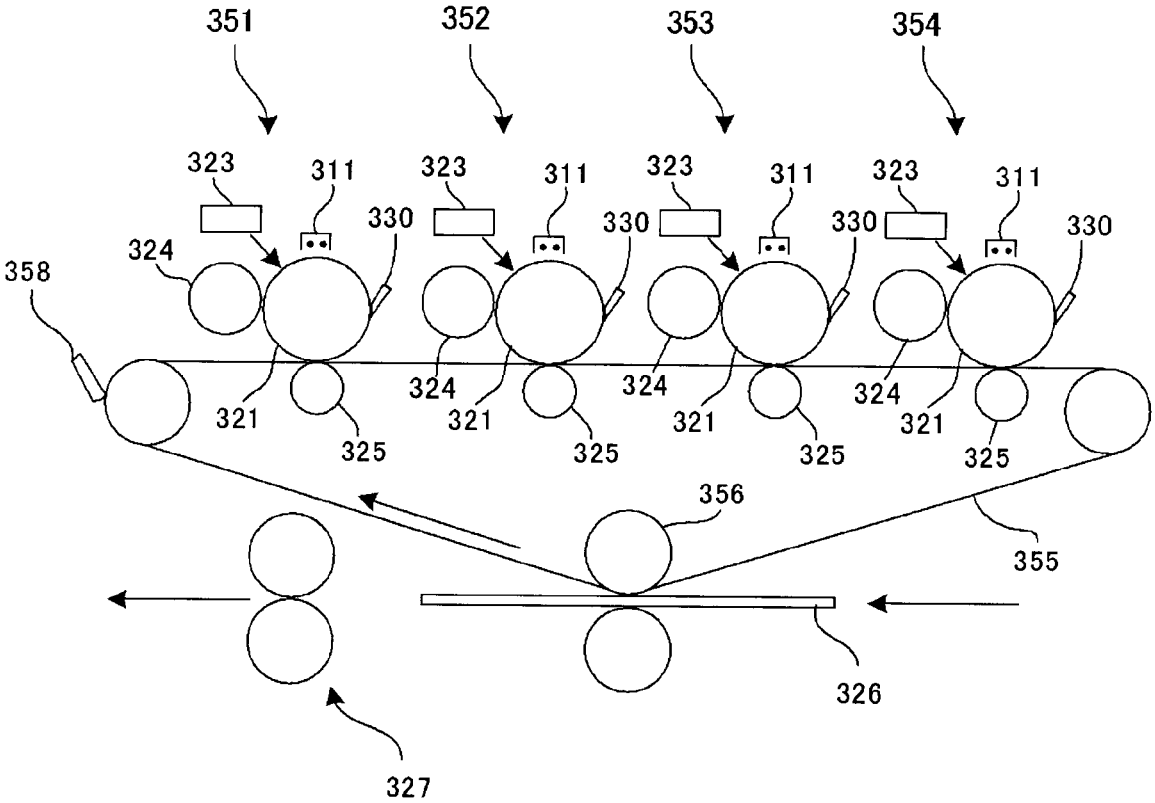
FIG. 21 is a schematic view showing an example of an image forming apparatus B used in Examples.

The two-component developers 1 to 8 thus prepared were charged in an image forming apparatus B shown in FIG. 21 and an image was formed, and then stability with time was evaluated. In the same manner as in Examples 1 to 6 and Comparative Examples 1 to 2, images were evaluated for fixation properties, image quality and filming resistance, and general evaluations were made. The results are shown in Table 7.

<Image Forming Apparatus B>

An image forming apparatus B shown in FIG. 21 is a tandem type image forming apparatus of an indirect transferring system, which employs a non-contact charging system, a two-component developing system, a secondary transferring system, a blade cleanerless system and an external heating roller fixing system.

In the image forming apparatus B shown in FIG. 21, a non-contact type corona charger as shown in FIG. 3 is employed as a charging unit 311. A two-component developing apparatus as shown in FIG. 6 is employed as a developing unit 324. A cleaning blade as shown in FIG. 10 is employed as a cleaning unit 330. A roller type fixing device of an electromagnetic induction heating system as shown in FIG. 12 is employed as a fixing unit 327.

Regarding image forming element 351 in the image forming apparatus B shown in FIG. 21, a charging unit 311, an exposing unit 323, a developing unit 324, a primary transferring unit 325 and a cleaning unit 330 are provided around a photoconductor drum 321. While the photoconductor drum 321 in the image forming element 351 rotates, a latent electrostatic image corresponding to an exposed image is formed on the surface of the photoconductor drum through charge by the charging unit 310 and exposure by the exposing unit 323. This latent electrostatic image is developed with a yellow toner by the developing unit 324 to form a visualized image on the photoconductor drum 321 by the yellow toner. This visualized image is transferred onto an intermediate transferring belt 355 by a primary transferring means 325, and then the yellow toner left on the photoconductor drum 321 is remove by the cleaning unit 330. Similarly, a visualized image of a magenta toner, a cyan toner and a black toner is formed on the intermediate transferring belt 355 by each of image forming elements 342, 343 and 344. The color image on the intermediate transferring belt 355 is transferred onto the recording medium 326 by a transferring device 356 and the toner left on the intermediate transferring belt 355 is removed by an intermediate transferring belt cleaning unit 358. The color image formed on the recording medium 326 is fixed by a fixing unit 327.

TABLE 7

| | Two-component developer No. | Image forming apparatus No. | Fixing properties: Lower limit of fixation temperature | Fixing properties: Hot offset generation temperature | Filming resistance | Image quality | Overal rank |
|---|---|---|---|---|---|---|---|
| Example 7 | Developer 1 | B | A | A | A | A | B |
| Example 8 | Developer 2 | B | A | A | A | A | B |
| Example 9 | Developer 3 | B | A | B | A | A | B |
| Example 10 | Developer 4 | B | B | B | A | A | B |
| Example 11 | Developer 5 | B | B | A | A | A | B |
| Example 12 | Developer 6 | B | A | B | B | B | B |
| Com. Ex. 3 | Developer 7 | B | A | C | B | C | D |
| Com. Ex. 4 | Developer 8 | B | B | B | D | D | D |

From the results shown in Table 6 and Table 7, it is possible to recognize that the toners or developers of Examples 1 to 12 are excellent in low-temperature fixation properties and anti-offset properties, in contrast to the toners using an unmodified rosin of Comparative Examples 1 and 3 and the toners containing a resin derived from a maleic acid-modified rosin alone of Comparative Examples 2 and 4, and have good storage stability even under severe conditions, and are also excellent in filming resistance and rising property of electrification and can stably attain excellent image quality.

The image forming apparatus, the image forming method and the process cartridge of the present invention are capable of formation of an extremely high quality image, which is excellent in low-temperature fixation properties, anti-offset properties, storage stability, rising property of electrification and filming resistance and does not generate odor, and also causes no change in color tone when used for a long period of time and is free from abnormality such as decrease in density or background smear, and thus they can be widely used for laser printers, direct digital plate makers, full color laser copying machines using a direct or indirect electrographic multicolor image developing system, full-color laser printers, and fill-color plain paper facsimiles.

What is claimed is:

1. An image forming apparatus comprising:

a latent electrostatic image bearing member;

a charging unit configured to charge a surface of the latent electrostatic image bearing member;

an exposing unit configured to expose the charged surface of the latent electrostatic image to form a latent electrostatic image thereon;

a developing unit configured to develop the latent electrostatic image with a toner to form a visualized image;

a transferring unit configured to transfer the visualized image onto a recording medium; and a fixing unit configured to fix the visualized image to the recording medium, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resin (A) is a resin which is derived from a (meth)acrylic acid-modified rosin and which comprises a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which comprises a polyester unit obtained by condensation polymerization of an alcohol component and a carboxylic acid component containing any one of a fumaric acid-modified rosin and a maleic acid-modified rosin.

2. The image forming apparatus according to claim 1, wherein the charging unit is a charging unit configured to charge the latent electrostatic image bearing member without involving any contact with the latent electrostatic image bearing member.

3. The image forming apparatus according to claim 1, wherein the charging unit is a charging unit configured to charge the latent electrostatic image bearing member while being in contact with the latent electrostatic image bearing member.

4. The image forming apparatus according to claim 1, wherein the developing unit comprises a developer bearing member which comprises a magnetic field generating unit fixed inside, the developer bearing member being rotated while bearing on its surface a two-component developer composed of a magnetic carrier and a toner.

5. The image forming apparatus according to claim 1, wherein the developing unit comprises a developer bearing member to which the toner is supplied, and a layer thickness controlling member which forms a thin layer of toner on the surface of the developer bearing member.

6. The image forming apparatus according to claim 1, wherein the transferring unit is a transferring unit configured to transfer a visualized image formed on the latent electrostatic image bearing member onto a recording medium.

7. The image forming apparatus according to claim 1, comprising a plurality of image forming elements arranged therein, each including at least a latent electrostatic image bearing member, a charging unit, a developing unit and a transferring unit, wherein each transferring unit is a transferring unit configured to transfer onto a recording medium a visualized image formed on the corresponding the latent electrostatic image bearing member, the surface of the recording medium being configured to pass through a transfer portion where each transferring unit faces the corresponding latent electrostatic image bearing member.

8. The image forming apparatus according to claim 1, wherein the transferring unit comprises an intermediate transfer member onto which a visualized image formed on the latent electrostatic image bearing member is primarily transferred, and a secondary transferring unit configured to secondarily transfer the visualized image formed on the intermediate transfer member onto a recording medium.

9. The image forming apparatus according to claim 1, further comprising a cleaning unit, wherein the cleaning unit comprises a cleaning blade which is brought into contact with the surface of the latent electrostatic image bearing member.

10. The image forming apparatus according to claim 1, wherein the developing unit comprises a developer bearing member to be brought into contact with the surface of the latent electrostatic image bearing member, develops the latent electrostatic image formed on the latent electrostatic image bearing member, and recovers toner particles left on the latent electrostatic image bearing member.

11. The image forming apparatus according to claim 1, wherein the fixing unit is a fixing unit which comprises at least one of a roller and a belt and is configured to fix the visualized image transferred on the recording medium by application of heat and pressure by heating from the side which is not in contact with the toner.

12. The image forming apparatus according to claim 1, wherein the fixing unit is a fixing unit which comprises at least one of a roller and a belt and is configured to fix the transferred image transferred on the recording medium by application of heat and pressure by heating from the side which is in contact with the toner.

13. The image forming apparatus according to claim 1, wherein an alcohol component of at least one of a resin derived from a (meth)acrylic modified rosin and a resin derived from a fumaric acid/maleic acid-modified rosin contains an aliphatic alcohol.

14. The image forming apparatus according to claim 1, wherein the content of the (meth)acrylic acid-modified rosin in the carboxylic acid component of a resin derived from a (meth)acrylic acid-modified rosin is from 5% by mass to 85% by mass, and the total content of the fumaric acid-modified rosin and the maleic acid-modified rosin in the carboxylic acid component of a resin derived from fumaric acid/maleic acid-modified rosin is from 5% by mass to 85% by mass.

15. The image forming apparatus according to claim 1, wherein at least one of the (meth)acrylic acid-modified rosin, the fumaric acid-modified rosin and the maleic acid-modified rosin is obtained by modifying a purified rosin.

16. The image forming apparatus according to claim 1, wherein an alcohol component of at least one of a resin derived from a (meth)acrylic modified rosin and a resin derived from fumaric acid/maleic acid-modified rosin contains a trihydric or higher alcohol, a carboxylic acid component of at least one of a resin derived from a (meth)acrylic modified rosin and a resin derived from a fumaric acid/maleic acid-modified rosin contains a trihydric or higher carboxylic acid compound, or the alcohol component contains a trihydric or higher alcohol and the carboxylic acid component contains a trihydric or higher carboxylic acid compound.

17. The image forming apparatus according to claim 1, wherein the content of a low molecular weight component having a molecular weight of 500 or less in at least one of the polyester-based resin (A) and the polyester-based resin (B) is 12% or less.

18. The image forming apparatus according to claim 1, wherein condensation polymerization of at least one of a resin derived from a (meth)acrylic modified rosin and a resin derived from a fumaric acid/maleic acid-modified rosin is performed in the presence of at least one of a titanium compound and a tin(II) compound having no Sn—C bond.

19. The image forming apparatus according to claim 1, wherein the total content of a resin derived from a (meth) acrylic modified rosin and a resin derived from a fumaric acid/maleic acid-modified rosin in the binder resin is 70% by weight or more.

20. The image forming apparatus according to claim 1, wherein at least one of the degree of modification of the (meth)acrylic acid rosin with (meth)acrylic acid, the degree of modification of the fumaric acid-modified rosin with fumaric and the degree of modification of maleic acid-modified rosin with maleic acid-modified rosin is from 5 to 105.

21. The image forming apparatus according to claim 1, wherein a softening point of the polyester-based resin (A) is from 80° C. to 120° C. and a softening point of the polyester-based resin (B) is from 100° C. to 180° C.

22. An image forming method comprising:

charging a surface of a latent electrostatic image bearing member;

exposing the charged surface of the latent electrostatic image to form a latent electrostatic image thereon;

developing the latent electrostatic image with a toner to form a visualized image;

transferring the visualized image onto a recording medium; and fixing the visualized image to the recording medium, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resin (A) is a resin which is derived from a (meth)acrylic acid-modified rosin and which comprises a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which comprises a polyester unit obtained by condensation polymerization of an alcohol component and a carboxylic acid component containing any one of a fumaric acid-modified rosin and a maleic acid-modified rosin.

23. A process cartridge comprising:

a latent electrostatic image bearing member; and a developing unit configured to develop a latent electrostatic image formed on the latent electrostatic image bearing member with a toner to form a visualized image thereon, the process cartridge being removable from the body of an image forming apparatus, wherein the toner comprises a binder resin and a coloring agent, and the binder resin comprises a polyester-based resin (A) and a polyester-based resin (B) having a melting point which is at least 10° C. higher than that of the polyester-based resin (A), the polyester-based resin (A) is a resin which is derived from a (meth)acrylic acid-modified rosin and which comprises a polyester unit obtained by condensation polymerization of an alcohol component and a carboxylic acid component containing a (meth)acrylic acid-modified rosin, and the polyester-based resin (B) is a resin which is derived from a fumaric acid/maleic acid-modified rosin and which comprises a polyester unit obtained by condensation polymerization of an alcohol component and a carboxylic acid component containing any one of a fumaric acid-modified rosin and a maleic acid-modified rosin.

* * * * *